US012582873B1

(12) United States Patent
Whalen et al.

(10) Patent No.: US 12,582,873 B1
(45) Date of Patent: Mar. 24, 2026

(54) COMPARATIVE EXERCISE SESSION EQUIVALENCE FOR UNWEIGHTED EXERCISE, MICROGRAVITY SYSTEMS AND RELATED DEVICES AND METHODS

(71) Applicants: Robert Tremaine Whalen, Los Altos, CA (US); Boost Treadmills, LLC, Palo Alto, CA (US)

(72) Inventors: Sean Tremaine Whalen, Mountain View, CA (US); Thomas Jack Waldo Allen, Palo Alto, CA (US); Robert Tremaine Whalen, Los Altos, CA (US); Matthew Laye, Boise, ID (US)

(73) Assignee: Boost Treadmills, LLC, Palo Alto, CA (US)

( * ) Notice: Subject to any disclaimer, the term of this patent is extended or adjusted under 35 U.S.C. 154(b) by 172 days.

(21) Appl. No.: 18/237,873

(22) Filed: Aug. 24, 2023

Related U.S. Application Data

(63) Continuation-in-part of application No. 17/964,851, filed on Oct. 12, 2022, now Pat. No. 11,883,713.
(Continued)

(51) Int. Cl.
*A63B 24/00* (2006.01)
*A63B 22/02* (2006.01)

(52) U.S. Cl.
CPC ..... *A63B 24/0075* (2013.01); *A63B 22/02* (2013.01); *A63B 2024/0068* (2013.01);
(Continued)

(58) Field of Classification Search
CPC ..... A63B 21/00181; A63B 22/02; A63B 2208/053; A63B 2225/093; A63B 2225/62
See application file for complete search history.

(56) References Cited

U.S. PATENT DOCUMENTS 5,133,339 A * 7/1992 Whalen ..... A63B 21/00181 482/52
7,591,795 B2 * 9/2009 Whalen ..... A63B 22/02 600/19
(Continued)

OTHER PUBLICATIONS

Kraft, Jennifer C. et al., "Bodyweight support alters the relationship between preferred walking speed and cost of transport," Elsevier B.V., 2023.
(Continued)

*Primary Examiner* — Joshua Lee
(74) *Attorney, Agent, or Firm* — KandareIP, LLC; Anthony Kandare

(57) ABSTRACT

A method is provided of evaluating comparative equivalence for a user of a MicroGravity system between an unsupported exercise session and an unweighted MicroGravity exercise session. The method includes receiving, for a comparative group of the unweighted and unsupported sessions, an unweighting for each and a $1^{st}$ exercise parameter for a base selection of the group having a first run speed and a first incline. The method includes evaluating a session output for the comparative group based on the first run speed and incline and an unweighting of the base selection, which includes determining, for a comparison selection of the comparative group and the session output, based on an unweighting of the comparison selection, a $2^{nd}$ exercise parameter having a second run speed and a second incline. The method further includes providing to the user session output and comparative information including the second speed and the second incline.

23 Claims, 43 Drawing Sheets

Related U.S. Application Data

(60) Provisional application No. 63/254,972, filed on Oct. 12, 2021, provisional application No. 63/254,969, filed on Oct. 12, 2021, provisional application No. 63/255,001, filed on Oct. 12, 2021.

(52) U.S. Cl.
CPC . *A63B 2024/0093* (2013.01); *A63B 2208/053* (2013.01); *A63B 2220/30* (2013.01); *A63B 2220/50* (2013.01); *A63B 2225/093* (2013.01); *A63B 2225/62* (2013.01); *A63B 2230/438* (2013.01); *A63B 2230/755* (2013.01)

(56) References Cited

U.S. PATENT DOCUMENTS

| | | | | |
|---|---|---|---|---|
| 7,645,212 | B2 | 1/2010 | Ashby et al. | |
| 7,805,186 | B2 | 9/2010 | Pulkkinen et al. | |
| 8,464,716 | B2 * | 6/2013 | Kuehne | A63B 21/00181 601/19 |
| 8,840,572 | B2 * | 9/2014 | Whalen | A61G 10/023 601/6 |
| 8,900,098 | B2 * | 12/2014 | Egan | A63B 24/0087 482/4 |
| 9,272,175 | B2 * | 3/2016 | Egan | A63B 21/00181 |
| 9,454,541 | B2 | 9/2016 | Chou | |
| 9,642,764 | B2 * | 5/2017 | Kuehne | A61H 1/00 |
| 10,004,656 | B2 * | 6/2018 | Whalen | A63B 21/00181 |
| 10,111,589 | B2 | 10/2018 | Kirby et al. | |
| 10,154,789 | B2 | 12/2018 | Raghuram et al. | |
| 10,219,734 | B2 * | 3/2019 | Williams | A62B 31/00 |
| 10,342,461 | B2 * | 7/2019 | Basta | A61B 5/1038 |
| 10,366,628 | B2 | 7/2019 | White et al. | |
| 10,674,958 | B2 | 6/2020 | Bleich et al. | |
| 10,709,935 | B2 | 7/2020 | Anderson | |
| 10,843,036 | B2 * | 11/2020 | Bayerlein | A63B 69/0064 |
| 11,134,890 | B2 | 10/2021 | Kirby et al. | |
| 11,311,732 | B2 | 4/2022 | Bleich et al. | |
| 11,517,781 | B1 * | 12/2022 | Whalen | A61G 10/023 |
| 11,559,720 | B2 * | 1/2023 | Bayerlein | A63B 22/025 |
| 2002/0025889 | A1 * | 2/2002 | Egger | A63B 22/0605 482/57 |
| 2003/0149615 | A1 | 8/2003 | Orban | |
| 2007/0054783 | A1 * | 3/2007 | Egger | A61H 1/0237 601/1 |
| 2012/0238921 | A1 * | 9/2012 | Kuehne | A63B 71/0009 601/5 |
| 2014/0194252 | A1 * | 7/2014 | Arimoto | A63B 23/04 482/51 |
| 2015/0379239 | A1 * | 12/2015 | Basta | A63B 22/02 434/247 |
| 2016/0007885 | A1 * | 1/2016 | Basta | A61B 5/112 600/595 |
| 2016/0250519 | A1 | 9/2016 | Watterson | |
| 2017/0128769 | A1 * | 5/2017 | Long | A61G 10/02 |
| 2017/0367916 | A1 * | 12/2017 | Kuehne | A63B 22/02 |
| 2019/0392939 | A1 * | 12/2019 | Basta | G16H 20/30 |
| 2020/0221975 | A1 * | 7/2020 | Basta | A63B 24/0075 |
| 2021/0187348 | A1 * | 6/2021 | Phillips | A63B 22/02 |
| 2021/0299520 | A1 | 9/2021 | Evancha et al. | |
| 2022/0054893 | A1 * | 2/2022 | Basta | A63B 24/0075 |
| 2022/0401782 | A1 * | 12/2022 | Whalen | A63B 21/4009 |
| 2023/0058141 | A1 * | 2/2023 | Long | A63B 24/0062 |
| 2023/0158363 | A1 * | 5/2023 | Bayerlein | A63B 21/4009 482/54 |

OTHER PUBLICATIONS

Vincent, Heather K. et al., "Role of Antigravity Training in Rehabilitation and Return to Sport After Running Injuries," Arthroscopy, Sports Medicine and Rehabilitation, vol. 4, No. 1., Jan. 2022, pp. e141-e149.

Huang, Chenhui et al., "Method for Estimating Temporal Gait Parameters Concerning Bilateral Lower Limbs of Healthy Subjects Using a Single In-Shoe Motion Sensor through a Gait Event Detection Approach," Sensors MDPI, 2022.

Naylon, Jordyn A. et al., "Novice Users of a Bodyweight-Supporting Treadmill Require Familiarization," Journal of Sport Rehabilitation, 2022, vol. 31, issue 6.

R. Scott Van Zant et al., "Impact of Varying Exercise Intensity on Oxygen Uptake and Cardiovascular Response during Body Weight Supported Treadmill Walking in Healthy Adults," International Journal of Sports Exercise Medicine, 2022 @213.

Lee, David K. et al., "Training on a Lower Body Positive Pressure Treadmill with Body Weight Support does not Improve Aerobic Capacity," International Journal of Exercise Science 14(7), pp. 829-839, 2021.

Fleckenstein, Daniel et al., "Effect of Uphill Running on VO2, Heart Rate and Lactate Accumulation on Lower Body Positive Pressure Treadmills," MDPI Journal of Sports, 2021.

Mark Wagner and Kevin D. Dames, "Making the Grade: An Exploration of Incline Running on a Bodyweight-Supportive Treadmill," Journal of Sport Rehabilitation, vol. 30, issue 6, 2021.

R. Whiteley et al., "Lower limb EMG activation during reduced gravity running on an incline. Speed matters more than hills irrespective of indicated bodyweight," Elsevier B.V., ScienceDirect, Gait Posture, 83 pp. 52-59, 2021.

R. Whiteley et al., "Effect of speed and gradient on plantar force when running on an AlterG treadmill," BMC Sports Science, Medicine and Rehabilitation, 13:34, 2021.

T. Brussau and R. Oehring et al., "Cardiorespiratory and metabolic responses to exercise testing during lower-body positive pressure running," Journal of Applied Physiology, 128: 778-784, 2020.

D. Fleckenstein et al., "Physiological and Metabolic Reaction to Lower Body Positive Pressure Treadmill Running," German Journal of Sports Medicine, 71, Jan. 2020.

K. Masumoto et al., "Metabolic Costs During Backward Running with Body Weight Support," International Journal of Sports Medicine, 2019.

W. Hoogkamer et al., "A Comparison of the Energetic Cost of Running in Marathon Racing Shoes," Sports Medicine, 48:1009-1019, 2018.

C. T. Brennan et al., "Can anti-gravity running improve performance to the same degree as over-ground running," Journal of Sports Sciences, Mar. 2018.

F. Stucky et al., "The Effect of Lower-Body Positive Pressure on the Cardiorespiratory Response at Rest and during Submaximal Running Exercise," Frontiers of Physiology, vol. 9, Article 34, 2018.

T. Roussos et al., "Muscle activity during locomotion in various inclination surfaces and different running speeds," ACTA Orthopaedica Et Traumatolotica Hellinca, vol. 69, Issue 4, Dec. 2018.

K. Barnes and J. Janecke, "Physiological and Biomechanical Responses of Highly Trained Distance Runners to Lower-Body Positive Pressure Treadmill Running," Barnes and Janecke Sports Medicine, 3: 41, 2017.

C. Temple et al., "Run Economy on a Normal and Lower Body Positive Pressure Treadmill," International Journal of Exercise Science, 10(5), pp. 774-781, 2017.

K. A. Farina et al., "Physiological and Biomechanical Responses to Running on Lower Body Positive Pressure Treadmills in Healthy Populations," Springer Sports Medicine, Jul. 2016.

Ka-Young Lee, MD et al., Physiological Responses During the Lower Body Positive Pressure Supported Treadmill Test, Ann. Rehabil. Medicine, 40(5); 915-923, 2016.

B. Gojanovic et al., "Overspeed HIIT in Lower-Body Positive Pressure Treadmill Improves Running Performance," Medicine & Science in Sports & Exercise, American College of Sports Medicine, 2015.

J. R. Kline et al., "Conversion Table for Running on Lower Body Positive Pressure Treadmills," Journal of Strength and Conditioning Research, 29(3), pp. 854-862, 2015.

Mcneil, David K.P. et al., "Oxygen Consumption of Elite Distance Runners on an Anti-Gravity Treadmill," Journal of Sports Science and Medicine, vol. 14, pp. 333-339, 2015.

(56) References Cited

OTHER PUBLICATIONS

Mcneill, David K.P. et al., "Metabolic Accomodation to Running on a body weight-supported treadmill," European Journal of Applied Physiology, Dec. 2014.
Buona, Michael J. et al., "Alternations in the Rate of Limb Movement Using a Lower Body Positive Pressure Treadmill Do Not Influence Respiratory Rate or Phase III Ventilation," BioMed Research International, Hindawi Publishing, 2014.
Dr. Nikolaos Koutlianos et al., "Indirect estimation of VO2 max in athletes by ACSM's equation: valid or not?," Hippokratia, 17(2), pp. 136-140, 2013.
Gojanovic, B. et al., "Maximal Physiological Parameters during Partial Body-Weight Support Treadmill Testing," Medicine & Science in Sports & Exercise, American College of Sports Medicine, 2012.
Hoffman MD and Donaghe He, "Physiological Responses to Body Weight-Supported Treadmill Exercise in Healthy Adults," Arch Phys. Med. Rehabil., vol. 82, Jun. 2011.
Schlabs, H. et al., "Oxygen Consumption During Walking and Running Under Fractional Weight Bearing Conditions," Aviation, Space, and Environmental Medicine, vol. 81, No. 6, Jun. 2010.
Grabowski, A.M., Phd, "Metabolic and Biomechanical Effects of Velocity and Weight Support Using a Lower-Body Positive Pressure Device During Walking," Arch Phys. Med. Rehabil., vol. 91, Jun. 2010.
A. Grabowski and R. Kram, "Effects of Velocity and Weight Support on Ground Reaction Forces and Metabolic Power During Running," Journal of Applied Biomechanics, vol. 24, pp. 288-297, 2008.
Gottshall, J. S., "Ground reaction forces during downhill and uphill running," Journal of Biomechanics, 38, pp. 445-452, 2005.
W. Brent Edwards, "Modeling Overuse Injuries in Sport as Mechanical Fatigue Phenomenon," American College of Sports Medicine, Exercise and Sport Reviews, 0091-6331/4604/224-231, 2018.
Firminger, C. R. et al., "Joint kinematics and ground reaction forces in overground versus treadmill graded running," Elsevier, ScienceDirect, Gait & Posture 63, pp. 1109-1113, 2018.
Ryan, M. R. et al., "Comparison of different measures to monitor week-to-week changes in training load in high school runners," International Journal of Sports Science & Coaching, pp. 1-10, Sage Publishing, 2020.
Warden, S. J. et al., "Preventing bone stress injuries in runners with optimal workload," HHS Public Access, Current Osteoporos Rep., 19(3), pp. 298-307, 2022.
Dr. Thor Besier, "The importance of measuring lower limb cumulative load in sport: a mechanobiological approach," I Measure U Ltd., White Pager, 2017.

* cited by examiner

TABLE / CHART REFERENCES

| MPH | PACE/MI. | PACE EQ. – Incline % | | | | | | |
|---|---|---|---|---|---|---|---|---|
| | | 0% | 1% | 2% | 3% | 4% | 5% | 6% |
| 5.0 | 12:00 | 12:31 | 11:44 | 11:05 | 10:32 | 10:03 | 9:38 | 9:1 |
| 5.2 | 11:32 | 12:02 | 11:18 | 10:42 | 10:11 | 9:44 | 9:20 | 8:5 |
| 5.4 | 11:07 | 11:35 | 10:55 | 10:20 | 9:51 | 9:26 | 9:03 | 8:4 |
| 5.6 | 10:43 | 11:10 | 10:32 | 10:00 | 9:33 | 9:09 | 8:48 | 8:2 |
| 5.8 | 10:21 | 10:47 | 10:12 | 9:42 | 9:16 | 8:53 | 8:33 | 8:1 |
| 6.0 | 10:00 | 10:26 | 9:52 | 9:24 | 9:00 | 8:38 | 8:19 | 8:0 |
| 6.1 | 9:50 | 10:15 | 9:43 | 9:16 | 8:52 | 8:31 | 8:12 | 7:5 |
| 6.2 | 9:41 | 10:05 | 9:34 | 9:08 | 8:44 | 8:24 | 8:06 | 7:4 |
| 6.3 | 9:31 | 9:56 | 9:26 | 9:00 | 8:37 | 8:17 | 7:59 | 7:4 |
| 6.4 | 9:23 | 9:46 | 9:17 | 8:52 | 8:30 | 8:10 | 7:53 | 7:3 |
| 6.5 | 9:14 | 9:37 | 9:09 | 8:45 | 8:23 | 8:04 | 7:47 | 7:3 |
| 6.6 | 9:05 | 9:26 | 9:01 | 8:37 | 8:16 | 7:56 | 7:41 | 7:2 |
| 6.7 | Pace: | Mins | MPH | 95% | 90% | 85% | 80% | 75% | 70% | 65 |
| 6.8 | 5:00 | 1.00 | 12.0 | 12.3 | 12.6 | 12.9 | 13.2 | 13.7 | 13.8 | 13 |
| 6.9 | 5:05 | 0.08 | 11.8 | 12.1 | 12.4 | 12.7 | 13.0 | 13.1 | 13.6 | 13 |
| 7.0 | 5:10 | 0.17 | 11.6 | 11.9 | 12.2 | 12.6 | 12.8 | 13.1 | 13.4 | 13 |
| 7.1 | 5:15 | 0.25 | 11.4 | 11.8 | 12.0 | 12.4 | 12.6 | 12.9 | 13.2 | 13 |
| 7.2 | 5:20 | 0.38 | 11.3 | 11.6 | 11.9 | 12.2 | 12.5 | 12.8 | 13.1 | 13 |
| | 5:25 | 0.42 | 11.1 | 11.4 | 11.7 | 12.0 | 12.3 | 12.6 | 12.9 | 13 |
| | 5:30 | 0.50 | 10.9 | 11.2 | 11.5 | 11.8 | 12.1 | 12.4 | 12.7 | 12 |
| | 5:35 | 0.58 | 10.7 | 11.0 | 11.3 | 11.6 | 11.9 | 12.2 | 12.5 | 12 |
| | 5:40 | 0.67 | 10.6 | 10.9 | 11.2 | 11.5 | 11.8 | 12.1 | 12.4 | 12 |
| | 5:45 | 0.75 | 10.4 | 10.7 | 11.0 | 11.3 | 11.6 | 11.9 | 12.2 | 12 |
| | 5:50 | 0.83 | 10.3 | 10.6 | 10.9 | 11.2 | 11.5 | 11.8 | 12.1 | 12 |
| | 5:55 | 0.90 | 10.1 | 10.4 | 10.7 | 11.0 | 11.3 | 11.6 | 11.9 | 12 |
| | 6:00 | 1.00 | 10.0 | 10.3 | 10.6 | 10.9 | 11.2 | 11.5 | 11.8 | 12 |
| | 6:05 | 0.00 | 9.9 | 10.2 | 10.5 | 10.8 | 11.1 | 11.4 | 11.7 | 12 |
| | 6:10 | 0.17 | 9.7 | 10.0 | 10.3 | 10.6 | 10.9 | 11.2 | 11.5 | 11 |

5063

PROPRIETARY RESEARCH

| MPH | PACE/MI. | PACE EQ. – Incline % | | | | | | |
|---|---|---|---|---|---|---|---|---|
| | | 0% | 1% | 2% | 3% | 4% | 5% | 6% |
| 5.0 | 12:00 | 12:31 | 11:44 | 11:05 | 10:32 | 10:03 | 9:38 | 9:1 |
| 5.2 | 11:32 | 12:02 | 11:18 | 10:42 | 10:11 | 9:44 | 9:20 | 8:5 |
| 5.4 | 11:07 | 11:35 | 10:55 | 10:20 | 9:51 | 9:26 | 9:03 | 8:4 |
| 5.6 | 10:43 | 11:10 | 10:32 | 10:00 | 9:33 | 9:09 | 8:48 | 8:2 |
| 5.8 | 10:21 | 10:47 | 10:12 | 9:42 | 9:16 | 8:53 | 8:33 | 8:1 |
| 6.0 | 10:00 | 10:26 | 9:52 | 9:24 | 9:00 | 8:38 | 8:19 | 8:0 |
| 6.1 | 9:50 | 10:15 | 9:43 | 9:16 | 8:52 | 8:31 | 8:12 | 7:5 |
| 6.2 | 9:41 | 10:05 | 9:34 | 9:08 | 8:44 | 8:24 | 8:06 | 7:4 |
| 6.3 | 9:31 | 9:56 | 9:26 | 9:00 | 8:37 | 8:17 | 7:59 | 7:4 |
| 6.4 | 9:23 | 9:46 | 9:12 | 8:52 | 8:30 | 8:10 | 7:53 | 7:3 |
| 6.5 | 9:14 | 9:37 | 9:09 | 8:45 | 8:23 | 8:04 | 7:47 | 7:3 |
| 6.6 | 9:05 | 9:26 | 9:01 | 8:37 | 8:16 | 7:55 | 7:41 | 7:2 |
| 6.7 | | | | | | | | |
| 6.8 | | | | | | | | |
| 6.9 | | | | | | | | |
| 7.0 | | | | | | | | |
| 7.1 | | | | | | | | |
| 7.2 | | | | | | | | |

| Pace | Mins | MPH | 95% | 90% | 85% | 80% | 75% | 70% | 65 |
|---|---|---|---|---|---|---|---|---|---|
| 5:00 | 1.00 | 12.0 | 12.3 | 12.6 | 12.9 | 13.2 | 13.5 | 13.8 | 13 |
| 5:05 | 0.08 | 11.8 | 12.1 | 12.4 | 12.7 | 13.0 | 13.3 | 13.6 | 13 |
| 5:10 | 0.17 | 11.6 | 11.9 | 12.2 | 12.6 | 12.8 | 13.1 | 13.4 | 13 |
| 5:15 | 0.25 | 11.4 | 11.8 | 12.0 | 12.4 | 12.6 | 12.9 | 13.2 | 13 |
| 5:20 | 0.38 | 11.3 | 11.6 | 11.9 | 12.2 | 12.5 | 12.8 | 13.1 | 13 |
| 5:25 | 0.42 | 11.1 | 11.4 | 11.7 | 12.0 | 12.3 | 12.6 | 12.9 | 13 |
| 5:30 | 0.50 | 10.9 | 11.2 | 11.5 | 11.8 | 12.1 | 12.4 | 12.7 | 12 |
| 5:35 | 0.58 | 10.7 | 11.0 | 11.3 | 11.6 | 11.9 | 12.2 | 12.5 | 12 |
| 5:40 | 0.67 | 10.6 | 10.9 | 11.2 | 11.5 | 11.8 | 12.1 | 12.4 | 12 |
| 5:45 | 0.75 | 10.4 | 10.7 | 11.0 | 11.3 | 11.6 | 11.9 | 12.2 | 12 |
| 5:50 | 0.83 | 10.3 | 10.6 | 10.9 | 11.2 | 11.5 | 11.8 | 12.1 | 12 |
| 5:55 | 0.90 | 10.1 | 10.4 | 10.7 | 11.0 | 11.3 | 11.6 | 11.9 | 12 |
| 6:00 | 1.00 | 10.0 | 10.3 | 10.6 | 10.9 | 11.2 | 11.5 | 11.8 | 12 |
| 6:05 | 0.00 | 9.9 | 10.2 | 10.5 | 10.8 | 11.1 | 11.4 | 11.7 | 12 |
| 6:10 | 0.17 | 9.7 | 10.0 | 10.3 | 10.6 | 10.9 | 11.2 | 11.5 | 11 |

5050

EQUIVALENCE ENGINE – METS EXAMPLES (potential option)

Metabolic Equations for Estimating Gross $VO_2$ (ACSM 2000)

{ Exercise mode Gross $VO_2$ ($ml \cdot kg^{-1} \cdot min^{-1}$) + Resting $VO_2$ ($ml \cdot kg^{-1} \cdot min^{-1}$) }

Walking $VO_2 = (S^a \times 0.1) + (S \times G^b \times 1.8) + 3.5$

Running $VO_2 = (S^a \times 0.2) + (S \times G^b \times 0.9) + 3.5$

5082

Where S is Speed or Velocity in meters/min. and G is Gradient or Incline in % incline.

(Metabolic Equivalent of Task) Run MET Output (per kg) = Gross $VO_2$ (ACSM above) / Resting $VO_2$

5091

MET (Run) Output UNsupported (e.g., Tm)(per kg) = Run MET Output (per kg) * (Tm Factor) = Exercise Output (unsupported)~m)

where Tm Factor is approximated by 93%BW for identified output losses on UW Tm vs. reg. Tm & ACSM for over-estimate evals.

MET (Run) Output MicroGravity (per kg) = Run MET Output Unsupported (per kg) * (UW Factor) = Unweighted Exercise Output for a user partially unweight by a UW%, such that a bodyweight of the user is effectively a corresponding %BW (1-UW%).

5091

Energy Expenditure (Energy output kcal./min.) = Run MET (Output/kg) * Resting $VO_2$ (ml $O_2$ / min.) * Mass (kg) *

1 L / 1000ml * 5 kcal / L $O_2$ = Run MET * 3.5/200 =

Energy Exercise Output = 3.5 MET(Run)/200 = (kcal./min.)

WorkRate (W) = mass(kg) * V(m/s) * (On TM relationship)/0.98 kJ/kg/m*(1+sin ((θ)), where θ is treadmill angle

FIG. 12

MULTI-SESSION WORKOUT EVALUATION; CUMULATIVE EQ ESTIMATE

MicroGravity Workout

| | TIME | TRAVELED | SPEED | PACE | % B.Wgt. | INCLINE | Energy Used |
|---|---|---|---|---|---|---|---|
| | 5:22 | 0.85 miles | 8.0 mph | 7:30 | 84% | 2% | 60.3 kcal |
| | 4:38 | 0.74 miles | 8.0 mph | 7:30 | 84% | 4% | 56.0 kcal |
| | 4:00 | 0.4 miles | 8.0 mph | 7:30 | 84% | 0% | 27.8 kcal |
| | 1:00 | 0.11 miles | 8.0 mph | 7:30 | 80% | 0% | 42.2 kcal |
| OVERALL | 15:00 | 2.1 miles | 8.0 mph | 7:30 | - | - | 192.3 kcal |

Cumulative Workout - EQ Sessions

| | TIME | DISTANCE | SPEED | PACE | % B.Wgt. | INCLINE | Output (kcal) |
|---|---|---|---|---|---|---|---|
| UW MicroGravity | 15:00 | 2.0 miles | 8.0 mph | 7:30 | 80% | 2% | 207.5 kcal |
| Off-Tm | 15:00 | 1.57 miles | 6.5 mph | 6:23 | 85% | 2% | 207.5 kcal |

FIG. 25

Table 12-8. P3T drills, exercises and schedule template

| Strength and Mobility Drills and Exercises | | | | |
|---|---|---|---|---|
| Pregnancy | Upper Body | Lower Body | Core | Flexibility |
| Kegel<br>Standing Trunk<br>Curve<br>Pelvic Clock<br>Deep Sumo Squat<br>CRP | SSD<br>Chest Press<br>Biceps Curls<br>Seated Row<br>Shrug<br>Bent Over Row<br>Lat Pull Down | Hip Stability Drill<br>Front Leaning<br>Rest Mod<br>Hamstring Curls<br>Leg Press<br>Squat Bender<br>Forward Lunge<br>Deep Sumo Squat | 4C<br>CD1 Mod<br>Trunk Extension<br>Trunk Flexion<br>Front Leaning Rest<br>Mod<br>Sit-ups Mod<br>Reverse Sit-ups<br>Oblique Sit-up | PMCS<br>RD Mod<br>PD Mod |

| Endurance Activities | | | |
|---|---|---|---|
| No Impact Lower Body | Light Impact Lower Body | Moderate Intensity Lower Body | Upper Body |
| Rowing Machine<br>Aqua-jogging<br>Elliptical<br>Stationary Cycling | MMD1 / RUD<br>Treadmill walking<br>Foot March | Stair Climber<br>Water Aerobics<br>Release Run | Upper Body Cycle<br>Rope Climb Machine |

FIG. 30

COMPARATIVE EXERCISE SESSION EQUIVALENCE FOR UNWEIGHTED EXERCISE, MICROGRAVITY SYSTEMS AND RELATED DEVICES AND METHODS

CROSS-REFERENCES TO RELATED APPLICATIONS

This application is a continuation-in-part of U.S. Frame and Related Devices and Methods"; U.S. prov. App. No. 63/254,969 patent application Ser. No. 17/964,851 filed on Oct. 12, 2022, entitled "DAP System Control and Related Devices and Methods," which claims priority to the following U.S. provisional patent applications: U.S. prov. app. No. 63/254,972 filed on Oct. 12, 2021, entitled "DAP System, Enclosure, Seal filed on Oct. 12, 2021 entitled "DAP System, Platform, integrated Lifts and Related Devices and Methods"; and U.S. prov. app. No. 63/255,001 filed on Oct. 12, 2021, entitled "DAP System, Enclosure, Controls and Related Devices and Methods".

Each of the above applications is hereby specifically incorporated by reference in its entirety, correlation

BACKGROUND

Aspects, concepts, and features described herein relate to supplemental equipment for exercise and rehabilitation devices, and particularly to equipment known as unweighting. MicroGravity (MG), lower body positive pressure (LBPP), or differential air pressure (DAP) exercise systems, devices and methods, as well as to related devices, systems and methods for use with or pertaining to exercise sessions for the same. More particularly, aspects, concepts, and features described herein pertain to unweighted exercise and MicroGravity system user interaction, evaluation & control methods based on exercise session equivalence and related devices, which includes evaluating comparative equivalence for an unweighted exercise session of a user with a non-unweighted exercise session and providing comparative equivalence information to the user.

MicroGravity Systems; Unweighted Exercise Benefits

Systems for unweighting individuals for rehabilitation and fitness training have been a popular modality. Traditional methods have included aquatic training and using a hoist to lift a person or animal off a walking surface. Harness and hoist systems provide benefits related to their historical use that are well-known and can provide precise and granular unweighting, but become uncomfortable at off-loading greater than about 25% of normal body weight. Further, aquatic systems can be difficult to control in terms of degree of off-loading, and are cumbersome to use along with having large space and resource requirements.

MicroGravity (MG) systems have been developed that create an unweighting pressure differential across a portion of a user, which can vary pressure differentials more precisely and are easier to use than aquatic or lift systems allowing for a wide range of unloading in small steps. One such benefit is in the case of rehabilitation, for which it has been shown that small amounts of unweighting can effectively determine and bypass a pain threshold below which a user can exercise pain free. MG systems apply a pressure difference at a portion of the user's body with a net upward force at the center of pressure, which when oriented parallel with the force of gravity located near the user's waist, applies off-loading or partial unweighting of the user's bodyweight for effectively creating a microgravity environment that can minimally alter natural gait patterns during exercise. These systems are generally in commercial use in rehabilitation and training centers around the world.

Conventional MG systems have been commercialized by companies like Showa Denki in Japan, Sasta Fitness of the UK, Vacuwell of Poland, and AlerG Inc. in the US. While these conventional systems offer benefits, they are expensive, large, minimally adjustable or have limited adjustability vs. corresponding standard devices, require specialized power sources, or have limited market access due to high costs, burdens, or general design discomfort for users of different body types or heights. These conventional MG systems rely on rigid, complex support structures that limit user flexibility of the underlying treadmill or other exercise device, such as inhibiting exercise parameter adjustments typically available to the user on corresponding standard devices like limited incline % adjustability by the user and/or that have a fixed gradient set at or near level.

For many of these conventional MG systems, incline or gradient setting modifications can impact orientation of pressure differentials and/or related structural support arrangements and controls for the inflated system, which if readily adjustable by the user, can present undo stress on system frameworks, increase risks for the user and/or create other challenges for the MG system. Thus, many conventional MG systems lock or limit the user's ability for readily modifying exercise parameters vs. traditional non-unweighted exercise sessions and devices. These limitations can impact exercise output for the user and, more significantly, limit performance options that may be appropriate for the user. Thus, many conventional MG systems hinder availability or effective use of particular therapeutic, rehabilitation or fitness training options and corresponding exercise benefits in accordance with needs of each user.

Unweighted Exercise—Lack of User Understanding/Insight; Difficult to Assess Progress Most conventional MG systems are adapted for use with a treadmill exercise device and/or they incorporate a treadmill device with the overall MG system, such that the user walks, jogs and/or runs for exercise activity during an unweighted session in a manner similar as for exercise activity using a standard treadmill. Most users indicate comfort and ready understanding of effects, impacts, intensity and/or fitness progress or improvements occurring for traditional exercise sessions via walking, jogging or running as exercise activity using non-unweighted (traditional) exercise equipment, such as exercise activity using a standard treadmill and/or on a track or open terrain. However, many users are unfamiliar with unweighted exercise and, even after performing multiple of unweighted exercise sessions, report uneasiness and lack of understanding of effects, impacts, intensity and/or fitness progression after walking, jogging or running sessions partial unweighting conditions.

Both traditional treadmills systems and conventional MG systems provide basic exercise session information to the user as aids to the user for monitoring their exercise session activity, evaluating intensity or performance, and recognizing related progress and fitness improvements. This basic session information includes gait velocity, such as walk or run speed while using the exercise device, session duration such as time-expended information or display showing progress against a fixed period for the session, exercise output information like estimated kcals burned or expended, and optionally heartrate information. For an unweighted exercise session on a conventional MG system, the basic session information further includes unweighting information for the partial unweighting of the user for the session.

The additional unweighting information provided to the user for conventional MG systems identifies an amount of upward unweighting applied to the user during an exercise session that offsets downward gravitational force on the user, which is the user's full bodyweight. For instance, the user can receive unweight information for a session in the form of applied bodyweight support %, which indicates an amount of upward, unweighting force applied to the user as a percentage of the user's bodyweight (e.g., bodyweight support of 20% indicates an upward, unweighting support force of 20% of the user's bodyweight being applied for the session), or alternatively in the form of % bodyweight showing the effective, reduced bodyweight of the user expressed as a percentage of their full bodyweight experienced for the session due to unweighting (e.g., 80% bodyweight=bodyweight support of 20%).

For most users, basic session information provided to the user for a standard exercise session on a traditional treadmill readily provides sufficient user insight and understanding that enables the user to assess performance and recognize fitness improvements between sessions over time, such as recognizing fitness improvements over a period of weeks for standard treadmill sessions by the user. Conversely, the opposite is true for many such users despite receiving similar basic information for unweighted sessions the user performs on a conventional MG system along with receiving the additional unweighted information. As a further aid to the user for understanding and assessing unweighted exercise on a MG system, conventional MG systems, related devices and methods, and/or related user support entities typically record unweighted session information for the user and provide or make available historical unweighted session performance information to the user especially when performed or planned as part of a rehabilitation or therapy plan. These unweighted session records provide each user with comparative session performance information that can help the user identify improvements and goal-related progress for the unweighted exercise sessions without providing insight or understanding of impacts, effects, and or aspects of unweighted exercise.

User understanding, insight and recognition of exercise performance is typically important for motivating the user, enhancing the user's involvement with exercise plans and for providing feedback regarding therapy and rehabilitation plans and goals, as well as for increasing user engagement and interactivity with exercise plans or goals, such as to push themselves during sessions for meeting or exceeding performance goals, providing feedback or adjustment recommendations to professional aids for an exercise session based, for example, on recognizing fitness or rehabilitation improvements and challenges. Despite basic information provided to the user and/or supplemental comparative historical or personal session information often made available to the user by conventional MG systems, these systems, related devices and methods fail to provide the user with effective, useful information for effective insight and understanding of an unweighted exercise session or sufficient user recognition of fitness or rehabilitation improvements from unweighted exercise sessions. Many users of conventional MG systems struggle with effectively understanding impacts and effects of unweighted exercise in general or their session performance, much less for enabling the user to assess performance improvements. Comparative unweighted exercise information in the form of unweighted session history information that is provided to the user via conventional MG systems, related devices and methods, and/or by support entities provided little, if any, beneficial understanding or effective insight regarding an unweighted exercise session on a conventional MG system or for recognizing therapeutic, fitness and other improvements gained from unweighted exercise beyond performance trends of unweighted exercise on its own. These deficiencies of conventional MG systems, and related devices and methods inhibit user engagement and realization of enhanced benefits of MG systems and unweighted exercise.

Despite drawbacks and limitations of conventional MG systems and related devices and methods, such inadequacies pale in comparison with enormous therapeutic benefits, training enhancements, and unparalleled advantages that unweighted exercise can provide to patients, athletes and others, such as enjoying greater mobility during periods of recovery or elevated risk of injury, reducing the user's therapy time, and/or enhancing training and fitness benefits compared with non-unweighted exercise. In other words, conventional MG systems and related unweighted exercise can be and are significant tools for advancing the state of therapeutic, rehabilitation and fitness arts. However, due to these drawbacks, limitations and deficiencies of conventional MG systems, related devices and methods, many users fail to realize potential or enhanced benefits available through effective use of unweighted exercise.

User Guidance or Insight Deficiencies, and Ineffective 'Tool' Usage

As with any tool, aid or assist device, realization of potential benefits of unweighted exercise is related to effective tool usage for best meeting needs of each user including reinforcing rehabilitation goals, avoiding user injury or adverse impacts, and enabling unweighted exercise options for best meeting recovery goals. Drawbacks, limitations and overall deficiencies discussed above for conventional MG systems, related devices and methods regarding user limitations for system flexibility or exercise session adjustments and/or user limitations for implementing exercise session options on their own limit effective usage of unweighted exercise for many users. Even without flexibility or adjustment limitations, overall deficiencies for providing users with effective unweighted exercise session insights and performance understanding of conventional MG systems, related devices and methods can significantly hinder effective use of unweighted exercise for users and prevent realization of enhanced benefits for the same without effectively enabling user understanding of their particular exercise session performance.

Some conventional MG systems, related technologies and methods rely on support entities, such as rehabilitation professionals, coaches and others, to provide supplemental unweighted exercise session information to the user, which often is not readily available or provided to user and, if so, is provided as general table, chart or guideline information that is difficult for the user to understand and of little benefit for rehabilitation and recovery efforts. The unweighted assessment and measurement information includes complex metabolic or physiological terms and information difficult for users to readily understand or effectively use for user involvement, engagement & feedback such as for recommending, modifying or customizing unweighted exercise sessions in accordance with recommendations of a support entity and the needs of each user. As such, technical metabolic or physiological information received from support entities including professional specialists and coaches fail to overcome these deficiencies of conventional MG systems, related devices and methods.

Many conventional efforts related to evaluating equivalence of unweighted exercise sessions have been pursued as scientific tests and research studies focused on precisely identifying metabolic or physiological response relationships and impacts of unweighted exercise on the user versus general trends and impacts for use by experts, professional support entities or athletic coaches. Such scientific tests have been performed according to highly structured test conditions having preset variables and parameters in accordance with accepted standards, and conducted according to particular procedures and protocols as appropriate for the specific research goals, such as specifically identifying metabolic, physiological or other particular responses or effects of unweighted exercise in accordance with the preset controls and study conditions of each study.

Technical results, specific conclusions, and research recommendations of these studies are provided to medical, therapy, and exercise physiology experts as technical references and publications along with recommendations and cautions for potential applications and parameters. Conventional research efforts, technical publications and references fail to provide effective user understanding regarding unweighted exercise sessions or related insights, and fail to overcome significant deficiencies of conventional MG systems for the same.

Research Efforts

Various research studies related to comparative equivalence information have been conducted that were each structured, performed, and analyzed under pre-set constraints to meet the study's particular research goal(s) in accordance with accepted practices. Particular results and conclusions for each were published along with identifying limitations (e.g., preset inputs, participant characteristics or potential bias, sample size); accuracy/inaccuracy (e.g., statistical analysis of error, p-values); analytics (e.g., linear regression equations); trends & anomalies for each equation (e.g., slope/consistency, equation comparisons, contrast and error analysis); discussion of results vs. hypotheses (e.g., equation characteristics, comparisons & trends vs, hypotheses), conclusions (based on results, accuracy, error, limitations, etc.); and practical applications and/or recommendations for further research in view of results and conclusions.

In other words, results of these studies were provided and intended for professional or scientific use that may appear related to evaluating comparative equivalence of an unweighted session for a user, but fail to describe or suggest evaluating the same for an unweighted session for a user of an MG system, nor describe or suggest providing comparative equivalence information to the user for providing understanding and insight for the unweighted session. Some test results include chart or table information according to discrete unweighting intervals and test speed values, and/or independent linear regression relationships for each discrete unweighting interval. These results are limited to the specific, preset unweighting intervals (e.g., 10% intervals) and range of gait speed inputs also tested at preset intervals and assessed for linear regression relationships having acceptable confidence levels (error analysis), which are affected by identified factor limitations, potential bias, or observed concerns and anomalies identified from data analytics, calculations and related data assessments, such as participant sample size, age/fitness levels, potential recruitment bias, and factors and effects of test environments and conditions such as elevation or test equipment impacts.

Kline et al. Research Effort—Reference Chart

As a notable example, a group of faculty and graduate students at the Northern Arizona University in Flagstaff, Arizona conducted unweighting research in 2014 seeking to identify "how much faster one must run on a [MicroGravity system] treadmill across a range of different running speeds and percentages of BW [bodyweight] to match the metabolic demand of running without BWS [bodyweight support]." which was described in a publication of the *Journal of Strength and Conditioning Research* in March 2015. John R. Kline et al "Conversion Table for Running on Lower Body Positive Pressure Treadmills," *Journal of Strength and Conditional Research,* 29(3): p. 854-862, March 2015 ("2015 Kline et al. study", introduction, lines 36-40). In particular, the research study "aimed to develop a user-friendly conversion table showing the speeds required on an (MG system) to match the equivalent metabolic output on a regular, [non-MG system] treadmill across a range of body weight supports." Id., Abstract, lines 10-13.

Consistent with the findings of numerous other research efforts seeking for precise metabolic output/unweighted run speed relationships for various research goals and purposes including exercise planning, the findings and results of Kline et al. study were "consistent with previous literature" regarding decreases in metabolic demand as unweighting increases, but with less precision than the stated aims. With respect to practical applications for the 2015 Kline et al. study, the publication stated, "[R]unning with BWS [bodyweight support] requires less effort than running without support, resulting in a lower cardiovascular training stimulus. The increase in speed needed to make up for the decrease in metabolic demand was highly dependent on the speed being run at. The findings are expressed in conversion tables, which can serve as a guideline for practitioners and coaches to develop training programs . . . [and to] summarize the required speed increases needed to match the metabolic output of running on a [MG system] for speeds ranging from (4 mph to 10 mph) and BWs [bodyweights from 50 to 100% in 10% increments. The tables can further be used as a starting point for future research" pertaining to rehabilitation and unweighted exercise. Id. at pg. 862, Practical Applications, lines 6-19.

The prior art research effort and proposed solutions of the 2015 Kline et al. study and proposed solution for providing a professional guideline Reference Chart provides little, if any, insight or understanding to a user of a MG system for an unweighted exercise session, and fails to overcome or effectively address such deficiencies of conventional MG systems, related devices and methods.

The results further highlighted the complex and technical nature of unweighted exercise that, despite lack of user understanding, nonetheless provides significant benefits for users. Thus, the 2015 Kline et al. provides little, if any, insight or understanding for users of MG systems, which further fails to overcome or effectively address such deficiencies of conventional MG systems, related devices and methods. Conversely, the 2015 Kline et al. study results reinforced the complex nature of unweighted exercise, related user confusion, and long felt user needs insight and understanding for unweighted exercise sessions for the user. In addition, the 2015 Kline et al. study identified limitations that are common for numerous other related research efforts pertaining to unweighted exercise related to aims of these studies for meeting particular goals, which focus almost universally on increased run or walk speeds needed for unweighted exercise sessions (horizontal exercise component) for precisely matching exercise output of corresponding non-unweighted exercise, such as walking or running on a standard treadmill.

For instance, at an extreme result depicted in Table 2 of the 2015 Kline et al. publication, non-unweighted exercise on standard treadmill for the run speed of 4 mph would require the user to run at the ridiculous speed of 87.44 mph if unweighted at 50% bodyweight support. Even for more reasonable run speed values, incredibly large run speed increases are identified are being required for many unweight levels, which would pose significant risks for many users if they were capable of running at such high speeds. Narrow focus presumably for research purposes, controls and protocols on gait speed differences alone for this study and for other research efforts pertaining to unweighted exercise fail to overcome noted deficiencies or address long felt needs of users of conventional MG systems, related devices and methods.

Other limitations and drawbacks of the 2015 Kline et al. research effort include results having narrow limits resulting from discrete preset research values, such as the preset 10% unweight intervals selected for this study along with noted concerns for interpolating or otherwise evaluating information between these intervals. Such limitations are common for other similar research efforts. Other drawbacks, limitations and deficiencies exist for this and other research efforts related to unweighting regarding testing or environment factors impacting results, such as performing the participant tests and data collection at an elevation of 7,000 feet, and other factors like potential participant bias from use of snowball sampling for recruitment and/or variability related to small sample size of participants and tests.

Overall, research efforts and proposed solutions have been attempted to clarify or quantify relationships between unweighted exercise for the user with metabolic or physiologic responses. Such research efforts and proposed solutions pertaining to exercise output or relationships between metabolic or physiological effects of unweighted exercise and gait speed, fail to overcome deficiencies of conventional MG systems, related devices and methods for providing users with insight and understanding of an unweighted exercise session on a conventional MG system, nor propose solutions that assist with the same. The precise nature of such research goals and related procedures have either provided results inapplicable or unrelated to overcoming deficiencies of conventional MG systems, related devices and methods described above, even if goals for these studies are directed to identifying relationships between unweighting applied to a user and metabolic or physiological responses.

Other Research Efforts—Physiological Responses: Multi-Study Reviews

Physiological responses of unweighted exercise and related impacts on users have been observed and are known in general as cause-effect trends and relationships, such that as levels of bodyweight support applied to a user's body increase for an unweighted exercise session, various physiological impacts on the users body are known to increase or decrease in response. Many of these responses exist by design like reduced ground reaction forces, impacts and loads a person experiences for walk or run exercise activity on a MG system known to decrease as unweight support is applied to the user. Some research studies have been pursued for quantifying or precisely identifying many of these response relationships during unweighted exercise on a MG system vs. partial unweighting applied to the user.

A review article published in 2016 Farina et al. (2016) breaks down into categories affected response parameters with respect to unweighted exercise that one may wish to compare including: 1. Biomechanical (a-Kinetic Parameters such as GRFs, b-Kinematic Parameters such as joint angles, c-Stride Characteristics such as stride length and stride frequency); 2. Neuromuscular Activation; 3. Physiological (O2 Consumption or VO2), Heart Rate or HR, Blood Lactate Accumulation or LA). There may be others, for which they are not all independent of each other. Kathryn A. Farina et al., "Physiological and Biomechanical Responses to Running on Lower Body Positive Pressure Treadmills in Healthy Populations. Further," *Sports Med*, Springer International Publishing, Switzerland, 2016. The 2016 Farina et al. publication provides, in a single reference, a fairly comprehensive overview of conventional proposed solutions pertaining to unweighted exercise sessions, evaluating exercise impacts and responses, and providing users with effective insights and understandings for evaluating progress for using MG systems and unweighted exercise, but which nonetheless fail to overcome drawbacks, limitations and deficiencies of conventional systems, devices and methods discussed above.

Thus, conventional MG systems, related control operations and methods, and control systems or other related devices, lack functionality for providing users with effective insights and understanding for unweighted exercise sessions, nor enable such users to effectively assess exercise performance. They also lack related functionality for aiding the user with providing effective input and feedback, making parameter adjustments, or setting up exercise sessions to the extent appropriate nor meeting therapy plans based on effective assessment information. Thus, needs exist for overcoming various drawbacks and limitations of conventional MG systems, controls and methods pertaining to user understanding, insight, and abilities for assessing physiological responses and impacts of unweighting and other factors on the user during unweighted exercise and for providing effective information to the user that can enable improved usage of MG systems for users, system performance and related functionality.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter. Aspects, concepts, and features described herein pertain to unweighted exercise and MicroGravity (MG) system user interaction, evaluation & control actions pertaining to comparative equivalence for a user of the MG system between an unweighted session and an non-unweighted (unsupported) session typically familiar to users, which includes evaluating comparative equivalence for an unweighted exercise session for the MG system user with an unsupported exercise session, and providing session output and comparative equivalence information to the user.

Methods of evaluating comparative equivalence between an unsupported exercise session (treadmill or off-treadmill) and an unweighted MicroGravity (MG) exercise session are described along with various examples that include providing session output and comparative equivalence information to the user, which the user can use as an effective tool for enhancing benefits for unweighted exercise. Users are typically familiar with unsupported exercise sessions either on or off a treadmill, such that relative or comparative information for unsupported and unweighted sessions having substantially the same session output can readily be used as a highly effective tool for enhancing usage and effectiveness of unweighted exercise.

Based on input values for unweight information of the sessions along with speed and incline % information for a first one of sessions (i.e., a base selection of either the unsupported or the unweighted session), information can be determined and provided for the second one (i.e., the remaining session) that can include comparative equivalence information for run or walk speed and incline % of the comparison (e.g., remaining selection). Providing information like session output and comparative equivalence information to the user can enable highly effective use of unweighted exercise concurrent with low injury risk for the user, such as enabling enhanced session customization and adjustment for the user. Actions for evaluating comparative equivalence and providing information to the user or support entity can be arranged to automatically and occur quickly, substantially in real-time, such that benefits can immediately be gained thereby. Related functionality and usage can provide further benefits, such as for related users that can include coaches, therapy professionals and other entities, such as for improved therapy or exercise planning purposes via evaluating comparative equivalence separately and/or in combination an unweighted session or MG system usage.

Accordingly, a method is provided of evaluating comparative equivalence between an unsupported exercise session of an unweighted MicroGravity (MG) exercise session for a user of an MG system, in which the MG system includes a computer, an MG treadmill, and an inflatable enclosure operable for partially unweighting the user. The method is performed by the computer for the MG system or other related computer. The method includes receiving, for a comparative group that includes the MG exercise session and the unsupported exercise session, that includes an unweighting associated with each exercise session of the comparative group and a $1^{st}$ exercise parameter for a base selection of the comparative group, for which an unweighting associated with the MG exercise session includes an unweight percentage for reducing the bodyweight of the user for the MG exercise session and the $1^{st}$ exercise parameter includes a first run speed and a first incline.

The method further includes evaluating a session output for the comparative group based on the first run speed, the first incline, and the unweighting associated with the base selection, which includes determining a $2^{nd}$ exercise parameter based on the session output and the UW associated with a comparison selection, which includes an exercise session selected from comparative group that is different from the base selection. The $2^{nd}$ exercise parameter includes a second run speed and a second incline, and the session output is substantially the same for the base selection and the comparison selection. In addition, the method includes providing to the user equivalence information comprising the second speed and the second incline.

In some implementations, for the providing, the session output information further includes one or more of a determined: Power output in watts, Work or energy output in calories or kilocalories, a volume of oxygen used represented as $VO_2$, a cumulative load estimate, and a cumulative load reduction. In some implementations, for the receiving, the unweighting associated with the unsupported exercise session is the bodyweight of the user, and for the evaluating the session output for the comparative group, the determining includes reverse calculating the $2^{nd}$ exercise parameter based on the session output evaluated for the base selection, such that the session output is substantially the same for the unweighted exercise session and the unsupported exercise session.

In some implementations, the evaluating the session output for the comparative group is performed based on at least one of attributes received by the computer for the user and exercise data for the user. The exercise data can include at least one of sensor data, $VO_2$ max measurements or calculations, fitness data, expelled gas information, heart rate data, and perceived intensity feedback. Further, the exercise data can include one of exercise data obtained during user performance of at least a portion of the exercise session for the base selection, and exercise data obtained for one or more historical or related exercise sessions for the user.

In some arrangements, for the evaluating a session output, the determining the $2^{nd}$ exercise parameter can further include calculating the $2^{nd}$ exercise parameter according to a relationship determined from a plurality of unweighted exercise sessions and unsupported exercise sessions of other users that are similar to the exercise sessions of the comparative group. The relationship can include at least one exercise parameter for an unsupported exercise session and an unweighted exercise session that have substantially the same session output, and the relationship can include one of an algorithm, a linear regression equation, and an exercise output calculation. In some arrangements, for the evaluating a session output, the determining the $2^{nd}$ exercise parameter can further include determining the $2^{nd}$ exercise parameter according to a comparison table established from a plurality of unsupported exercise sessions and unweighted exercise session of other users that are similar to the exercise sessions of the comparative group.

In some implementations, the method for evaluating comparative equivalence can be performed as pan of a method for controlling a MG system during use by the user for performing the unweighted MG session as a current unweighted exercise session, in which the evaluating can be performed substantially concurrently with the user performing the current unweighted exercise session. As such, for the receiving for the comparative group, the base selection for the comparative group can include the current unweighted exercise session and the $1^{st}$ exercise parameter can include the first run speed and the first incline for the current unweighted exercise session. For the evaluating the session output for the comparative group, the comparison selection can include the unsupported exercise session and the $2^{nd}$ exercise parameter for the comparison selection can include the second speed and the second incline. For the providing to the user the session output and comparative equivalence information, the providing can be performed in real-time substantially concurrently with the user performing the current unweighted exercise session. As such, real-time comparative equivalence information can be provided to the user during performance of the current unweighted exercise session.

Further, for the evaluating the session output for the comparative group, the unsupported exercise session can include exercise device environment parameters selectable as one of default or user-selected parameters, the second incline can include an incline % selectable as one of a default or user-selected incline %, and the providing to the user the session output and comparative equivalence information performed in real-time can include providing to the user baseline comparative equivalence information relative to the unsupported exercise session having the default or user-selected exercise device environment parameters and the default or user-selected incline %, which can each be selected according to according to user default comparative equivalence preferences. The preferences can include environment parameters for an off-treadmill, flat run unsupported exercise session, and a level exercise gradient with as default comparative equivalence preferences, among other options. The preferences can correspond with an exercise arrangement identified as familiar for the user for providing user-customized comparative equivalence information in real-time for user evaluation of the current unweighted exercise session. Further, on condition of receipt of one or more modification inputs for the current unweighted exercise session that include modified control values for at least one of the $1^{st}$ exercise parameter, the $2^{nd}$ exercise parameter or the unweighting associated with the current unweighted exercise session, evaluations for comparative equivalence can be repeated based on the modified control values associated with the current unweighted exercise session combined with any unmodified values the associated with the current unweighted exercise session, such that the user can be provided the session output and comparative equivalence information corresponding with the modified control values as real-time comparative equivalence information (e.g., real-time automatic update).

In some implementations, the unweighted MicroGravity exercise session and the unsupported exercise session can each include one of a walking session and a running session, in which the first run speed includes one of a first running velocity and a first walking velocity, and the second run speed includes one of a second running velocity and a second walking velocity. Further, the second incline can be different from the first incline, and in response to the receiving, the evaluating and the providing are performed automatically.

In some implementations, the evaluating can further include setting the second run speed to one of a matching or an adjusted best match run speed, and analyzing at least one potential value for the second incline for combining with the matching or the adjusted best match run speed such that the matched or the adjusted best match run speed combined with the second incline provides substantially the same session output. On condition the potential value provides substantially the same session output, for the providing, the session output and comparative equivalence information can further include the combination of the potential value for the second incline with the matched or the adjusted best match run speed. Further, for the setting the second run speed, the matching or the adjusted best match run speed can each be calculated for optimizing one of a temporal spatial factor and a kinetic response, in which the temporal spatial factor includes one of a cadence and a stride length, and the kinetic response can include one of a ground reaction force (GRF), an estimated load, a GRF impulse, and a perceived pain input.

In some arrangements, the evaluating the session output can further include calculating an unweighting (UW) factor for the base selection based on the unweighting associated with the base selection, calculating a metabolic output for the base selection based on the $1^{st}$ exercise parameter, and calculating the exercise output for the base selection based on the UW factor and the metabolic output. In some implementations, for the evaluating the exercise output, the calculating the metabolic output can include determining a Metabolic Equivalent of Task (MET) for the base selection, which can be substantially the same for the comparison selection. In other implementations, for the evaluating the session output, the calculating the metabolic output can include performing normalized, weight-independent and user-attribute independent calculations.

In yet other implementations, for the evaluating the session output, the calculating the metabolic output for the base selection can include determining the metabolic output according to a metabolic output relationship that substantially includes $(3.5+(0.2*v)+(0.9*v*G)$ where the v includes a velocity in meters/min. and the G includes a % grade in decimal form. In further implementations, for the calculating the UW factor for the base selection, on condition the unweighting includes the unweighting percentage of the bodyweight, the unweighting percentage can include a percentage bodyweight for the MG exercise session, and the calculating the UW factor for the base selection can include assessing the UW factor based on an unweight relationship that can include $(1-((-1.1302*(\%\ BW))+1.2045))$ where the % BW includes the percentage bodyweight in decimal form of the bodyweight of the user. In additional implementations, the evaluating the session output can further include calculating an estimated run environment factor (REF) for the base selection, and adjusting the metabolic output for the base selection based on the estimated REF to compensate for a run environment impact for a plurality of run environment options. The run environment options can include outdoor off-treadmill exercise, indoor off-treadmill exercise, powered treadmill exercise, user-powered treadmill exercise, and unsupported MG treadmill exercise. The calculating the estimated REF for the base selection can include calculating the estimated REF factor based on the unweight relationship of the UW factor, such that the estimated REF is determined based on a reduced percentage bodyweight of about 94% to about 98% of the bodyweight of the user.

In some implementations, the MG exercise session is a first MG exercise session of the MG system for the user, the unweighting is a first unweighting, the base selection is a first initial selection, the unsupported exercise session is a first unsupported exercise session, the comparison selection is a first remaining selection, the exercise output is a first exercise output, and the comparative equivalence is a first comparative equivalence, and the method can further include actions for a second session. As such, the method can further include evaluating a second comparative equivalence between a second unsupported exercise session and a partially unweighted second MG exercise session for the user. The evaluating the second comparative equivalence can include, for a second comparative group that includes the second MG exercise session and the second unsupported exercise session, receiving a second unweighting associated with each exercise session of the second comparative group, in which the second unweighting associated with the second MG exercise session can include a second unweight percentage for reducing the bodyweight of the user for the second MG exercise session, and receiving a $3^{rd}$ exercise parameter for a second base selection from the second comparative group, in which the $3^{rd}$ exercise parameter includes a third run speed and a third incline. The evaluating the second comparative equivalence can further include evaluating a second session output for the second comparative group based on the third run speed, the third incline, and the second unweighting associated with the second base selection, in which the second evaluating can include determining, for a second comparison selection selected from the second comparative group that is different from the second base selection, a $4^{th}$ exercise parameter that includes a fourth run speed and a fourth incline for the second comparison selection and the second session output based on the second unweighting associated with the second comparison selection. In addition, the evaluating the second comparative equivalence can include providing to the user for the second comparison selection, second session output and comparative equivalence information that can include the fourth speed and the fourth incline.

In some implementations, the method can further include receiving an input selection of a supplemental compare condition for a supplemental equivalence evaluation of a supplemental selection of one of the comparison selection, formulating a supplemental compare condition factor value for the comparison selection based on the supplemental compare condition, re-evaluating the $2^{nd}$ exercise parameter for the comparison selection based on the unweighting, and providing to one of the user and the support entity for the comparison selection, adjusted session output and comparative equivalence information that can include the user adjusted comparative session information that can include the adjusted $2^{nd}$ exercise parameter. The supplemental compare condition can include one of a weight change, a modified body composition, a performance footwear, an elevation, a gradient, a blood flow restriction, and an environment comprising one of an outdoor run, a treadmill run, or non-treadmill exercise device session.

In some implementation, the method can further include obtaining attribute data for the user, in which the attribute data can include one or more of the following: a bodyweight value for the user; gait information for the user including at least one of cadence information and stride length; historical exercise and performance data for the user; estimated height information; the user's age; the user's sex; metabolic test data for the user; sensor inputs, feedback, historical data, and current data; exercise monitor evaluation and determination data: heart rate information; body composition information that includes fat percentage and free fat percentage, and a plurality of biomechanical characteristics and run performance features for the user. Further, the method can include analyzing the attribute data according to equivalence engine processes for one or more of: adjustment factors, trends, metabolic feedback, and user limitations, and customizing one of determining an exercise output for the base selection and computing the $2^{nd}$ exercise parameter for the comparison selection according to the analyzing the attribute data.

The computer for the MicroGravity system can include one or more computers, which can be configured to perform particular operations or actions by virtue of having software, firmware, hardware, or a combination of them installed on the system that in operation causes or cause the system to perform the actions of the method. One or more computer programs can be configured to perform particular operations or actions by virtue of including instructions that, when executed by data processing apparatus, cause the apparatus to perform the actions of the method. Other arrangements according to aspects and features of the system or method can include corresponding computer systems, apparatus, and computer programs recorded on one or more computer storage devices, each configured to perform the actions of the method.

Other exercise-related support devices, related systems, and components, and/or methods according to aspects and features described herein will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIG. 12 depicts example metabolic relationships for potential use by the computer control system or equivalence engine for evaluating, determining, calculating, performing, and/or computing actions of the method of FIG. 8.

FIGS. 29 & 30 each depict example test standards, requirements, and/or guidelines for example usage of the comparative equivalence method of FIG. 28.

DETAILED DESCRIPTION

Figure 1A:
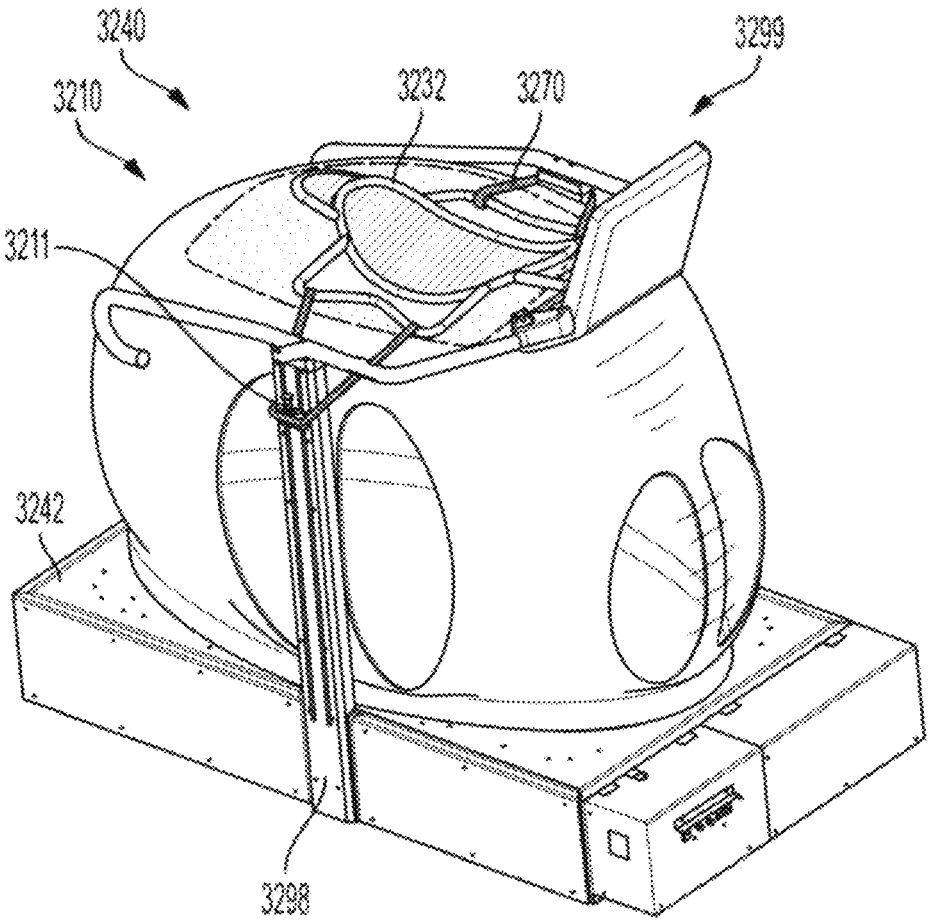
FIG. 1A is a top perspective view of an example schematic representation of an MG system supporting system operations for a flexible, inflatable enclosure of the MG system secured to a platform and an optional hybrid framework having height adjustment supports, which example system can support a wide range of system operations and optional functions in accordance with aspects and features described herein.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one arrangement," "an arrangement." or similar language means that a particular feature, structure, or characteristic described in connection with the arrangement is included in at least one arrangement of the present invention. Thus, appearances of the phrases "one arrangement," "an arrangement," and similar language throughout this specification can, but do not necessarily, all refer to the same arrangement, different arrangements, or component parts of the same or different illustrated invention. Additionally, reference to the wording "an arrangement," or the like, for two or more features, elements, etc. does not mean that the features are related, dissimilar, the same, etc. The use of the term "an arrangement," or similar wording, is merely a convenient phrase to indicate optional features, which may or may not be part of the invention as claimed.

Each statement of an arrangement is to be considered independent of any other statement of an arrangement despite any use of similar or identical language characterizing each arrangement. Therefore, where one arrangement is identified as "another arrangement," the identified arrangement is independent of any other arrangements characterized by the language "another arrangement." The independent arrangements are considered to be able to be combined in whole or in pan one with another as the claims and/or art may direct, either directly or indirectly, implicitly, or explicitly.

Finally, the fact that the wording "an arrangement," or the like, does not appear at the beginning of every sentence in the specification, such as is the practice of some practitioners, is merely a convenience for the reader's clarity. However, it is the intention of this application to incorporate by reference the phrasing "an arrangement," and the like, at the beginning of every sentence herein where logically possible and appropriate.

References for "herein" or similar terminology including "used herein," "shown herein" or "discussed herein" are understood to mean the instant patent application, as well as all related patent applications incorporated by reference and/or identified in the present application. Further, references for "herein: and the like are understood to include anticipated patent application filings for related subject matter and improvements including provisional or non-provisional patent applications that denote, identify or incorporate by reference the instant patent application.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more arrangements and optional elements, or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular" "round," "curvilinear." "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may already be designed prior to consideration for use of the same with an MG system and an existing exercise machine may further already be installed in the field, for example in a gym, training facility, etc. The reader shall interpret minor modifications of the exercise machine or existing exercise machine for use with an MG system as still part of the exercise machine and still within the spirit of the scope of the subject matter disclosed. Further, although many examples related to an MG System or example MG System are shown and discussed along with example treadmill exercise devices or equipment, it is understood that the application and invention are not so limited and various other types of exercise devices or equipment could replace the example treadmill devices or equipment.

As used herein, an "independently-supportable" inflatable enclosure refers to an inflatable enclosure formed from a substantially inelastic material defining a base opening configured for being secured to a base support, configured to form an airtight connection with an air supply, and defining a top port configured to form an airtight connection with a user interface such that, when inflated, secured to the air supply, and forming an airtight connection with a user, the inflatable enclosure is capable of independently extending in an upward direction from the base support and provide unweighting forces on the user without requiring a support framework, hybrid framework or other attachments or connections with support members regardless of whether the inflatable enclosure makes contact with a supplemental support member. As such, an independently supportable inflatable enclosure forms a hollow, thin-shelled inflatable support enclosure extending from secure attachment with the base support upward to the top port and user interface.

In accordance with a general aspect of concepts discussed herein, an inflatable unweighting enclosure for an exercise device is provided along with methods for controlling the same having a top port or opening formed therein, a corresponding generally hoop-shaped seal frame that can include a top frame or seal frame outlining the opening, and optionally a hybrid framework that can be selectively attached to the seal frame via a plurality of outboard-extending, ascending or vertically oriented tensile restraints while in the inflated state disposed about a horizontal perimeter portion of the enclosure. The seal frame can be configured to interface with a user's harness or other user interface and form a support connection therewith during use of the unweighting enclosure, in which the user extends into and through the top port and top bracket. Further, fixed connection arrangements for the hybrid transverse framework and lift components are further described herein along with control actions and operations for the same.

In accordance with various aspect and features of inventive concepts discussed herein, the inflatable enclosure can be configured to be self-supporting beyond its attachment at its base, such that configurations of the inflatable enclosure can inflate and operate without including a hybrid framework or other skeletal frame members arranged to restrain, modify and/or significantly shape the enclosure. Such a beneficial arrangement can allow operation of the MG at lower pressures and/or applications of forces than conventional MG systems, and thereby significantly reduce risks associated with usage, as well as provide enhanced freedoms of movement for the user.

Further, the above referenced various aspects and features of inventive concepts and related benefits can be enhanced, and uses and advantages pertaining to the same and to unweighted exercise in general more effectively realized, in accordance with additional aspects, concepts and features discussed herein along with various example usage, functionality, interactive and method scenarios shown and described herein pertaining to methods of evaluating comparative equivalence between an unsupported exercise session (treadmill or off-treadmill) and an unweighted Micro-Gravity (MG) exercise session along with providing comparative equivalence information to the user, which can provide effective tools for significantly enhancing benefits pertaining to unweighted exercise. Users are typically familiar with unsupported exercise sessions either on or off a treadmill, such that relative or comparative information for unsupported and unweighted sessions having substantially the same session output can be readily used as a highly effective tool for enhancing usage and effectiveness of unweighted exercise on its own and/or more broadly integrated into rehabilitation, therapy, athletic training and other plans and regimes.

Based on input values for unweight information of an unweighted and at least one unweighted comparative session option, with at least speed for the unweighted session and optionally incline % options/information for a first one of sessions (i.e., a base selection of either an unsupported or unweighted session), information can be determined and provided for the second one (i.e., the remaining session(s)) that can include comparative equivalence information for run or walk speed and optionally incline % of the comparison (e.g., remaining selection). Providing information like session output and comparative equivalence information to the user can enable highly effective use of unweighted exercise concurrent with low injury risk for the user, such as enabling enhanced session customization and adjustment for the user. Actions for evaluating comparative equivalence and providing information to the user and/or support entity can be arranged to occur automatically and quickly, substantially in real-time, such that benefits can immediately be gained thereby for evaluations of comparative equivalence corresponding with or related to performance of an unweighted exercise session. Related functionality and usage can provide other benefits and expanded usages, such as for related users that can include coaches, therapy professionals and other entities, like for improved therapy or exercise planning purposes via evaluating comparative equivalence separately and/or in combination with an unweighted session or MG system usage.

Example MG System for Supporting Example MG System Operations & Methods

Figure 1B:
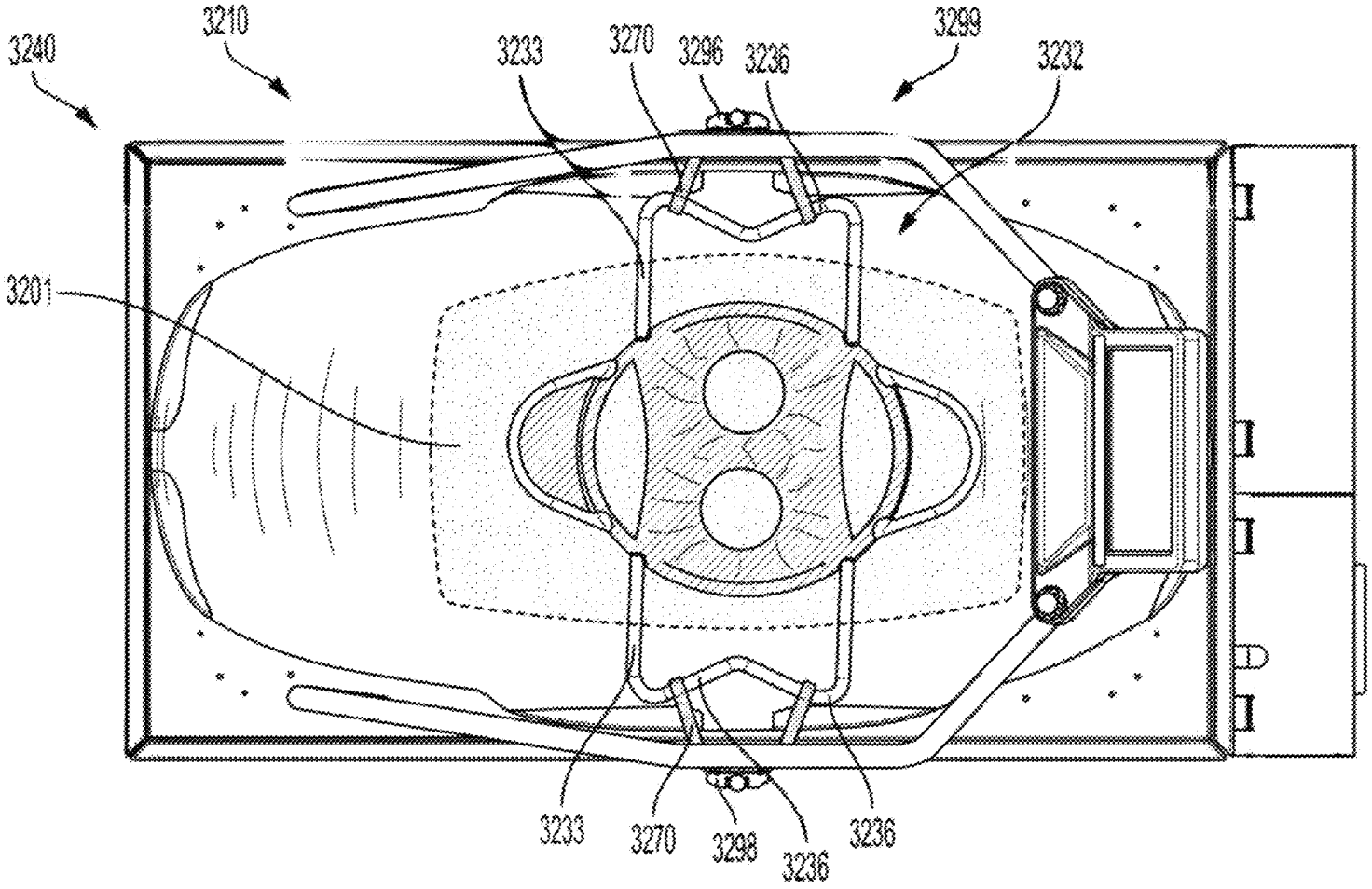
FIG. 1B is a top view of the MG system of FIG. 1A.
Figure 1C:
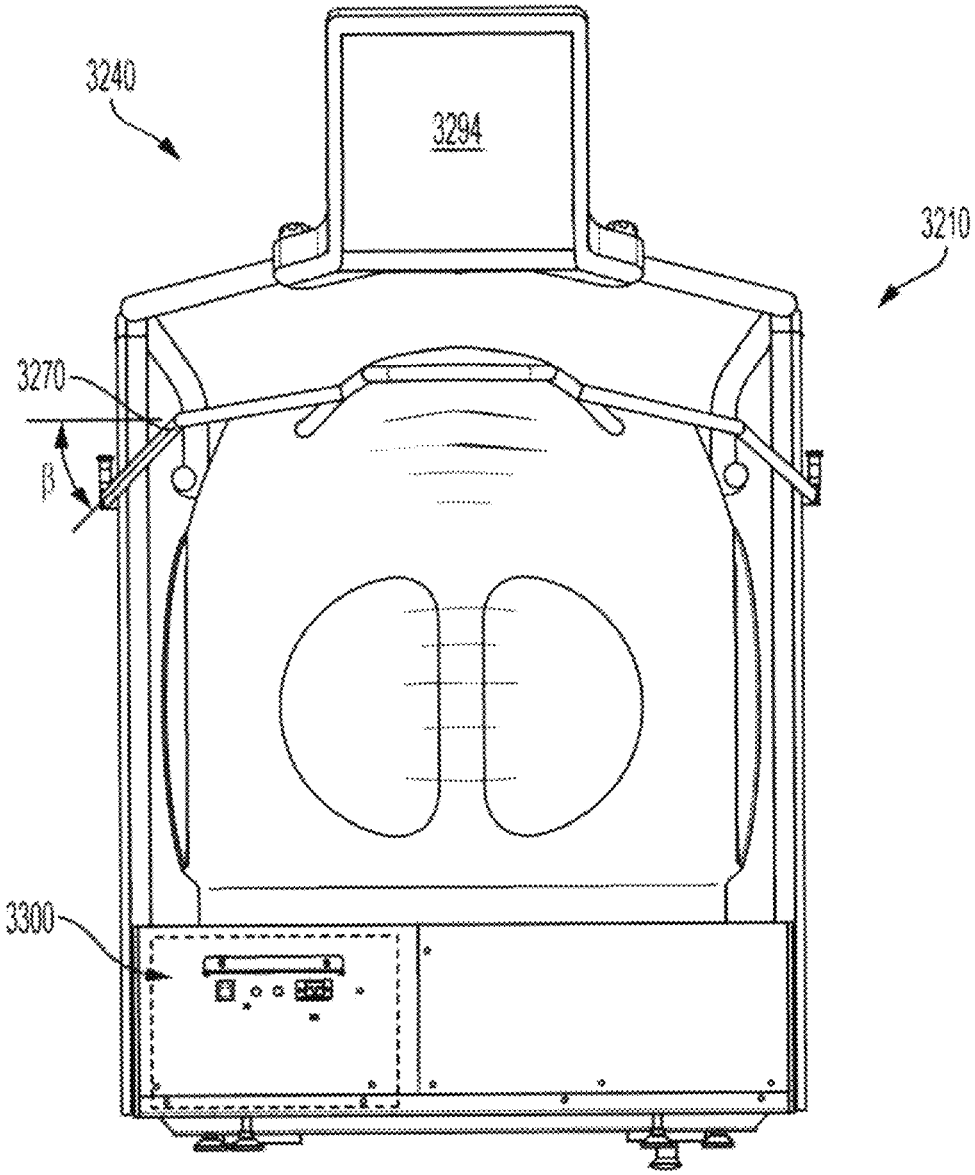
FIG. 1C is a front view of the MG system of FIG. 1A.

Referring now to FIGS. 1A to 1C, an example MG System 3240 is generally shown having a platform 3242, an enclosure 3210 attached at its base thereto, a pair of vertical lifts 3296, 3298 integrally attached at base ends to the platform, and a seal frame 3232 attached to the enclosure at a top port thereof, in which a lifting system 3299 is formed via the pair of vertical lifts 3296, 3298 integrated with the platform 3240 at their base ends and attached to opposite sides of the seal frame 3232. The lifting system can connect with the seal frame 3232 via opposing pairs of flexible, high tensile strength restraints 3270 for performing initial lift operations and for selective connection with opposite sides of the seal frame 3232 in a hybrid support for using the MG System. MG System 3240 generally includes the same aspects and features MG systems identified at the beginning of this specification and specifically incorporated herein by reference.

As shown in FIGS. 1B and 1C, MG System 3240 includes a control system 3300 that can be located in part in a portion of platform 3242 or other convenient location, such as at a front portion of the platform. It is understood that portions of control system 3300 can be distributed throughout the MG System including components and portions located within monitor 3294 and at other locations. Further, it is understood that components and portions of control system 3300 can include sensors, limit switches, motor interfaces such as motors for driving the vertical lifts, and the like, which as discussed below can be arranged as a considered as a block diagram as computer system 3300.

Example Computer Control System

Figure 2:
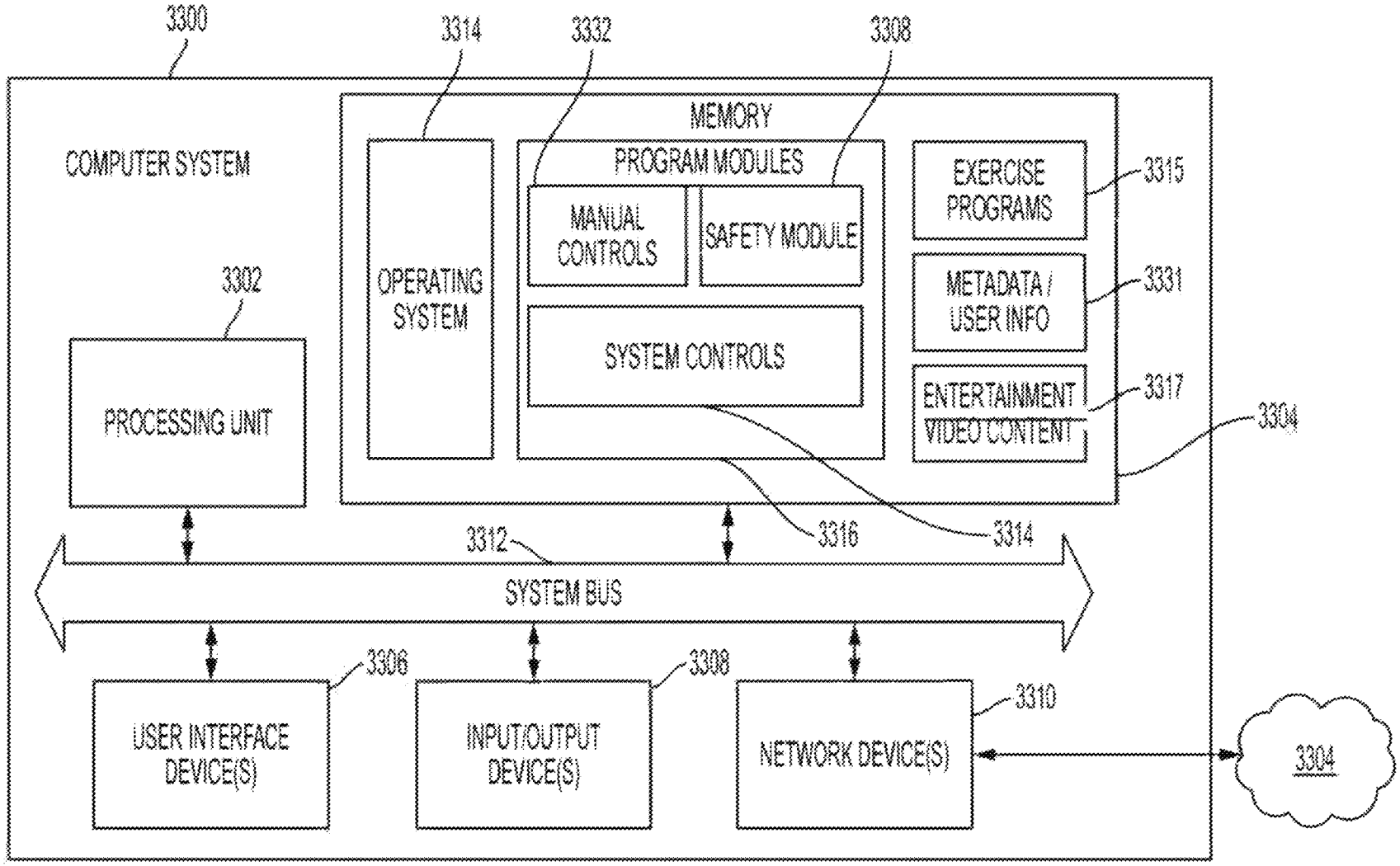
FIG. 2 is an example schematic representation of a computer control system for the MG system of FIG. 1A arranged for controlling system operations and performing related functions and optional routines according to aspects and features described herein.

Referring now to FIG. 2, a block diagram is shown illustrating a computer system 3300 configured generally to provide the functionality described herein, as examples, for: Controlling operations of a MG System including initialization of the corresponding inflatable enclosure for a user, monitoring and controlling operations of the exercise device and inflatable enclosure along with other system components; Interacting with the user; and Performing shutdown operations in accordance with aspects and features of subject matter discussed herein. In some arrangements, the architecture shown in FIG. 2 can correspond to the devices illustrated and described herein with respect to the MG System control panel or control device, though this is not necessarily the case. The computer system 3300 includes a processing unit 3302, a memory 3304, one or more user interface devices 3306, one or more input/output ("I/O") devices 3308, and one or more optional network devices 3310, each of which is operatively connected to a system bus 3312. The bus 3312 enables bi-directional communication between the processing unit 3302, the memory 3304, the user interface devices 3306, the I/O devices 3308, and the network devices 3314.

It is understood that the block diagram is illustrative of various different options for implementation of computer control system 3300. For instance, in one implementation, a RASPBERRY PI Microcontroller running on the ANDROID operating system can be located in the console area. A main control hub thereof can be arranged for controlling the lift monitors and communicating general MG System controls including a blower controller for blower monitoring and controls between the RASPBERRY PI and a blower controller and treadmill controller, which can cooperate with a treadmill exercise system for controlling subsystem management (maintaining target speed, etc.). These various circuit boards or modules can be separate or combined and be located in various parts of the MG system such as in the console area, or one or more bottom enclosures.

The processing unit 3302 may be a standard central processor that performs arithmetic and logical operations, a more specific purpose programmable logic controller ("PLC"), a programmable gate array, or other type of processor known to those skilled in the art and suitable for controlling the operation of the MG system functionality. As used herein, the word "processor" and/or the phrase "processing unit" when used with regard to any architecture or system can include multiple processors or processing units distributed across and/or operating in parallel in a single machine or in multiple machines. Furthermore, processors and/or processing units can be used to support virtual processing environments. Processors and processing units also can include state machines, FPGAs, microcontrollers, application-specific integrated circuits ("ASICs"), combinations thereof, or the like. Because processors and/or processing units are generally known, the processors and processing units disclosed herein will not be described in further detail herein.

The memory 3304 communicates with the processing unit 3302 via the system bus 3312. In some arrangements, the memory 3304 is operatively connected to a memory controller (not shown) that enables communication with the processing unit 3302 via the system bus 3312. The memory 3204 includes an operating system 3214 and one or more program modules 3216, which can include system controls 3214 for controlling operations of the MG System, a safety module for detecting safety concerns and taking appropriate actions, and manual controls 3232 for enabling sets of user commands in accordance with safety parameters and system status. The operating system 3314 can include, but is not limited to. Android or iOS, members of the WINDOWS, WINDOWS CE, and/or WINDOWS MOBILE families of operating systems from MICROSOFT CORPORATION, the LINUX family of operating systems, the SYMBIAN family of operating systems from SYMBIAN LIMITED, the BREW family of operating systems from QUALCOMM CORPORATION, the MAC OS, OS, and/or LEOPARD families of operating systems from APPLE CORPORATION, the FREEBSD family of operating systems, the SOLARIS family of operating systems from ORACLE CORPORATION, other operating systems, and the like.

The program modules 3316 may include various software and/or program modules for enabling or performing actions described herein, such as initialization actions for initial setup prior to and through inflation of the inflatable enclosure. In some arrangements, for example, the program modules 3316 can operate a Safety Module 3308 for performing Lift and Safety Restraint controls. These and/or other programs can be embodied in computer-readable media containing instructions that, when executed by the processing unit 3302, perform one or more of the methods related to subject matter describe herein and related applications. The program modules 3316 may be embodied in hardware, software, firmware, or any combination thereof. Although not shown in FIG. 2, it should be understood that the memory 3304 also can be configured to store user settings and preferences data, historical usage data including previous usage settings, user interface data, metadata 3331, exercise programs for usage of the exercise device, entertainment and/or video content 3317, and/or other data, if desired.

By way of example, and not limitation, computer-readable media may include any available computer storage media or communication media that can be accessed by the computer system 3300. Communication media includes computer-readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Computer storage media includes volatile and non-volatile, removable and non-removable media implemented in any method or technology for storage of information such as computer-readable instructions, data structures, program modules, or other data. Computer storage media includes, but is not limited to, RAM, ROM, Erasable Programmable ROM ("EPROM"). Electrically Erasable Programmable ROM ("EEPROM"), flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which, can be accessed by the computer system 3300. In the claims, the phrase "computer storage medium" and variations thereof does not include waves or signals per se and/or communication media.

The user interface devices 3306 may include one or more devices with which a user accesses the computer system 3300. The user interface devices 3306 may include, but are not limited to, computers, servers, personal digital assistants, cellular phones, or any suitable computing devices, as well as through touch screen and/or dedicated interface devices associated with monitor 3294 (FIG. 1C). The I/O devices 3308 enable a user to interface with the program modules 3316. In one arrangement, the I/O devices 3308 are operatively connected to an I/O controller (not shown) that enables communication with the processing unit 3302 via the system bus 3312. The I/O devices 3308 may include one or more input devices, such as, but not limited to, a keyboard, a mouse, an electronic stylus, and/or touchscreen functionality, external buttons, rotary encoder knobs, heart rate monitors etc. Further, the I/O devices 3308 may include one or more output devices, such as, but not limited to, a display screen including monitor 3294.

The network devices 3310 enable the computer system 3300 to communicate with other networks or remote systems via a network, such as wireless network. Examples of the network devices 3310 include, but are not limited to, a modem, a radio frequency ("RF") or infrared ("IR") transceiver, a telephonic interface, a bridge, a router, or a network card. The network 104 may include a wireless network such as, but not limited to, a Wireless Local Area Network ("WLAN") such as a WI-FI network, a Wireless Wide Area Network ("WWAN"), a Wireless Personal Area Network ("WPAN") such as BLUETOOTH, a Wireless Metropolitan Area Network ("WMAN") such a WiMAX network, or a cellular network. Alternatively, the network may be a wired network such as, but not limited to, a Wide Area Network ("WAN") such as the Internet, a Local Area Network ("LAN") such as the Ethernet, a wired Personal Area Network ("PAN"), or a wired Metropolitan Area Network ("MAN").

Control computer system 3300 can be coupled with various system devices, optional devices and sensors, supplemental devices and the like to provide a wide range of benefits and perform innovative methods as discussed in greater detail below. Such actions can be conducted as part of core operations for MG System 3240, as well as part of customized and optional actions and operations.

Example Unweighting Operations

Traditionally, unweighting machines, harness systems and other unweighting devices have used manual lifting systems that require the user to lift the system. The applicant has invented a flexible and independent mechanized lift system to automatically raise and lower a support frame that goes around the user to shape an opening of the inflatable shell, which includes the left and right lifts being decoupled from each other. Examples of such a lift system are described in related applications listed at the beginning of this specification that are incorporated herein by reference.

Figure 3:
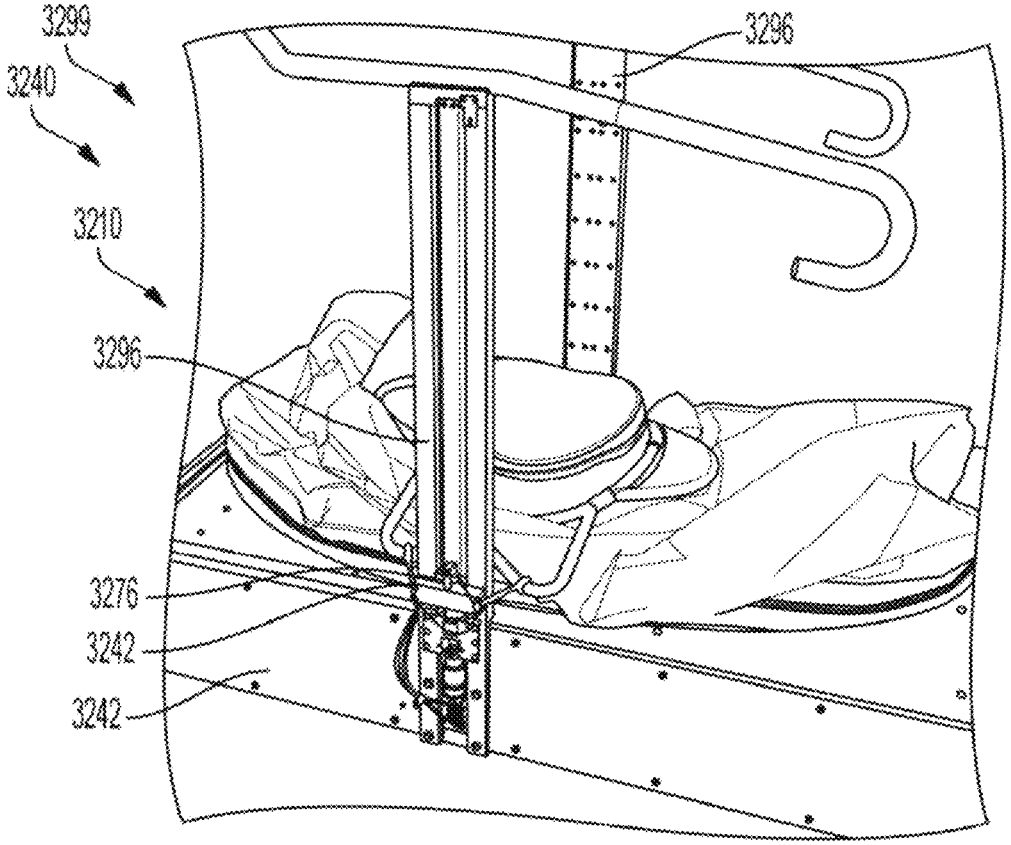
FIG. 3 is a partial left side perspective view of the example MG system of FIG. 1A shown in a base position.
Figure 4:
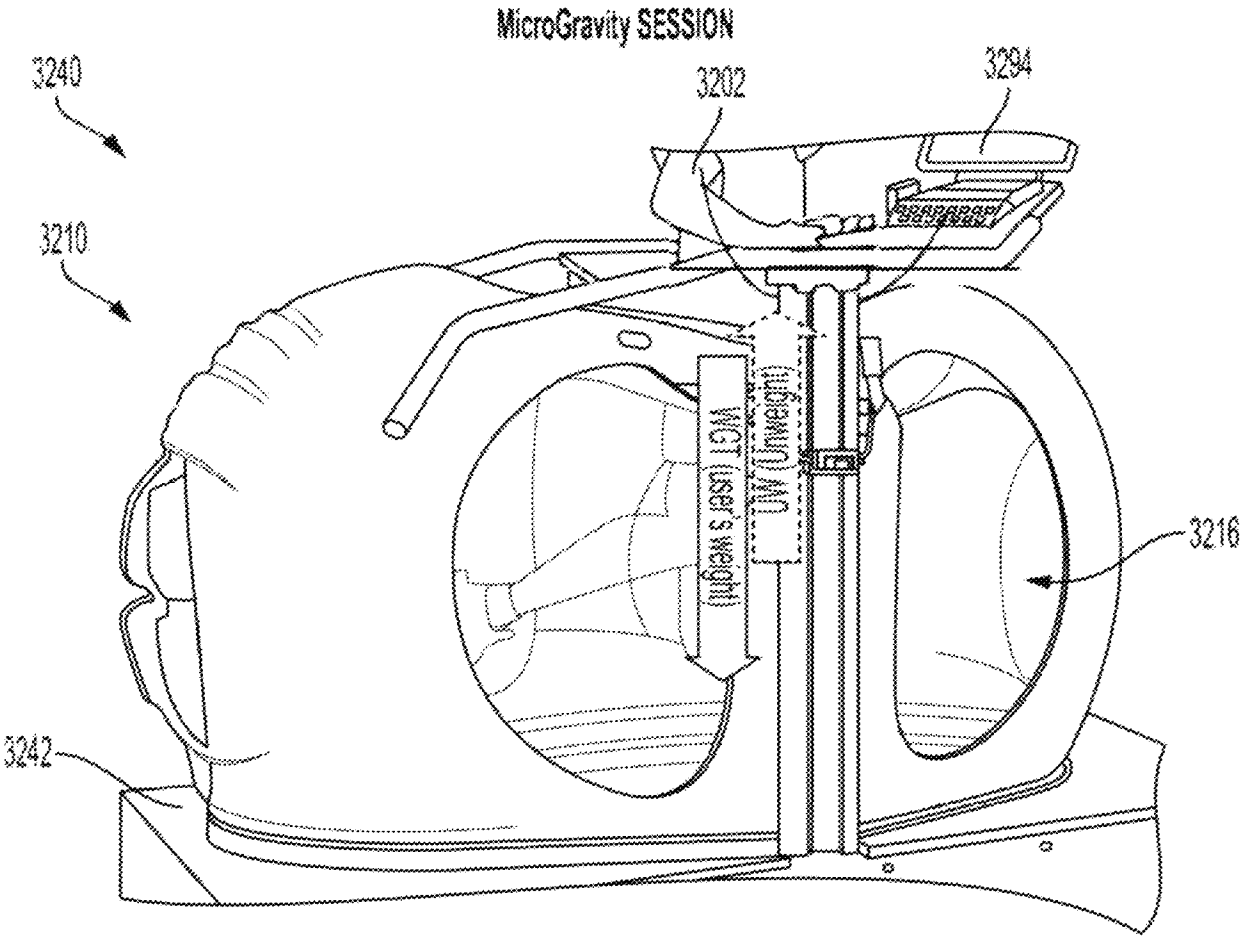
FIG. 4 is a right-side perspective view of the example schematic representation of an MG system of FIG. 1A shown in a fully inflated, hybrid framework arrangement with an example user located therein.

Referring now to FIGS. 3 and 4 along with FIGS. 1A to 2, the lifting system 3299 generally includes the left lift 3296, the right lift 3299, and an attachment mechanism for each lift to connect and disconnect with opposite sides of the seal frame 3232 having a plurality of flexible, high tensile strength restraints 3270 and release pin 3276 for each side and corresponding lift, which allows the seal frame 3232 to decouple from the mechanized lifting columns 3296, 3298. Further, seal frame 3232 cam move vertically as whole and independently on each of the left and right side based on connections with each of the left lift 3296 and the right lift 3298 via flexible restraints, as well as based on the low hoop stress curved edge portion extending along the seam and perimeter portions of the joined sheets as discussed herein and along with related patent applications. This added vertical compliance further promotes more natural movement via vertical lifting force during a range of vertical positions of the user seal.

Note that the left lift 3296 and right lift 3298 and related attachment components are designed for universal use on either the left or right side in mirror image arrangements of each other. As such, details shown and corresponding descriptions for each side applies to both left and right-side components and features. The attachment mechanism for each lift to connect and disconnect selectively with the seal frame 3232 provides flexible options for use of the MG System and use of the lifting mechanism 3299 therewith, such as for lift operations alone and/or as a hybrid framework for supporting high inflation usage modes of the MG System. Further, such a selective use and quick disconnect attachment mechanism promotes safety in the event inadvertent errors or noncompliant conditions, such as the lifting system 3299 becoming stuck, or losing power or in the event of software control errors. As an example, such a release can include a single pin 3276 for each vertical lift 3296, 3298 that is placed through one or more loops in the flexible ropes or other quick release mechanisms as described herein. In the case two separate ropes or restraints 3270 are used per side, this adds another layer of safety redundancy in the event that one rope breaks, the other rope can still hold that side down which is important to prevent the hard seal frame 3232 from popping up quickly due to high pressure. Further, the safety pin can incorporate a secondary pin, or detent, or some action that needs to be released in order to remove the safety pin. This can prevent accidental release of the safety pin. A release mechanism with a pin that allows quick release of the ropes also facilitates easy replacement of the ropes, which allows a customer to self-service the component and feature.

Figure 5:
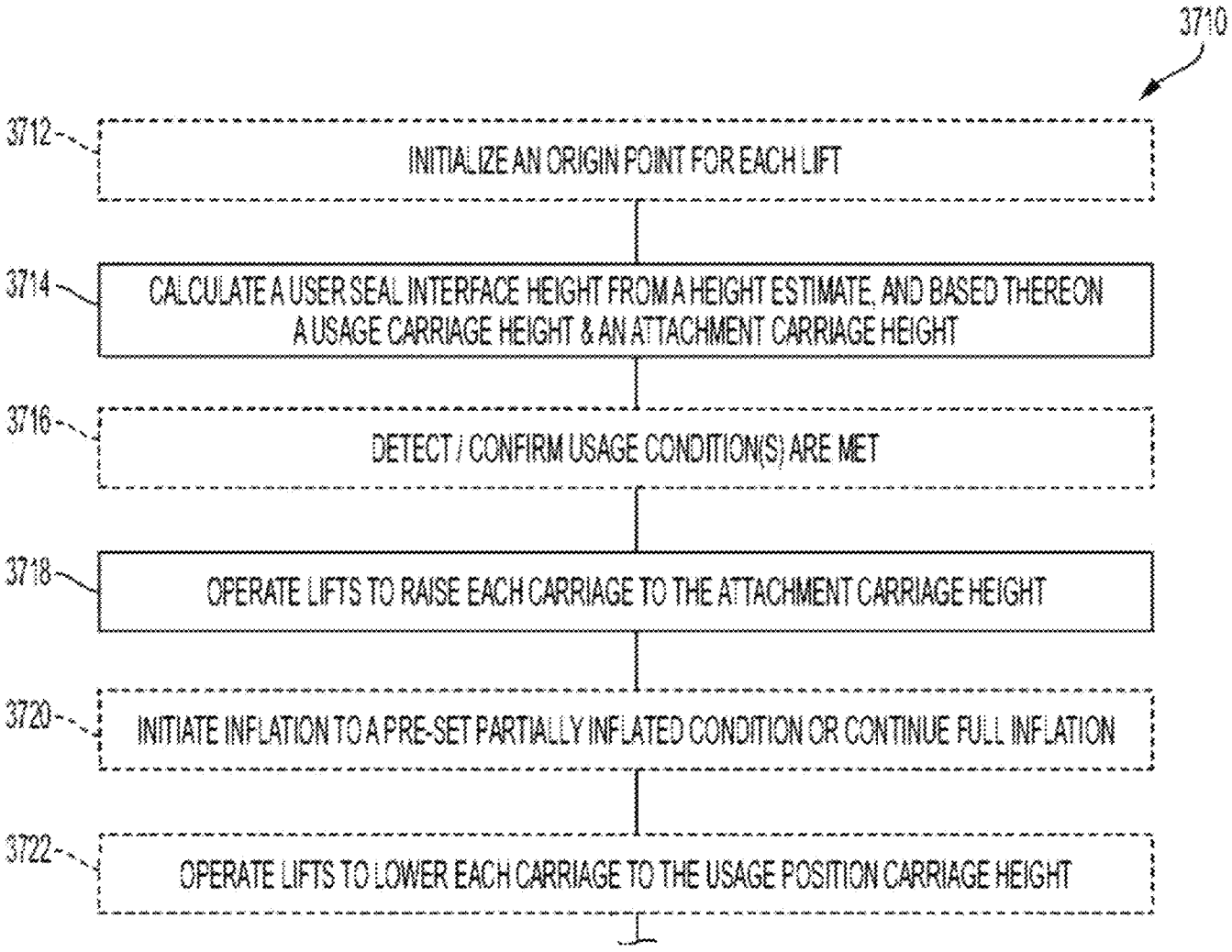
FIG. 5 schematically depicts actions of an example operational control method related to FIGS. 1A to 4 for example operations of the MG system of FIG. 1A for a user exercise session.
Figure 5:
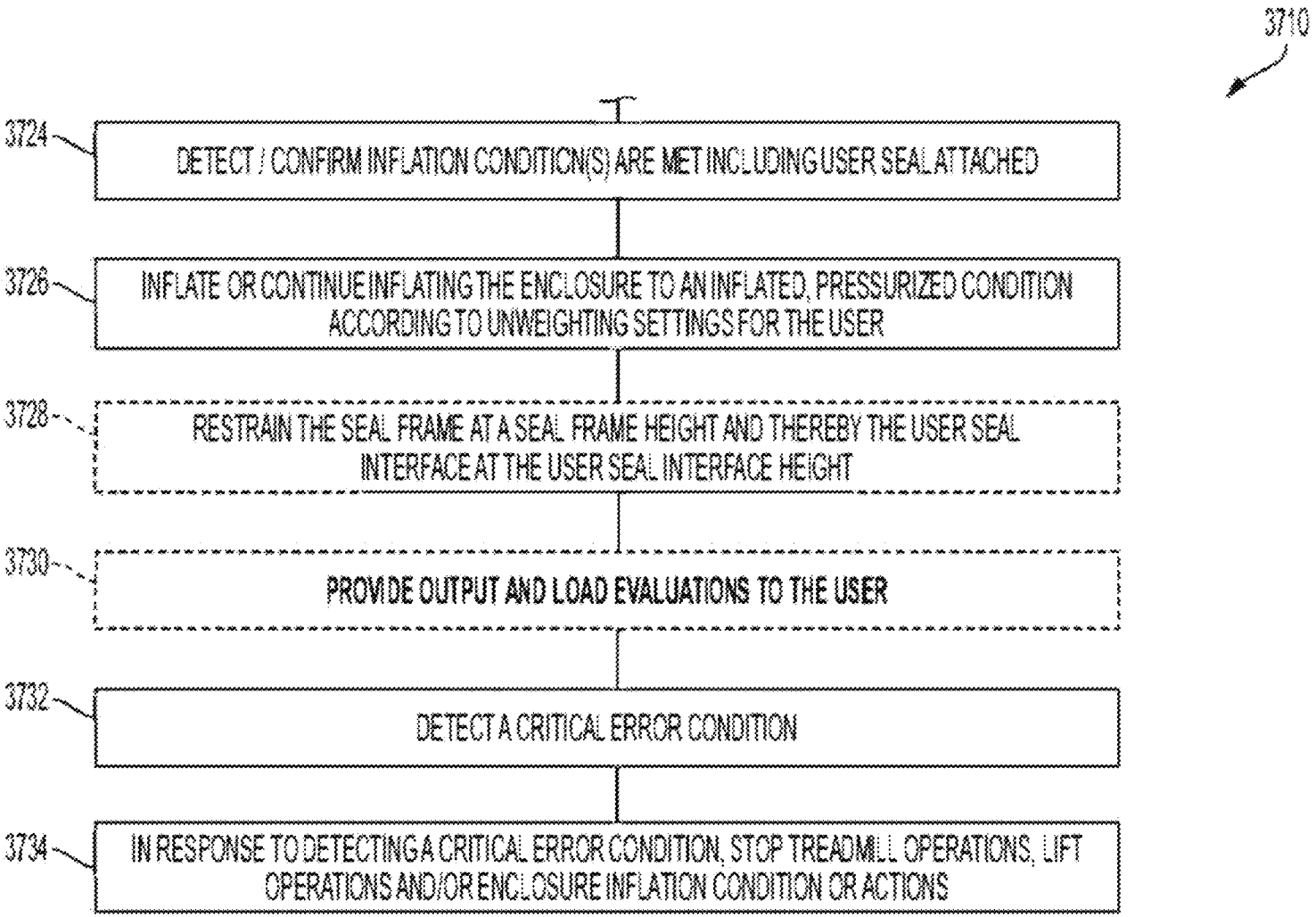

The computer system 3300 can be programmed for initial lift operations for raising the uninflated enclosure 3210 from a base level via connections with restraints 3270 to automatically adjust the height of the lifting carriage to approximately 55% of the user's height, or in some cases between 50% and 60%, or in other cases 45% to 65%. To facilitate entry and exit, the lift may initially be moved higher, to approximately between 50-70% of the user's height, and then automatically moved back down the target height of the ranges previously mentioned. This may facilitate entry and connection to the machine to have the seal frame initially higher during the connection process, but then lower in the proper position to facilitate running and movement and keep the bag out of the way of the arm swing of the user. Further, restraints 3270 can selectively be removed after initial lift and setup operations and prior to full inflation for use of the MG System 3240 in an independent support mode without having height adjustment features provided via lifts 3296, 3298 or support from the hybrid framework that can be provided via connections with the vertical lifts during use, Example Lift Method Actions Referring now to FIG. 5, a method 3710 is generally shown for using an MG system including, as an example for discussion purposes, MG System 3240, as well as other MG systems shown or described herein or in related applications including those identified at the beginning of the Specification. Method 3710 is shown and described in greater detail in the parent application identified at the beginning of the present Specification, of which the present application is a continuation-in-part. Method 3710 generally describes operations of the MG System 3240 for a user exercise session including preliminary set-up operations for ensuring proper placement of the user and connections between the user and the MG system, initial setting operations such as determining and control actions pertaining to carriage and seal frame heights for supporting the user and inflation settings, mid-session operations such as user interactions for session changes, and ongoing operations including monitoring and safety operations prior to the session, throughout session operations, and through full completion of the exercise session and user exit.

Aspects, concepts and features described herein include methods for evaluating comparative equivalence of a partially unweighted MG exercise session for the user with an unsupported (non-unweighted) exercise session for the user including an unsupported treadmill session and/or an unsupported off-treadmill session. Method 3710 includes Action 3730 for providing output and load evaluations to the user, which is described further below in the section entitled "Output and Cumulative Load Evaluations." Action 3730 is related to comparative equivalence methods and actions described herein, which is shown in Method 3710 along with actions for using the MG System 3740 for a user exercise session. However, the comparative equivalence actions and methods described below including the Action 3730 for providing output and load evaluations to the user is not limited to exercise session actions or operations. For example, actions and methods pertaining to evaluations of comparative equivalence described herein including providing output and/or load evaluations to the user can be performed in advance of the user performing a related exercise session, after the user has performed a related exercise session, and/or along with or part of a related exercise session, as well as providing the output and/or load evaluations without performance of the related MG session.

Evaluating Comparative EQ-UW Vs. Standard Sessions & Related Considerations

Advantages and benefits from unweighted exercise can be provided for users of MicroGravity exercise systems, such as the example MicroGravity exercise systems of FIGS. 1A to 4, and other MicroGravity exercise systems including conventional MicroGravity-type exercise systems discussed in the BACKGROUND, which can be particularly beneficial for persons recovering from an injury or surgical procedure or other rehabilitation activities. Yet the full extent of these benefits go unrealized for conventional unweighted exercise sessions due to unavailable, insufficient or ineffective measurement standards or assessment mechanisms for providing effective assessment information to users or support entities. Such assessment information can enable users, support entities, and MicroGravity systems functionality, related controls, methods and devices to use such assessment information as a tools for enabling improved usage of MG systems and for enhancing benefits for users including customized benefits for users. As an example, such improvements and benefits can include the user experiencing reduced loads and impacts, and being able to exercise with lower risks of injury under appropriate unweighted support conditions that can be fine-tuned or otherwise customized as appropriate for the user.

Aspects, concepts and features described herein are directed to actions of a computer system, such as computer control system similar to MG exercise system computer 3300 discussed above along with FIG. 2 or other related computer system or device for an MicroGravity-type system and providing such assessment information to a user, as well as related functionality for using the assessment information for improving usage of unweighted exercise as appropriate for a user and enhancing benefits of unweighted exercise sessions for the user. For instance, evaluating the level of reduced load or impacts and injury risks, and providing estimated levels for these reductions to the user for an unweighted exercise session can improve determinations of exercise conditions and parameters by the user or a support person for the user. These determinations can greatly increase exercise performance and benefits for the user while avoiding adverse impacts and risks of injury by keeping conditions and exercise parameters within safe limits based on the estimated reductions.

Determinations of exercise conditions and parameters can be improved further by evaluating comparative equivalence between an unweighted session vs. a similar unsupported session familiar to the user or support person, and providing assessment information in the form of estimated equivalence information to the user or support person. These determinations can be greatly enhanced by evaluating comparative equivalence in concert with evaluating reduced levels of loads or impacts and injury risks, and providing equivalence information and potential options that meet desired reduction levels for load or impacts and injury risks to the user or support entity.

Without users having or being provided with effective measures or readily available measures for assessing or estimating load, impact and injury reductions gained with unweighted exercise, and/or being provided with reduction levels evaluated based on these measures, such as for unweighted exercise with conventional MicroGravity-type systems and related devices and methods, users often err on the side of safety during unweighted sessions and run or walk while receiving greater unweight support than necessary. Similarly, without users having or being provided with effective measures or readily available measures for assessing aerobic output of unweighted sessions, users often perform unweighted exercise under conditions and exercise parameters that result in significantly lower or different aerobic outputs than desired or appropriate for the user.

Further, based on proposed solutions discussed in the BACKGROUND, users of conventional MicroGravity-type systems often perform unweighted exercise with significant deviations for a single exercise parameter vs. similar unsupported exercise familiar or comfortable for the user, such as running at significantly faster treadmill speed settings to compensate for unweighted reductions in metabolic output, which can increase injury risk for running outside of the user's comfort zone or other adverse effects. In addition, proposed assessment solutions fail to evaluate potential gradual, adverse impacts of unweighted exercise to the user and also from increased run speeds of unweighted sessions, such as for run performance changes of unweighted exercise sessions like gait or stride length changes.

As noted in the BACKGROUND, proposed assessment solutions for conventional unweighting or MicroGravity-type exercise systems and related devices and methods pursue rule-of-thumb type guidelines or general table/chart information indexed as blocks of settings. Conventional limited chart data or guidelines according to proposed solutions that may be available to the user are limited to preset categories (e.g., set unweighting or speed increments) separated by significant gaps, such as for unweight settings separated by 10% each (e.g., 60%, 70% and 80%) or run speeds separated by 0.5 mph increments that are often inappropriate for a desired session like 6.5 mph run speed and 75% bodyweight or other unaddressed unweight setting and/or lack reasonable accuracy beyond general guidelines.

Further, conventional proposed assessment solutions include significant variance for velocity or speed settings of an unweighted session vs. settings for a similar unsupported session (non-unweighted) session. As such, a velocity or speed setting for an unweighted session identified as similar to an unsupported exercise session according to conventional limited chart data or guidelines can be significantly faster for the user. Even though unweighted exercise is typically comparatively easier for the user to perform, significant speed increases can be uncomfortable for the user or can adversely affect their run or walk characteristics, such as gait, cadence and stride length and run performance. In addition, the conventional proposed assessment solutions limit available estimates and chart data for unweighted exercise and for exercise sessions on a conventional treadmill (without unweighting options or equivalence) to preset categories that often are not applicable or helpful for user's more familiar with off-treadmill exercise or who may be preparing for an outdoor competition or run event.

Inventive aspects, concepts and features of methods, systems, computer systems, related interface interactions thereof, and associated inputs, sensors and/or devices discussed along with various examples shown or described hereafter overcome these and other shortcomings of conventional systems along with providing significant benefits and advantages for users of MicroGravity-type systems. Such benefits and advantages address various response factors that are known in general and, as outlined above for conventional systems, devices and methods that may be available as conventional proposed assessment solutions as rule-of-thumb guidelines and step-wise estimates of charts and tables, which result in user's lacking effective measures and assessment information for use as tools for considering effects of unweighted exercise on the user and physiological or other impacts of unweighted exercise on the user. Inventive aspects, concepts and features discussed herein for addressing physiological responses and other impacts of unweighted exercise on the user include evaluating comparative equivalence of an unweighted exercise session with an unsupported treadmill or off-treadmill exercise session familiar to the user, and providing equivalence information to the user or support entity that can be used as effective assessment tools.

Unweighting Physiological Responses

Figure 6:
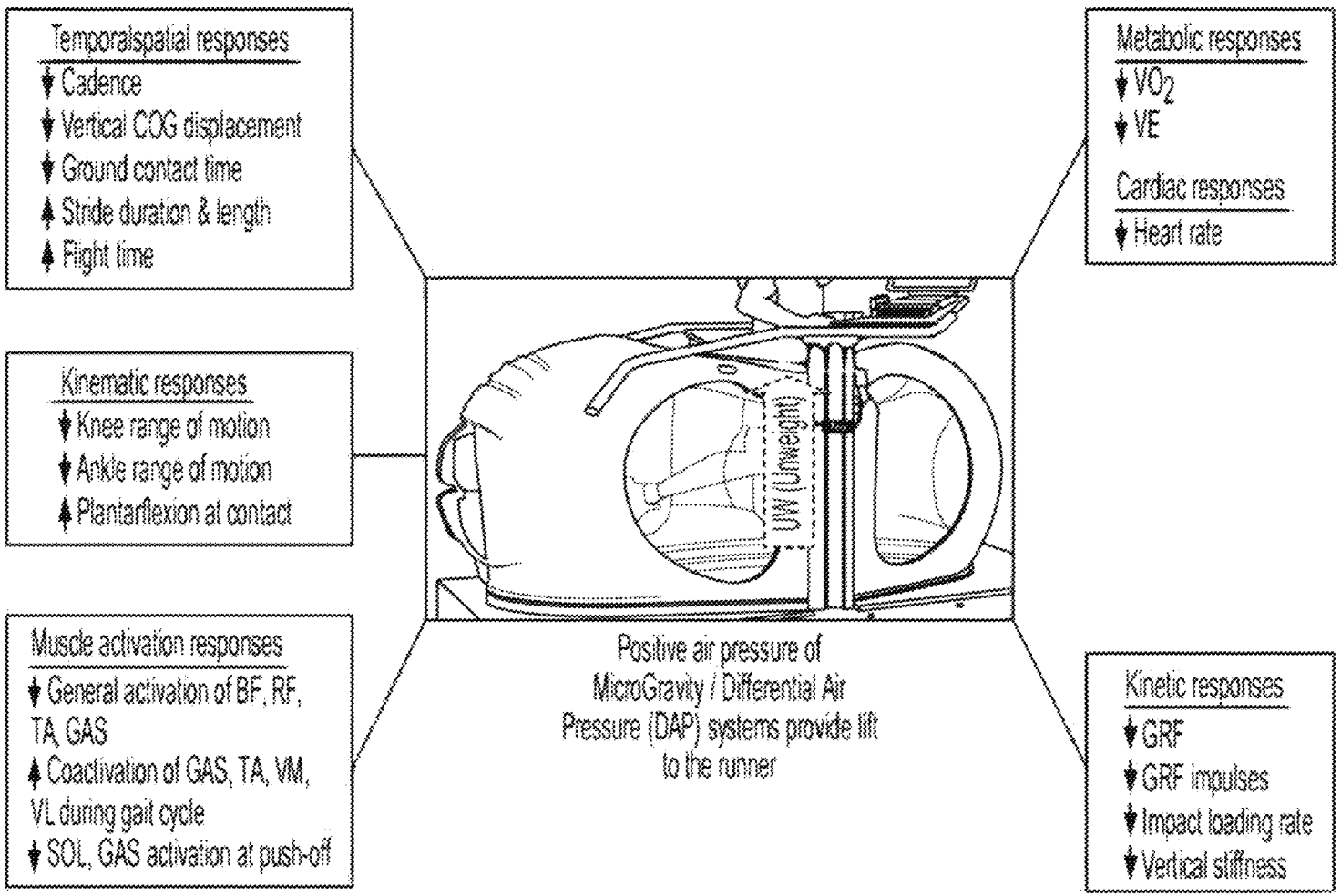
FIG. 6 shows a right-side perspective view of an example MicroGravity-type exercise system depicted in a center region of the figure (showing the right-side perspective view of FIG. 4 as a general example representation), which is surrounded by category groupings of observed physiological responses to the user for unweighted exercise on such a system with each having a corresponding arrow that indicates an 'increasing' or 'decreasing' response as levels of unweighting applied to the user increase.

Referring now to FIG. 6, the MicroGravity exercise system 3240 of FIG. 4 is depicted in a center region thereof as a general example representation of MicroGravity-type exercise systems including conventional unweighting systems for reference along with discussing content related to FIG. 6. Physiological responses and impacts for the user during unweighted exercise are also shown in FIG. 6 arranged in category groups along with an 'increase' or 'decrease' arrow for each, which indicates a corresponding physiological or other factor response to the user as unweighting applied to the user increases (i.e., as upward unweighting support increases). The identified response observations of FIG. 6 are based on a published article entitled "Role of MicroGravity Training in Rehabilitation and Return to Sport After Running Injuries" (*Arthroscopy, ports Medicine, and Rehabilitation*, Vol. 4, No. 1, January 2022, published by Elsevier Inc. on behalf of the Arthroscopy Association of North America as an open access article under CC BY-NC-ND license (http://creativecommons.org/licenses/by-nc-nd/4.0/); which is available online at https://doi.org/10.1016/j.asmr.2021.09.031 as of this filing) (the "Rehabilitation Article"). However, corresponding FIG. 1 of the Rehabilitation Article shows a different example MicroGravity-type system in the center region.

The "responses" identified in FIG. 6 herein and in FIG. 1 of the Rehabilitation Article are generally known physiological responses the user encounters with increased unweighting during exercise sessions on MicroGravity-type systems including many noted above and further discussed in the BACKGROUND. The Rehabilitation Article discusses such responses based on the authors' review of research publications, case studies and related references, which includes the authors' recommendations, inferences, and conclusions with respect to unweighted exercise for rehabilitation and running injuries. The articles references are identified in footnotes or otherwise identified therein, for which many references may be applicable as prior art against the present application and are discussed in the BACKGROUND. However, the Rehabilitation Article itself was published after the earliest priority date of the present application, and therefore is not admitted herein as prior art.

The Rehabilitation Article itself and content thereof is not admitted nor necessarily applicable as prior art, which includes inferences, deductions, comparison/contrast comments, conclusions, recommendations and other content therein. However, many of the references and portions of the article provide beneficial information pertaining to inventive aspects, concepts and features described or discussed hereafter beginning with FIG. 7 and examples discussed along with Figures shown thereafter. For this purpose, along with clarifying introductory comments noted above and base concepts of further discussions hereafter, some of the factors and responses of the Rehabilitation Article are discussed below along with FIG. 6.

Metabolic & Cardiac Responses—As indicated in FIG. 6, metabolic and cardiac response items for users of MicroGravity-type exercise systems are known to 'decrease' (downward arrows) as upward unweighting support the system applies to the user increases. In particular, the items shown for volume of oxygen ($VO_2$) used, ventilatory equivalent of oxygen (VE), and heart rate of a user during an unweighted exercise session are known to decrease as upward unweighting support these system apply to the user increases during an exercise session. Even though reduction or decreasing responses are known in general and expected by many users, conventional proposed solutions pertaining to estimated decreases are not readily available, effective as assessment tools for users or support entities, nor provided to users of conventional unweighted exercise sessions beyond general guidelines.

Similarly, reduced "Cardiac responses" are known and expected to decrease for the user as unweighting support increases during an unweighted exercise session. However, some studies and research publications appear to conclude that heartrate and cardiac response relationships with respect to metabolic responses are generally unaffected by unweighted exercise, such that heartrate or cardiac response are effectively tied to metabolic responses, such that decreasing metabolic responses as unweighting increases may occur primarily due to reduced exercise output and metabolic activity observed as unweighting increases. As discussed below, it is understood that user measurements, inputs and related fitness data and information can be used when available along with evaluations of comparative equivalence, such that heartrate monitoring and other information can enhance such evaluations for many users. Nonetheless, the Rehabilitation Article notes that heart rates have been observed to progressively reduce vs. incremental increases in bodyweight support.

Conventional table and chart type references discussed in the Rehabilitation Article provide some stepwise guidance pertaining to exercise speed parameters and for stepwise unweight settings, such as run speed estimates for applied unweight percentages according to 10% unweighting intervals (e.g., 90% of the user's bodyweight or 10% body weight support applied to the user, 80% of the user's bodyweight or with 20% body weight support, and so on) as discussed above in the BACKGROUND. These rule-of-thumb type guides and general estimates provide minimal assistance for users and related persons, and fall far short of evaluating 'comparative equivalence' and providing related information for beneficial insights or session settings to users. In other words, common user or patient questions like "To what standard treadmill or off-treadmill exercise session is an unweighted exercise session equivalent?" remain unanswered and related beneficial insights go unrealized based on general guidance provided by conventional systems and related devices and methods.

Likewise, for exercise session planning purposes, questions like "What unweighted exercise session at X % bodyweight would be comparatively equivalent to an unsupported exercise session at a particular speed and grade or incline?" also remain unanswered for exercise sessions using conventional MicroGravity-type systems particularly with respect to many, if not most users. Some specific linear regression equations or multi-equation regression equations have been determined for particular usages and users (typical certain professional athletes & almost always without consideration of incline options), factors or parameters beyond the narrow range and factors of such users or technical/research goals, and/or that have been extrapolated beyond test subject factors and parameters under assumptions of general applicability to wide ranges of age, fitness, sex, etc. Such relationships based on specific inputs or limitations and expanded applications of these or other research-specific conventional proposed solutions quickly become difficult for effective use by many users and/or applicability under differing conditions, characteristics or scenarios for which similar details, information, fitness data and the like are unknown, not readily available, or simply overly complex and technical for effective user by users and/or related entities for planning or similar purposes.

As such, significant therapeutic benefits for users thereby go unrealized based on conventional guidance to users, or the lack of effective guidance, which can be gained by receiving effective information and insights like reduction amounts for kinetic response factors and potential aerobic session output losses. This is the case for a large number of MG systems and unweighted exercise users other than perhaps few exceptions for professional athletes under ongoing test and evaluation regimes, such as user-specific intensive medical tests, evaluations and ongoing fitness data, such as can be gained via graded exercise tests and related continued testing and ongoing measurements and calculations readily available for particular users. Nonetheless, as noted above, additional fitness information can readily be included as part of evaluations of comparative equivalence and related methods, concepts and features described herein, which can enhance or improve customized information and benefits for such users including benefits available even for such exceptions, like professional athletes, including providing weighted comparative equivalence or identifying limitations like load limits for injury avoidance as discussed herein.

Aerobic Impacts: Exercise Session Output—the Rehabilitation Article also describes potential considerations for lower heart rate responses vs. increasing unweight support, and options for addressing decreases in metabolic responses including lower $VO_2$ output and aerobic session output. Potential consideration options addressed include linear regression formulas identified from a research report published by Kline et al, in 2015 along with sample table information shown in FIG. 2 of the Rehabilitation Article for estimating, based on standard treadmill flat run (0% incline) run speed increments, increased run velocities for unweight exercise sessions according to set unweight categories and unchanged, flat run (0% incline) unweighted conditions considered as having similar VO2 outputs as the flat treadmill session.

Conventional proposed assessment solutions consider increased run speed or velocity values alone and on a stepwise, unweight support level basis for similar session outputs while failing to evaluate comparative equivalence between unsupported and unweighted exercise sessions for ranges of unweighting support and for combined run speed and incline exercise parameter options for the exercise sessions, nor providing such comparative equivalence information to the user—particularly in real-time for immediate consideration and potential usage.

Beginning with FIG. 8A, example methods for evaluating comparative equivalence between unsupported and unweighted exercise sessions that can evaluate exercise parameters including both run speed (or walk speed) along with incline percentage of the sessions are discussed further below along with various examples according to inventive aspects, features and concepts described herein. For instance, FIG. 27 and related content describe options for evaluating comparative equivalence of sessions based on both run speed and incline exercise parameters, as well as efforts for optimizing or weighting result options and otherwise guiding combined speed and incline equivalence output as appropriate or desired for the user, and providing comparative equivalence information to the user. For instance, in some implementations evaluations of comparative equivalence can be guided to pursue the same or similar run speeds for both unsupported and unweighted exercise sessions, such as for minimizing potential gait, stride and other user impacts or in accordance with user preferences while evaluating incline percentage options that can best maintain exercise or session output, and provide the same to the user.

Temporal spatial Responses—The Rehabilitation Article further identifies as depicted in FIG. 6 known concerns pertaining to users performing unweighted exercise session over extended periods, which can include gradual gait or stride drift and other effects on the user resulting from the unweighted sessions absent efforts to offset these effects. Example impacts or responses are identified as decreasing cadence and increasing stride duration & length and flight time as unweighting increases, which is depicted in FIG. 6 for these items. For running exercises performed on an unsupported system (e.g., regular treadmill), cadence, stride length & stride duration changes experienced by the user due to injury or other reasons can be challenging for the user to address and correct if necessary, without complicating these changes further from impacts of unweighted exercise. As such, it can be additionally beneficial for comparative evaluations of unweighted exercise sessions vs. familiar unsupported exercise sessions to consider these types of response factors for potential comparative equivalence results. Run speed is generally based on stride length and frequency or cadence, so understandably increasing a user's run speed for metabolic response purposes (e.g., for maintaining aerobic fitness) as discussed above can exacerbate potential long-term changes regarding a user's stride length and/or cadence, which can be difficult to change when transitioning to unsupported run exercises. Potential comparative equivalence result options can be weighted to provide results for reducing or minimizing such impacts.

As discussed in greater detail below along with example methods for evaluating comparative equivalence, inventive aspects, concepts and features described herein can include pursuing ranges of run speeds for unweighted exercise session of users as appropriate such that comparative session output and aerobic fitness can be maintained without significant speed increases for unweighted sessions. Options for doing so and for weighting comparative equivalence evaluation results as appropriate for a user can provide significant benefits in addition to significant benefits available from providing equivalence information to the user and/or related persons. For instance, related benefits and examples are discussed along with FIG. 28 and Method 6050 described below.

Kinetic responses—As identified by the title, the Rehabilitation Article is directed to considering the role of MicroGravity training in rehabilitation—particular for athletes suffering from sports injuries. Thus, notable emphasis on known benefits that can be provided from unweighted exercise include Kinetic Responses (reduced impacts, forces, impulse intensity etc. to the user from running & ground contact), which as shown in FIG. 6 uniformly decrease as unweighting increases. These responses alone can provide huge benefits to users and especially for users suffering from run-related injuries. Evaluating these benefits along with comparative equivalence of unweighted vs. standard unsupported exercise sessions, and providing relating information to the user can further enhance these benefits along with exercise output benefits.

As also shown on FIG. 6, ground reaction forces (GRF), ground reaction force impulses, impact loading rate, and vertical stiffness reductions and benefits experienced by users during unweighted session are often generally known, yet little more than general expectations of reduced kinetic response are provided or available to AG-type system users. The Rehabilitation Article discusses options for relying on the user's/patient's comments regarding pain sensed during an exercise session as a guide for an unweight setting. Without having effective information regarding reduction amounts for these factors for unweighting exercise sessions, neither the user nor persons related to the user, such as medical, athletic, or therapeutic professionals, can effectively consider appropriate unweighting with respect to these reductions along with comparative equivalence information for considering desired exercise output information.

Figure 7:
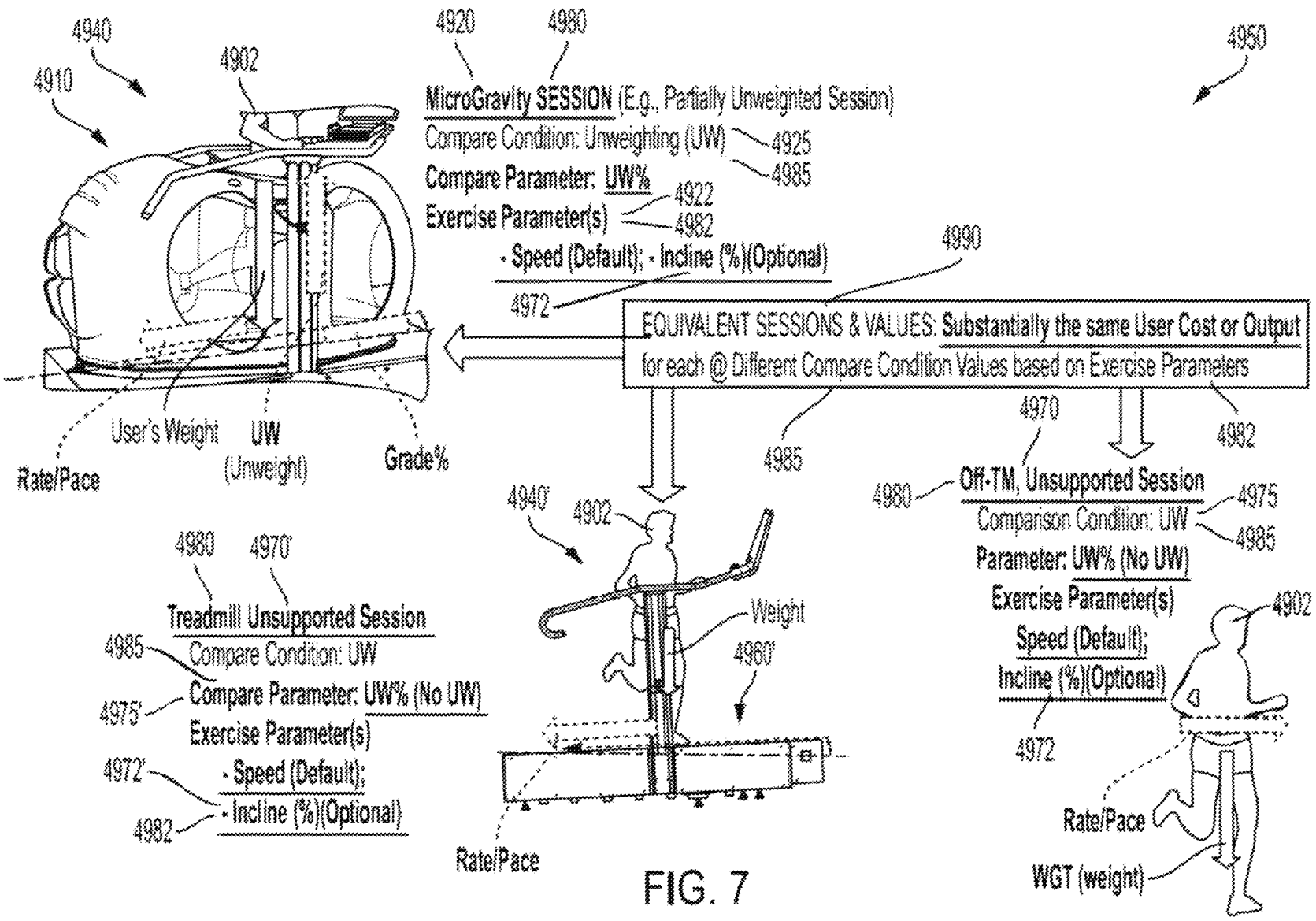
FIG. 7 is an example schematic representation of a method of evaluating comparative equivalence between an unsupported exercise session either on or off treadmill with an MG exercise session according to aspects, concepts and features described herein.
Figure 8:
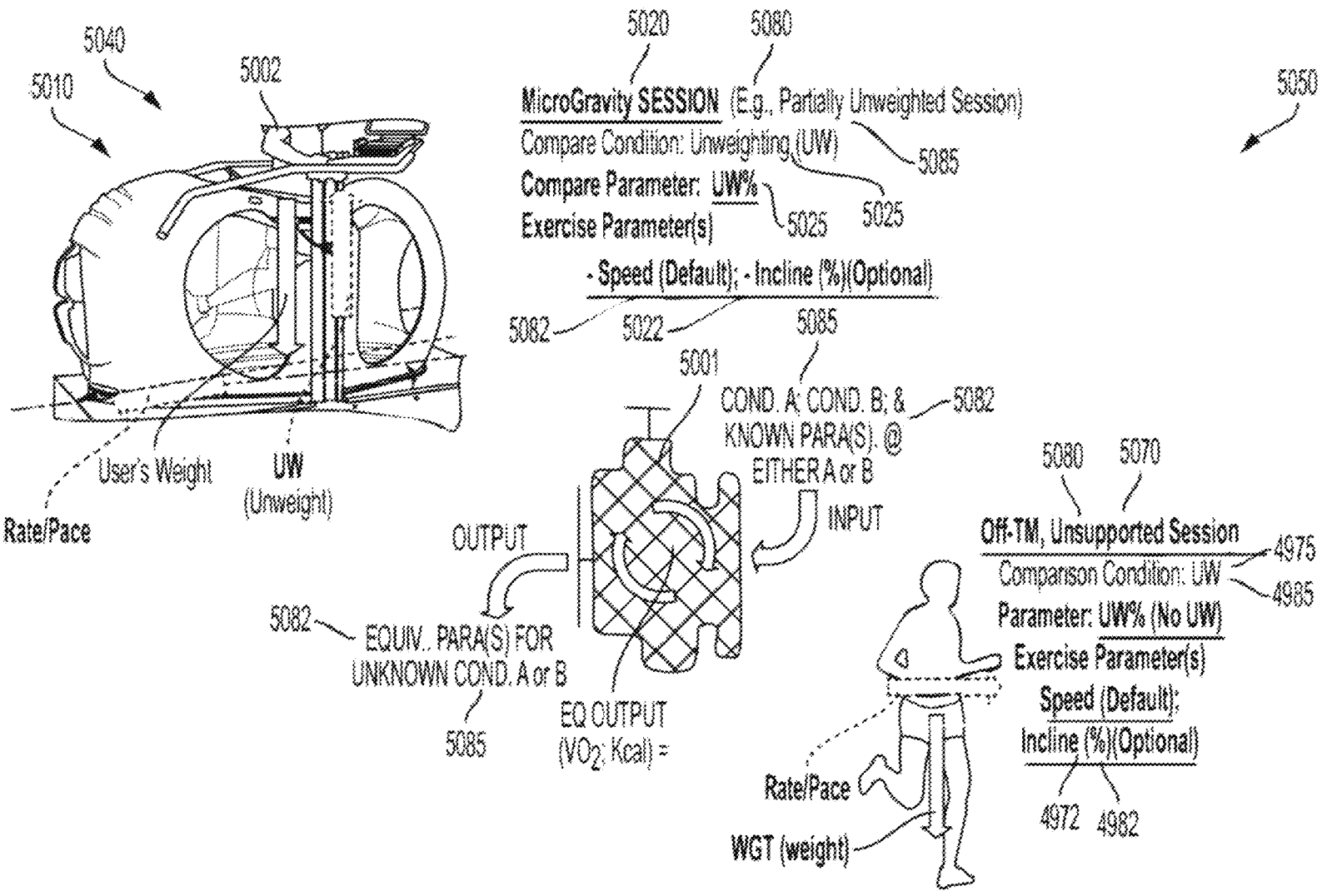
FIG. 8 is another example schematic representation of a method of evaluating comparative equivalence between an unsupported off-treadmill exercise session and an MG exercise session according to aspect, concepts and features described herein.

Conventional proposed assessment solutions fail to evaluate comparative equivalence between unweighted and unsupported sessions effectively and to provide related information to the user, nor do so with respect to loading, cumulative or training loads, and applied force reductions to the user. Similarly, conventional proposed assessment solutions fail to provide reduced load, force or impulse information to the user or related persons or evaluated comparative equivalence according to load or force limits appropriate for a user. Example methods for evaluating comparative equivalence discussed below, such as along with FIG. 31, that describe methods for evaluating comparative equivalence that can include load or force reduction features and factors according to inventive aspects, concepts and features described herein, Evaluating and Providing Comparative Equivalence Methods Overview Referring now to FIG. 7, a Method 4950 is schematically depicted for evaluating comparative equivalence between a plurality of Exercise Sessions 4980 including a base selection for comparison with either off-treadmill or treadmill sessions vs. an unweighting session, and for providing session output and comparative equivalence information to the user according to inventive aspects, features and concepts described herein. FIG. 7 is a schematic representation of Method 4950 of evaluating comparative equivalence between a plurality of Exercise Sessions 4980 for a user 4902 including a MicroGravity (MG) session 4920 and an Unsupported session 4970. The unsupported session 4970 can include an Off-Treadmill session 4970, such as a flat run outside or on an inside track, and/or a Treadmill session 4970' on a traditional treadmill 4940'. As depicted in FIG. 8, the comparative equivalence Method 4950 can include options for the user to select either the off-treadmill session 4970 or the treadmill session 4970' as a default exercise session (i.e., base selection) for comparison with the unweighted MG exercise session (comparison selection) or vice-versa.

According to the Method 4950, each of the exercise sessions 4980 can be evaluated for determining Equivalence between exercise sessions for the user 4902 based on a Compare Condition 4985 that affects exercise output for the user and on adjustable exercise parameters 4982 for each session, such that the session exercise output per unit time for the sessions evaluated are substantially the same (e.g., same % $VO_2$ for the comparative sessions). The default primary Compare Condition 4985 for evaluating comparative equivalence described according to examples herein includes Unweighting (UW) as the Compare Condition, and an Unweighting Percentage as the Compare Parameter for each comparative exercise session. The unweighting parameter for an unweighted session can include a percentage unweighting of the user's weight that is offset or unweighted during the MG exercise session, or as a percentage of the user's bodyweight. For example, an unweight percentage of 20% would refer to a session in which 20% of the user's bodyweight is offset or uplifted by the inflatable enclosure during the MG session, whereas an 80% bodyweight (BW) would refer to the same session for which the user's bodyweight during the session is at 80% of the user's weight.

The unweighted MG session can be performed or evaluated for equivalence as if performed on an MG system 4940 like MG system 3240 discussed above along with FIGS. 1 to 4 except as noted herein. As such, like numbers refer to like features tor the MG system 4940. The Off-TM Unsupported Session 4970 can be performed or evaluated for equivalence as if performed on a finished road or track, or another substantially firm surface. The Treadmill Unsupported Session 4970' can be performed or evaluated for equivalence as if performed on a standard or traditional treadmill having a powered, rotatable belt that can be rotated at a set treadmill speed (velocity) along with options for adjusting the incline % up to about 15 percent incline. The default unsupported session can be selected as either Off-treadmill or On-treadmill with or without a grade or gradient (e.g., uphill). However, for example methods described below, the default unsupported session will be described as an Off-Treadmill, flat run (i.e., horizontal) unsupported session (i.e., non-unweighted). Nonetheless, it is understood that evaluation of comparative equivalence with include an On-Treadmill session with or without the running surface having a gradient based on an incline % setting greater than zero, for which the same option and flexibility is implied for each of the examples described depending on user or system preferences.

As described hereafter, equivalence can be evaluated between an unweighted MG session and an unsupported session based on exercise parameters for one of the sessions and a value for the Change Condition (e.g., unweighting) corresponding with each session, such as an unweight percentage for the MG session and an unweight value for the unsupported session representing the user's weight (i.e., no unweighting or 100% bodyweight). Optionally, equivalence can further be evaluated between multiple unweighted MG sessions each having a different unweighting. For example, if a user was familiar with unweighted exercise at a first % bodyweight like 90% bodyweight (unweighting upward support of 10% bodyweight) and a first set of exercise parameters (run speed and incline %), a comparative evaluation could be performed with an exercise session for a different unweighting, such as 70% bodyweight (unweighting support of 30%). The evaluation of comparative equivalence can be performed by a computer for the MG system, and more particularly, by an equivalence engine module or portion of the computer that can include one or more other computers in communication with or part of the MG system computer, as well as by another related computer, such as a handheld computing device (e.g., tablet or mobile phone) or laptop.

Input information for evaluating equivalence can include the unweight information including unweighting values for each exercise session, and exercise parameter(s) for one of the sessions, such as velocity or run speed and incline for either the MG session or the unsupported session as the base selection. The output information can similarly include equivalence exercise parameters for the remaining, unknown session (i.e., comparison selection) vs. the input information (base selection). As such, the evaluation of equivalence can go either way or, rather with either session selected as the base selection, such that equivalence can be evaluated and provided for the unweighted MG session based on known exercise parameters for the unsupported session along with unweighting, or can be evaluated and provided for the unsupported session based on known exercise parameters for the unweighted MG session.

Evaluating Comparative Equivalence of Microgravity w/ Unsupported Exercise

Figure 9A:
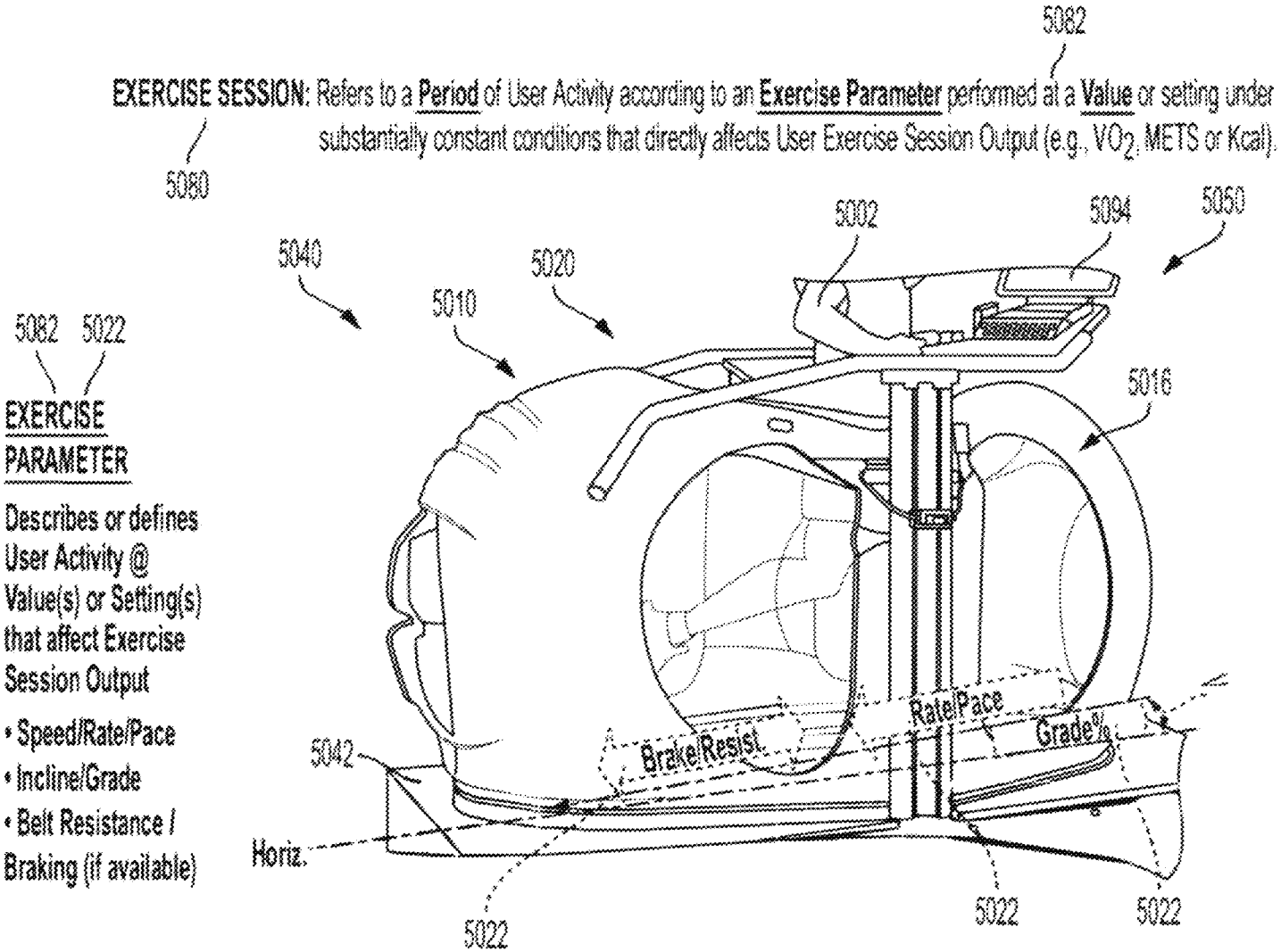
FIGS. 9A, 9B and 9C are each the same right side perspective view shown in FIG. 4 of an example MG system that further depicts example features pertaining to the evaluation of comparative equivalence method of FIG. 8.
Figure 9B:
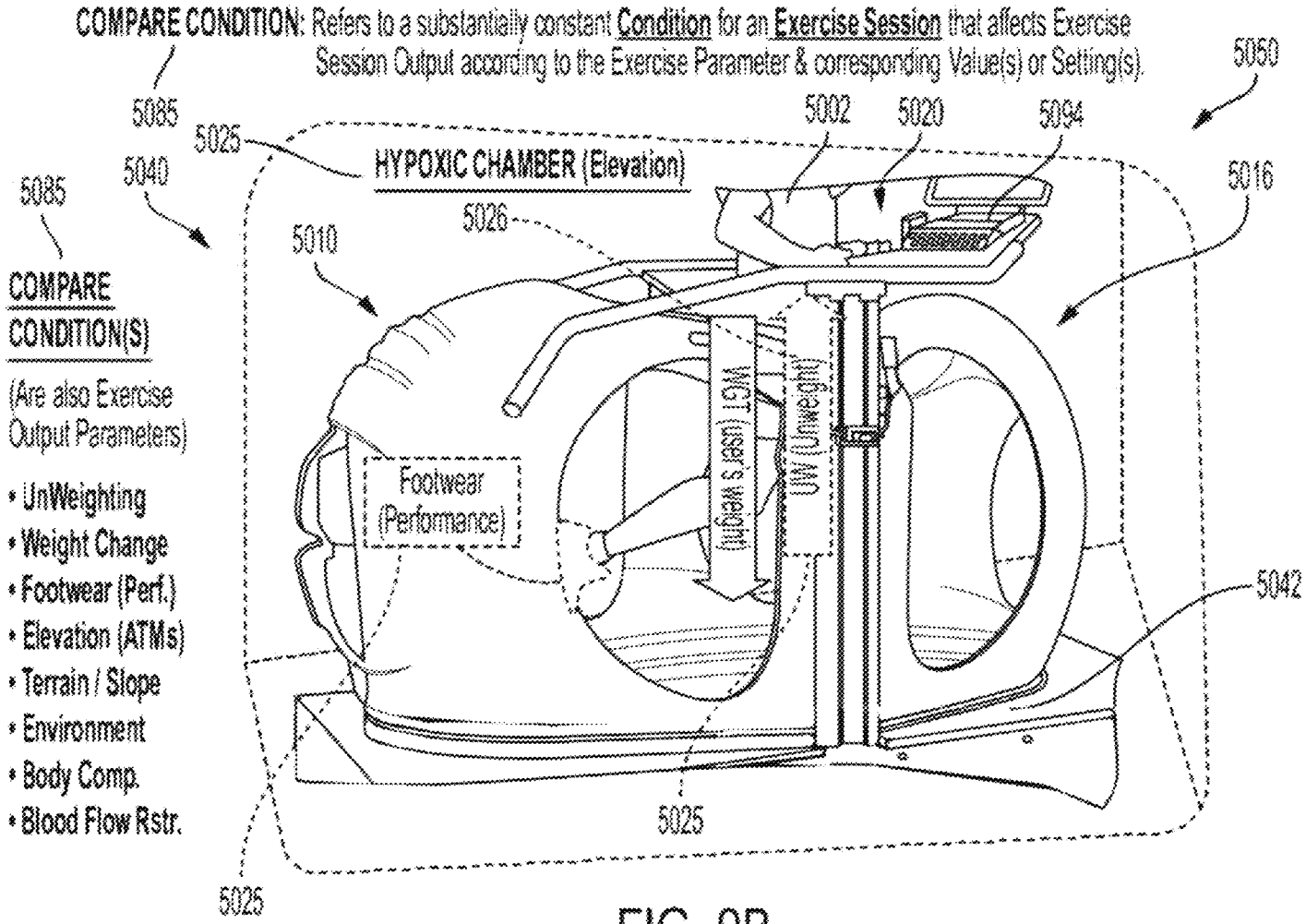
Figure 9C:
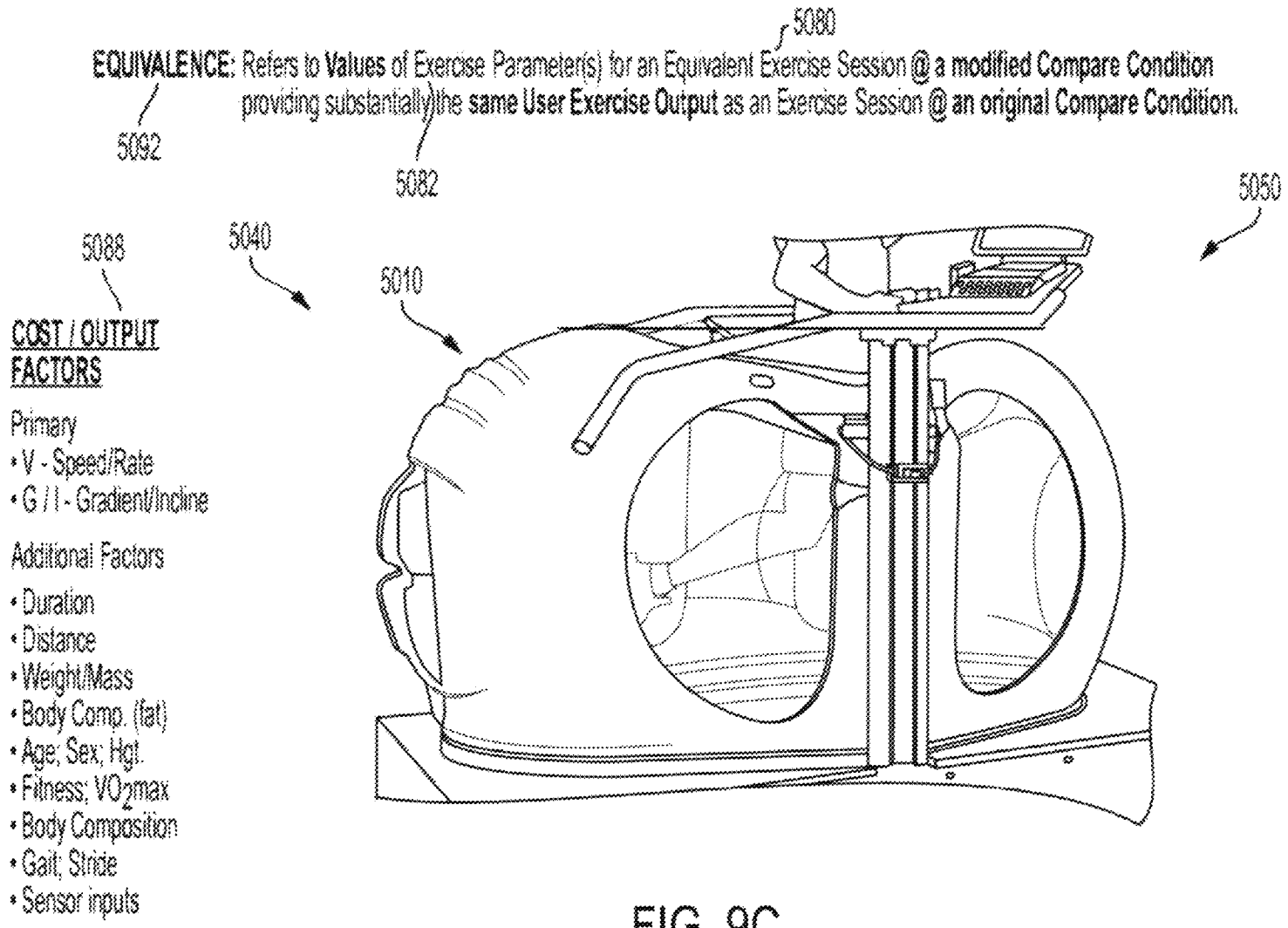

Referring now to FIGS. 9 to 9C, another Method 5050 is generally shown for evaluating comparative equivalence between an unweighted MicroGravity (MG) session 5020 for a user of an MG system 5040 and an unsupported session 5070 for the user according to inventive aspects, features and concepts described herein. Method 5050 generally includes the aspects and features of Method 4950 except as described herein. Accordingly, like numbers refer to like features. Method 5050 primarily differs from Method 4950 in that actions of an equivalence engine 5001 are described for Method 5050 based on an example unsupported off-treadmill exercise session for simplifying related descriptions vs. describing options for both On-Tm and/or Off-Tm exercise, which is implied as an option for methods described herein. Thus, it is understood that method 5050 can include substantially similar actions that can be described using an example unsupported treadmill session rather than describing examples including an unsupported flat run exercise session, which can optionally include multiple unweighted exercise sessions as noted above.

With particular reference to FIG. 8, a Method 5050 is schematically shown for evaluating comparative equivalence between exercise sessions 5080 including an off-treadmill (TM) unsupported session 5070 and an unweighted MicroGravity (MG) session 5020. Exercise output factors for each exercise session 5080 have a Change Condition 5085 including an unweighting (UW) 5085 for each session and an exercise parameter 5082 for one of the sessions. The UW 5085 for the MG session 5020 includes an UW % 5025 provided for a percentage of unweighting of the user during the MG session, whereas the UW for the off-TM session 5070 includes an UW % of 0% for the full percentage of the user's bodyweight (100% bodyweight), or simply the bodyweight of the user. Further, exercise output factors for each exercise session 5080 have an exercise parameter 5082 including a velocity or run speed value as a default exercise parameter, which can further include a gradient or incline value.

The unweighting 5085 for each exercise session 5080 is received by the equivalence engine 5001 along with the exercise parameter (known exercise parameter) for a base selection as a first session selected from a comparative group for the evaluation including at least the MG session 5020 and the unsupported exercise session depicted as Off-TM session 5070. In other words, the unweighting 5025 is provided for the MG session 5020 to indicate a W unweighting, and the unweighting 5075 is either provided to the equivalence engine, such as via a user input, or provided in advance as a default setting having a value of 100% bodyweight for an unsupported session, whereas a known exercise parameter in provided for only one of the sessions (i.e., the base selection for evaluating comparative equivalence—either a partially unweighted MG session or an unsupported session)

The equivalence engine 5001 receives the unweighting 5085 for each session and the $1^{st}$ or known exercise parameter 5082 for the base selection that can, for example, be provided as an input, for evaluating comparative equivalence with a comparison selection of a second session selected as the remaining one of either the MG session 5020 or the Off-TM session 5070. The equivalence engine 5001 is adapted for determining an exercise output per unit of time or duration of the known base selection based on the known $1^{st}$ exercise parameter 5082 for the base selection and unweighting associated with each session, evaluating a session exercise output based on the unweighting for the base selection and the $1^{st}$ exercise parameter that includes determining an unknown $2^{nd}$ exercise parameter 5082 for the comparison selection (e.g., remaining session of the comparative group) based on the session exercise output and the unweighting for the comparison selection. As such, the exercise sessions each have substantially the same session exercise output per unit time or matching duration evaluating according to the base selection, and providing to the user or a support entity the unknown $2^{nd}$ exercise parameter (e.g., equivalence parameter) as output.

With particular reference to FIG. 9A, the MG exercise session 5020 is represented for Method 5050 of FIG. 8B along with exercise parameters that affect an exercise session 5080 (either supported or unsupported). As shown in FIG. 9A, the term "exercise session" 5080 as used herein refers to a period that includes a set duration or open rate (e.g., per min.) of exercise action or activity referred to as an exercise parameter 5082 at a value for a user 5002 that directly affects exercise output that is also known as session output or user cost a session duration or per unit time. As discussed in greater detail below, the exercise output can be determined or expressed as volume of oxygen ($VO_2$), calories or kilocalories (kcal), and/or via normalized values discussed further below known as Metabolic Equivalent of Task (MET) units (METS).

The exercise parameters 5082 for the exercise session including the exercise parameters 5022 for the MG session 5020 that can include at least a velocity value that can be expressed as rate (e.g., miles per hour (mpg) or meters/min.) or as a pace (e.g., minutes & seconds per mile or per kilometer). The exercise parameters can further include a gradient, grade or incline expressed as Grade % or incline % representing a change in height vs. a change in horizontal distance, such as 10% representing, for example, a vertical rise of 10 cm per horizontal distance of 100 cm. As discussed along with additional examples described below, values for the exercise parameters that include both run speed or velocity and incline can provide greater flexibility for evaluating comparative equivalence and enhanced benefits for unweighted exercise for the user. Further, the exercise parameters can optionally include a belt resistance or braking, if available, such as for certain non-powered treadmills including curved treadmills or certain powered treadmills that can accommodate or adjust belt drag for the user when running below a speed setting or resistance for user attempting to run faster than a desired a speed setting, which can also be used for simulating various run surfaces or conditions like running in sand.

With particular reference to FIG. 9B, the MG exercise session 5020 is additionally represented for Method 5050 of FIG. 8B with various compare conditions of an exercise session (either supported or unsupported) and related factors. As shown, the MG exercise session 5020 is shown along with identifying the bodyweight of the user 5002 acting as downward force due to gravity, and an unweighting provided by the MicroGravity system acting upward as an offsetting force that partially unweights the bodyweight of the user according to the UW %. As shown in FIG. 9A, the term "compare condition" 5025 as used herein refers to a condition for an Exercise Session 5080, which if modified would change Equivalent Exercise Parameter values for the providing the same Exercise Output or cost for the session per unit time or duration for the session. So, for instance, unweighting (UW) can be a change condition, which if modified such as from no unweighting to a partial unweighting value, would be known to affect the value of Exercise Parameters (e.g., speed and/or incline) required for meeting the changed condition while maintaining the same or substantially the same exercise output (e.g., speed and/or incline changes for providing equivalent session output). Note that multiple change conditions can be evaluated simultaneously, such as a change condition for unweighting along with an environment change condition (e.g., between running on an MG treadmill unweighted and running off-treadmill without unweighting that involve both unweighting as a change condition and environment as a change condition).

Further, second compare conditions can be evaluated for a pair of exercise sessions along with or after evaluating primary change condition(s), such as (without limitation) a weight change for the user (estimated weight increase or decrease), a footwear change like with and without use of performance footwear or a particular choice of performance footwear, an elevation change like comparing a run at sea level with a run at a higher elevation for equivalent sessions, terrain or slope conditions like running uphill/downhill or on challenging terrain like dirt or sand, environment like a regular treadmill vs. an off-treadmill run, a body composition change like a change of fat percentage and/or free fat percentage, a blood flow restriction session like having blood flow restriction wraps on each leg set to desired % limb occlusion pressure (LOP) for the user, and various other change conditions beyond the examples listed. Note that, change conditions and exercise parameters are both considered exercise output factors, because by definition both directly affect exercise output or cost per unit time or duration to the user under the equivalent set of change condition values and exercise parameters.

FIG. 9B further identifies, as examples, change conditions that can be controlled for a MicroGravity session 5020. For instance, partial unweighting (UW) that can be controlled for an MG session 5020 to provide no-unweighting for an unsupported session or an UW % for partially unweighting the bodyweight of the user, such as 70% bodyweight such about 30% of the user's bodyweight is offset or supported by upward force of the inflatable enclosure. As another example, footwear performance can be controlled for an MG session 5020 (or for an unsupported session), such as using a performance footwear shoe or traditional running shoe for the session. Further, the use of hypoxic chambers are becoming increasingly common for use with various types of exercise equipment, which simulate higher elevation conditions by controlling available oxygen for the user, which can potentially be used for either equivalent session under evaluation. Such chambers could be used with unweighted MG systems, traditional treadmills and/or other exercise systems. Change conditions like these can be evaluated for exercise sessions involving the same exercise system, such as for sessions on a MicroGravity system (e.g., w/ or w/o unweighting, w/ or w/o performance shoes, and/or w/ or w/o elevation differences).

Other types of Change Conditions 5085 can include various hypothetical change conditions of interest for the user applicable to either an unweighted MG session 5020 and/or an unsupported session 5070, such as a weight change or a body composition change. Some Change Conditions 5085 necessarily involve the use of different exercise systems for evaluating equivalence, such as for evaluating a comparative equivalent session for running on a MicroGravity system 5040 with an environment or terrain associated with an off-treadmill session. As noted above and described for examples herein, methods for evaluating comparative equivalent session can include multiple compare conditions, such as the change condition of unweighting with the change condition of an environment for running on a different exercise system or open running without an exercise system.

With particular reference to FIG. 9C, the MG exercise session 5020 is represented for Method 5050 of FIG. 8B along with describing the Equivalence 5082 as evaluated for Method 5050 and further identifying various additional User Cost or Exercise Output factors 5088 that can be considered for evaluating exercise cost or output for the sessions. As shown in FIG. 9C, the term "Equivalence" as used herein and the terms "Equivalent" "Comparative Equivalence," and "Comparative Equivalent" refers to values of exercise parameter(s) for an Equivalent Exercise Session 5080 at an associated modified Compare Condition 5085 that provide substantially the same User Exercise Output or session output per unit time or session duration as an exercise session at an original Compare Condition per same unit of time or session duration.

Note that the term "modified" with respect to Compare Condition is a relative term, such that either session of a pair of sessions evaluated for Equivalence can be considered modified with respect to the other, such that either session could be considered the "base", "original" or "modified" exercise session or selection from a group of comparative exercise sessions. For instance, equivalence can be evaluated for an unsupported exercise session (i.e., without unweighting) vs. an 'original' unweighted MicroGravity exercise session with a % UW and an exercise parameter, OR an unweighted MicroGravity session can be evaluated for a comparative equivalent 'original' unsupported session w/o unweighting and lack an exercise parameter for equivalence. Thus, equivalence can be evaluated both ways between a pair of exercise sessions according to Method 5050, which further contemplates evaluations between multiple comparative session options. For instance, a comparative group can include multiple exercise sessions, for which one can be selected as a base selection and the remaining exercise sessions can be selected as first, second and so comparison selections, for which comparative equivalence can be evaluated vs the base selection.

Further, as described above, values for an Exercise Parameter 5082 and for a Change Condition 5085 can be considered "exercise output factors" in that each of these directly affect the exercise output or user cost for an exercise session, for which equivalence can be evaluated assuming other factors generally remain the same between the sessions. For exercise sessions involving running as the exercise typically performed on MicroGravity systems, exercise parameters 5052 primarily include run speed or velocity, incline or both along with optional belt resistance/braking, and values for change conditions primarily include unweighting along with an identified comparative session environment (i.e., exercise device including off-treadmill, traditional treadmill or an MG treadmill). However, it is understood that various other factors can impact exercise output for a user during an exercise session, and that many different options and methods can be used for evaluating an exercise output value for an exercise session.

For evaluating equivalence or comparative equivalence between exercise sessions for a user, the user is of course a common factor for the exercise output determinations and evaluations. As such, equivalence evaluations can be performed in many cases independently of user-specific attributes as discussed in greater detail below. For instance, the bodyweight of the user is assumed to be the same for both sessions, as is body composition, footwear, fitness level, age, sex and so on unless identified as a Change Condition for the evaluations or otherwise provided to the computer/equivalence engine discussed below. That said, Method 5050 and other equivalence evaluations described herein contemplate the use of complex data sets, user-specific evaluations, sensor inputs, exercise monitors and the like. Accordingly, evaluating comparative sessions as described herein specifically contemplates and encourages using as much user-specific information, measurements and evaluation information and data as may be available for a particular user or equivalence evaluation while also describing evaluating comparative sessions more generally using normalized exercise relationships and exercise output determination methods when supplemental information is not available for a user or appropriate for effective or efficient comparative evaluations, and/or for confidence evaluations with user-specific data and determinations.

The inventors have found that useful evaluations of comparative sessions can be performed using normalized relationships applicable to most users, which are generally accurate for evaluating comparative equivalence and providing related information to the user or support entity—even when more detailed user-specific attribute data is available for users, because the evaluations and comparative sessions are based on the same user and the evaluations are relative, comparative evaluations. As such, the evaluations can generally be performed and accurate information obtained and provided for comparative equivalence independent of user attributes, such as fitness level, age, sex, body composition and so on.

Note that, by definition as noted above for the term 'exercise session,' duration is set for such evaluations at least on a per/time basis, such as per/min. So, for instance, if a base selection for an exercise session were left open regarding time, by default it could be evaluated on a per minute basis, and the session output and equivalence can be evaluated and related information provided to the user according to the same rate or per min. basis. However, if a set duration were provided for a base selection for a session, such as 6:00 minutes, the exercise output and equivalence can also be evaluated and related information provided to the user for the same duration. Stated differently, it is understood that exercise output evaluations including subjective, normalized and/or quantitative measures can be per unit time or pro rata, such as per min. values by default, which are often used for metabolic measures, equations and assessments.

Computer Equivalence Actions and Communications; Equivalence Engine Actions

Figure 10:
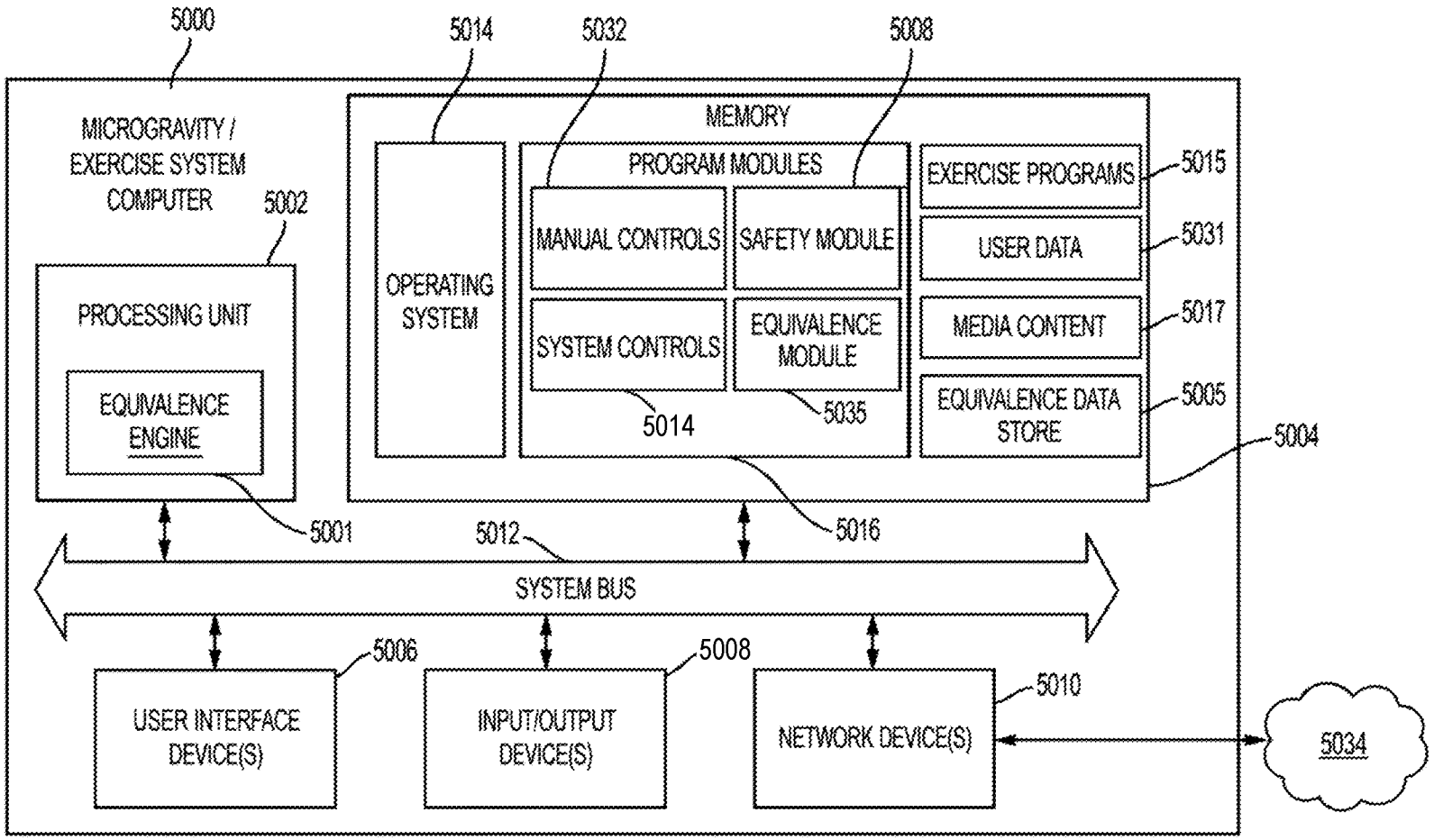
FIG. 10 is another example schematic representation of a computer control system for another example MG system or other exercise system for use with the comparative equivalence method of FIG. 8 arranged for controlling system operations and performing related functions and routines for the comparative equivalence method of FIG. 8.
Figure 11A:
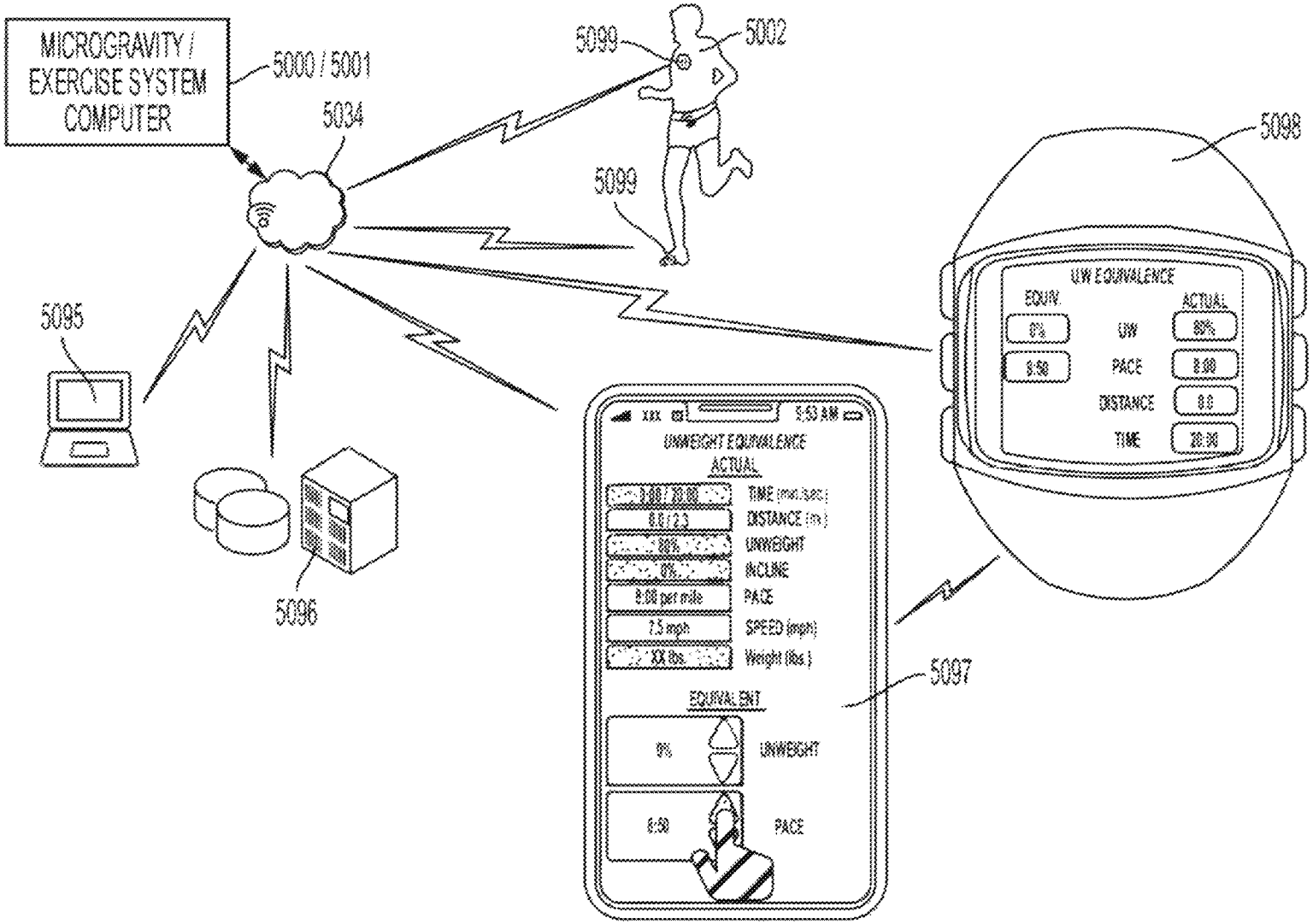
FIGS. 11A, 11B and 11C are each an example schematic representation of communications between the computer control system of FIG. 10 for use with the comparative equivalence method of FIG. 8.
Figure 11B:
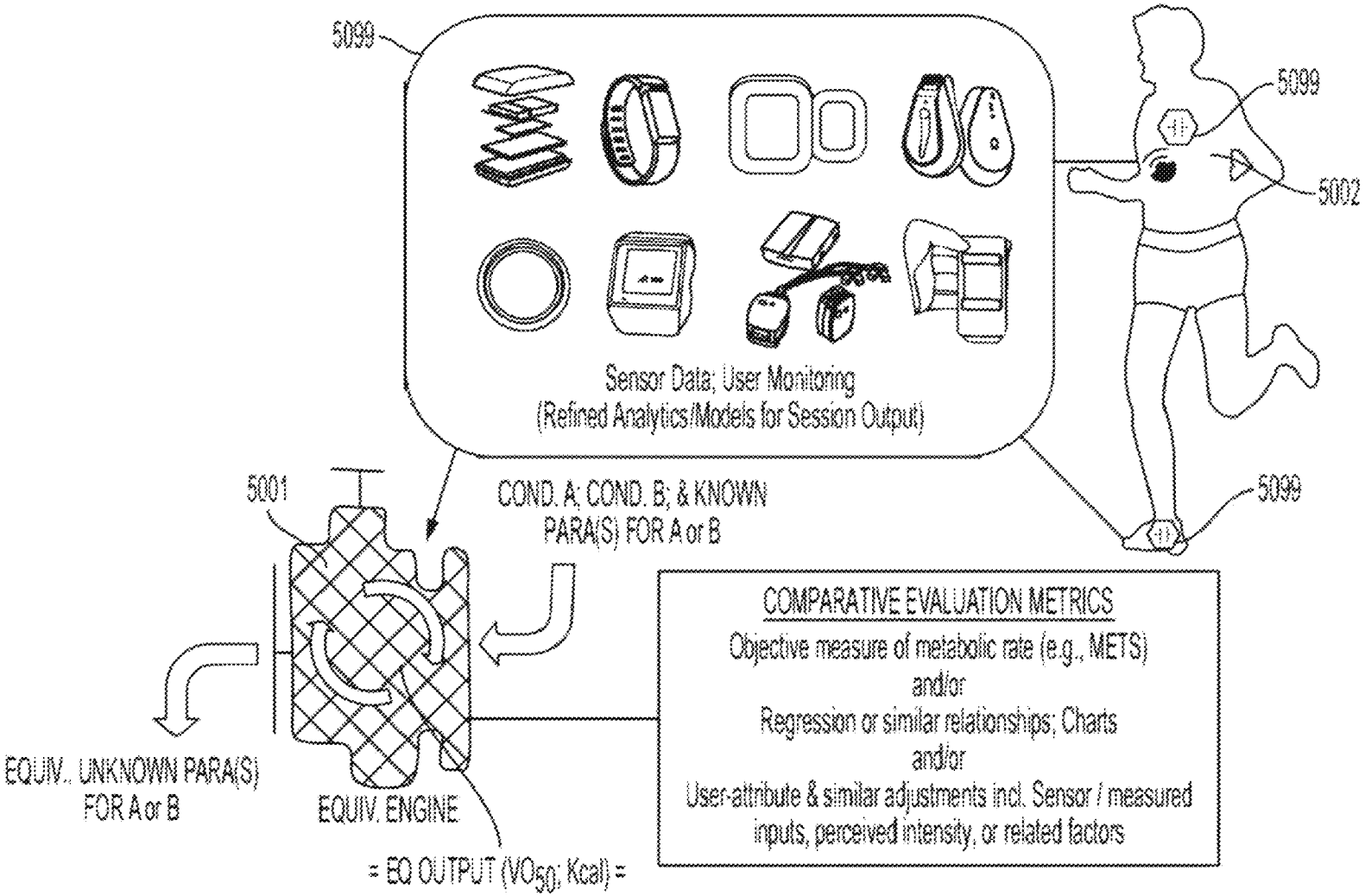
Figure 11C:
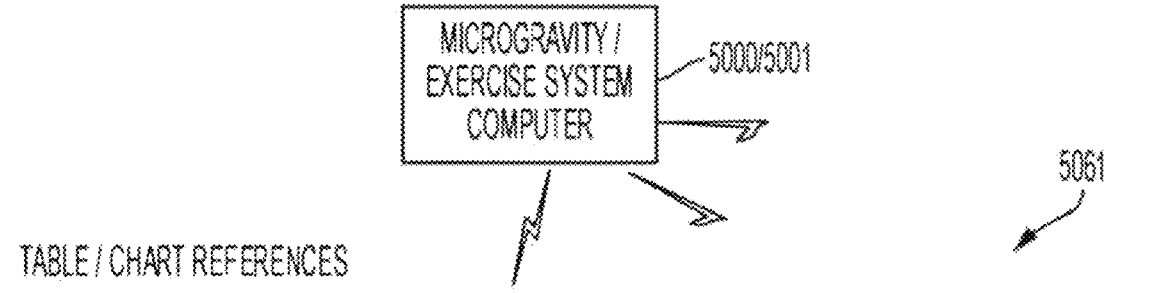
Figure 11C:
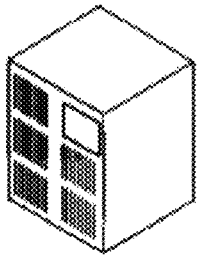
Figure 11C:
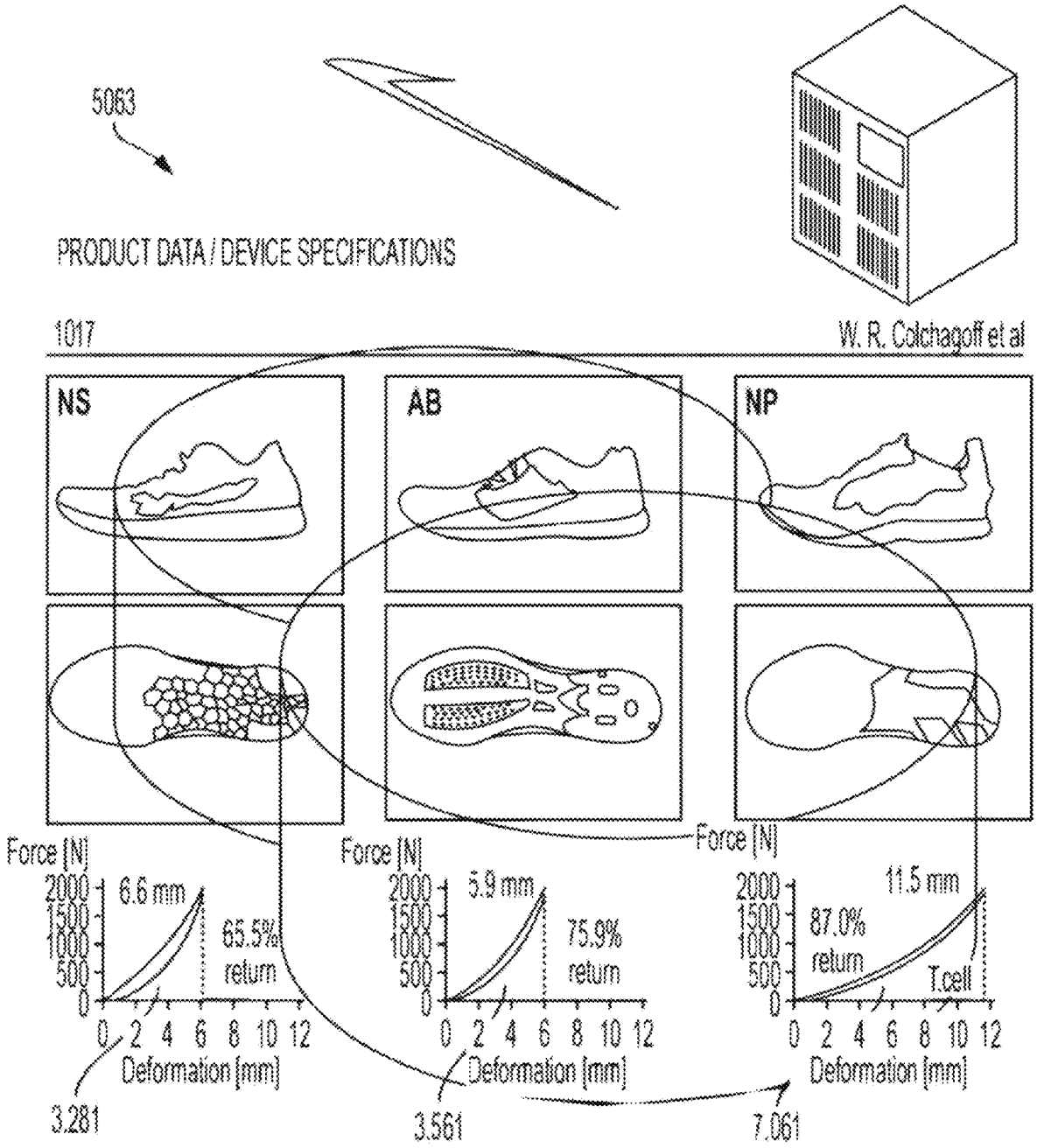
Figure 11C:
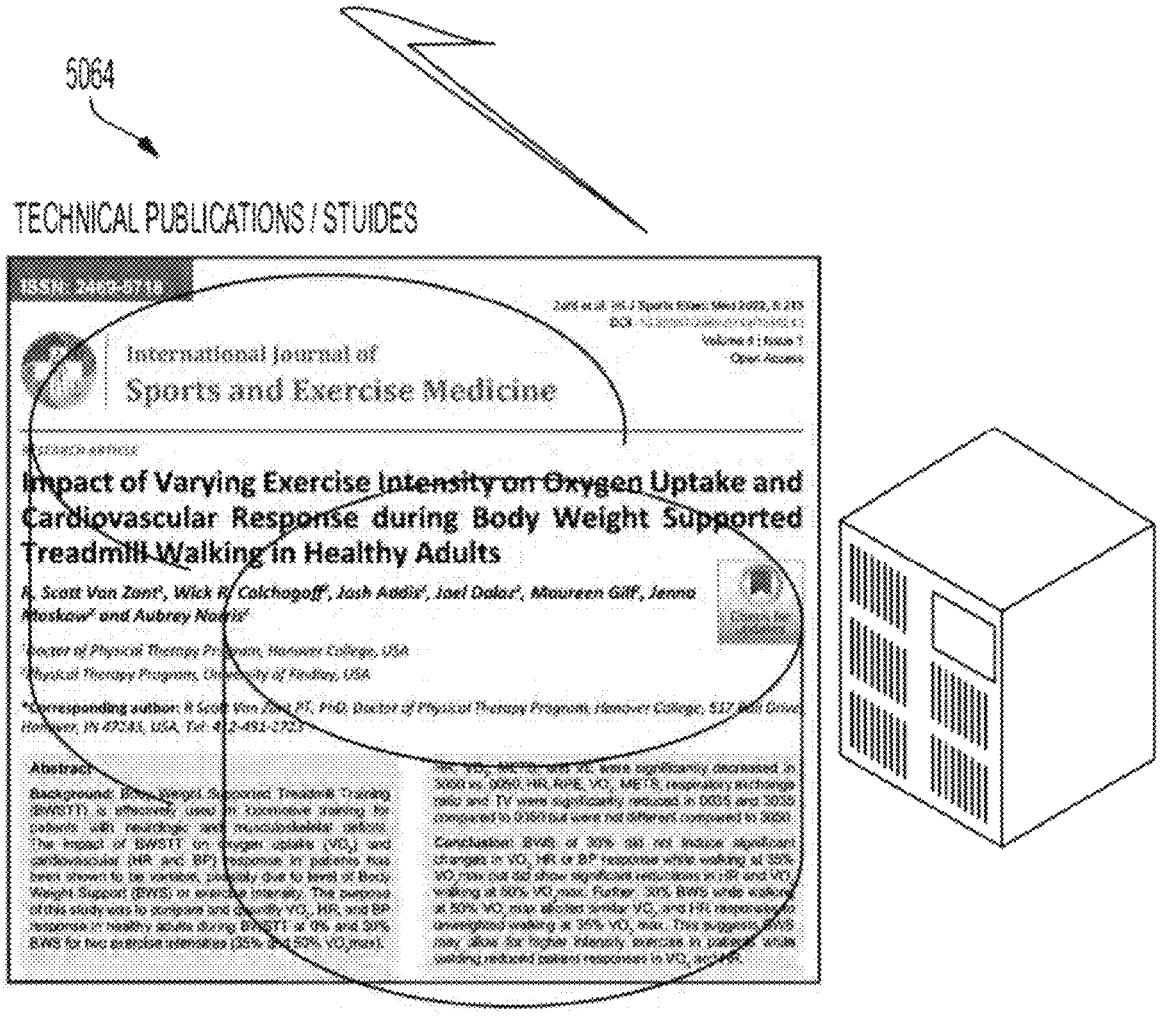

Referring now to FIGS. 10 to 11C, functional components, computing devices, and communications hardware and software of MicroGravity Exercise System Computer 5000 or other computer or group of computers are generally shown that primarily perform actions and operations pertaining to evaluating equivalence of comparative sessions according to aspects, concepts and features described herein. Computer 5000 generally includes the same aspects and features described above for Computer 3300 and described with FIG. 2 except as described hereafter. As such, like numbers refer to like features.

As shown in FIG. 2, the computer 5000 can include an Equivalence Engine 5001, which can include one or more processors, cores (real or virtual), parallel computers or networked computers that can cooperate with the control computer of the MicroGravity system 5340 or another exercise system (not shown) (e.g., a sister treadmill system collocated, proximate, or in communication with the MG system & available for the user and evaluating equivalence for MG sessions) to perform actions pertaining to methods for evaluating comparative equivalence of sessions as described herein. Although shown as part of the processing unit for the MicroGravity or other Exercise Control System, it is understood that the Equivalence Engine can be located elsewhere, and that such functionality can be provided by another computer cooperating with the overall control system including a computing entity in communication with the control system.

For example, the Equivalence Engine 5001 can include a separate or remote computer, a handheld device communicating with the control system, and/or a cloud computing arrangement or system communicating with the system computer, as well as being collocated with the processing unit 5002 of the system or functionally operative as a 'equivalence engine' based on software, modules or other control instructions provided to the processing unit for performing the inventive actions and operations described herein pertaining to evaluating equivalent sessions.

Nonetheless, in view of the specialized functionality of the Equivalence Engine 5001, the Equivalence Engine and/or significant user-specific modules, storage or other control or computer related portions, as well as potentially shared modules or portions and continually updated modules or portions of the control computer involved with equivalence evaluations can be considered a logically separate computing entity or engine even if not physically independent, separately operable as an individual processing or computing entity, or existing physically outside or apart from the MicroGravity Exercise System Computer or another exercise system computer. For instance, it can be desirable or beneficial for the Equivalence Engine 5001 to be independently operable from the MicroGravity Exercise System Computer or other Exercise System Computer, such as for evaluating Equivalence for comparative sessions of users for other exercise systems or for multiple nearby or network connected exercise systems independent of session activities or operations currently ongoing or being considered for the MG system.

MicroGravity Exercise System Computer can include an Equivalence Module 5003 and an Equivalence Data Store 5005 that likewise can be physically included as part of the MicroGravity Exercise System Computer or group of computers, and/or part of one or more other computers, connected or remote devices, cloud storage entities, mobile devices or other processing units or connected devices for providing evaluations of comparative equivalence. The Equivalence Module 5003 can include instructions for determining user energy expenditure for exercise sessions or user exercise output per unit time or duration, and/or for computing equivalence based on a range of options including user-specific determinations and calculations, as well as for performing preferred actions, operations or methods for such determinations and calculations that can be specified by a user for an exercise session or a coach or other professional.

Further, the equivalence module 5003 can include instructions for interacting with and using data, inputs and guidelines from a wide variety of resources that may or may not be available for a particular user and comparative sessions, such as for a user having exercise monitor updates, sensor inputs, professional evaluation factors for determining energy output and the like. In addition, the equivalence module 5003 can include instructions for interacting with resources, such as manufacturers of performance footwear for obtaining technical specifications or factors for evaluating equivalence for a user a particular performance shoe.

Similarly, the Equivalence Data Store 5005 can be co-located with the MicroGravity Exercise System Computer in whole or in part, and/or can include local, remote or connected user storage if even for a session, such as sharing data with a computer accessible or usable by the user, a mobile device of the user, an online or cloud resource pertaining to the user and their exercise performance, etc. User specific data, such as prior session history and basic information can be stored with the MG Exercise System Computer, as well as detailed historical data, attribute data, exercise physiology or specific evaluation data or other information as desired for the user. Further, User Interface Device(s) 5006, Input/Output Device(s) and/or Network Device(s) 5010 pertaining to or related with Evaluating Comparative Equivalence for exercise sessions involving a user can likewise include a wide range of devices, sensors, resources and interfaces in communication with the system computer 5000 as described further hereafter.

Referring now to FIG. 11A, various example computing devices and other devices that can communicate with MG System Computer 5001 and/or Interface Engine 5001 pertaining to and/or for evaluating comparative equivalence are generally shown. These devices can be arranged for long or short-term communication with the Computer 5000/Engine 5001 as appropriate for equivalence evaluations for the user or users over an extended period and/or for evaluating a single pair of comparative sessions for the user. The devices can be physically connected with Computer/Engine 5000/5001 or communicate via network 5034, which includes a wide range of communication options. For instance, network 5034 can include direct wireless communications such as via BLUETOOTH or similar communication mechanisms, via Wi-Fi, mobile network communications and the like.

Further, these communications can occur before, after or during evaluations of the Computer/Engine 5000/5001 of comparative sessions for the user, such as for collecting user or session data prior to performing evaluations, sending related information to a user-accessible computer or storage for the user after performing evaluations, communicating with user sensors or devices during evaluations, and/or throughout interactions or actions pertaining to the user including continually evaluating improvements for performing such or similar evaluations for the user or others. In addition, these devices can enable inputs and interfaces with the Computer/Engine 5000/5001 for providing information regarding equivalence evaluations, direct input/output interactions for such evaluations or during a related session, and/or for evaluating a plurality of comparative sessions and various comparative exercise session options for the same, such as part of evaluations for a workout session or plan for the user that include multiple sessions and evaluations for various sets of sessions/equivalent sessions.

As shown, for example, devices in communication with or connected to Computer/Engine 5000/5001 can include a user-accessible computer or other user-designated or user-related computer 5095 for supporting user interactions or interactions on behalf of a user of the MicroGravity system with the Computer/Engine related to evaluating equivalence, and a designated storage location 5096 such as a user-accessible store, coach accessible store, cloud storage for the user or the like. In addition, these devices can include a mobile device 5097 for the user 5002 and/or a wearable computing device 5099, such as a watch or similar device that can in communication with the mobile device 5097 and/or be in direct communication with the Computer/Engine 5000/5001. Further, these devices can include sensor devices 5099 including user-worn sensor devices, clothing embedded sensors or footwear sensors, as well as other sensor devices such as a load plate (not shown) on a treadmill or other exercise device set up for sending user exercise data to the Computer/Engine 5000/5001.

Referring now to FIG. 11B, further examples of sensor devices 5099 are shown, which can significantly vary with respect to levels of sensing, monitoring and data evaluation capabilities, all of which can communicate with the Computer/Equivalence Engine 5000/5001 regarding user fitness, exercise sessions, attributes and other information that can assist with evaluating equivalence comparative sessions of the user. The equivalence engine 5001 can maintain current exercise performance data and related information for the user, such as user preferences and attributes, which can be used for evaluations of comparative sessions for the user according to related preferences and/or potential accuracy improvements or specialized outputs. For instance, if detailed data and relationships are available for indexed heartrate (HR) data, relative Metabolic Equivalent of Task (METS) information and/or other complex performance user-assessments, data and device or sensor inputs/outputs, more precise exercise output determinations can be performed especially if based on exercise output measurements for a base selection of an exercise session evaluated for equivalence.

Referring now to FIG. 11C, a plurality of additional network devices are shown for communications with the Computer/Engine 5000/5001 pertaining to evaluating equivalence between comparative sessions in general, for multiple users or groups of users, and/or for a particular user, which can include reference communications, obtaining updates and/or as needed primary or supplemental communications for supporting EQ evaluations. The example network devices can include communications with Technical Reference Resources 5061, such as for obtaining Metabolic Charts, physiological evaluation updates, and the like such as periodically provided by governments, standards entities, event or race authorities & hosts and the like for obtaining specific criteria pertaining to a comparative evaluations for a user. The example network devices can also include Control resources 5063 for obtaining logic updates, proprietary resource information for operations of the equivalence engine 5001 or equivalence module 5003 or additional resource information as needed for evaluating equivalence, such as for evaluating a new change condition for a user.

Further, the example network devices can include product resources 5063 and technical exercise resources 5064 as needed, desired or appropriate for evaluating comparative equivalence. Product resources 5063, for instance, can include requests for and retrieval of performance shoe specifications for a requested change condition of a user. Technical exercise resources 5064, for instance, can include requests for and retrieval of recent elevation data or blood flow monitoring data for use with evaluating comparative equivalence of sessions involving recent, cutting edge or new areas of exercise physiology and equivalence information for a request change condition or other evaluation for a user.

METS Example Evaluation Mechanisms

Referring now to FIG. 12 along with FIG. 8, normalized exercise output relationships are shown in FIG. 12 in the form of example metabolic relationships that can be used by the computer 500 or the equivalence engine 5001 for performing actions of Method 5050 shown in FIG. 8 and other related methods described herein. As discussed below, the normalized relationships including potential modifications and adjustments of the same are provided below as example evaluation mechanisms that can be used with Method 5050 and other related methods described herein. However, it is understood that Method 5050 and related methods are not so limited, and that various other evaluation mechanisms can also be used with Method 5050 and other related methods discussed herein, as well as combinations of evaluation mechanisms, modified versions of evaluation mechanisms, and adjustment factors or relationships that can be applied to various evaluation mechanisms.

As discussed along with FIG. 8, Method 5050 includes evaluating comparative equivalence between an MG exercise session 5020 and an unsupported exercise session 5070, which together can be considered a comparative group 5045 that includes both exercise sessions. Method 5050 further includes evaluating a session output 5087 of the comparative group based on an unweighting 5025,5075 for the base selection and a $1^{st}$ exercise parameter 5022,5072 for the base selection including a first run speed and a first incline, for which the computer or equivalence engine can use normalized metabolic relationships to perform such as those shown in FIG. 12. In particular, the example metabolic relationships of FIG. 12 can be used for estimating the session output 5087 based on the 1st exercise parameter of a base selection exercise session 5020,5070 of the comparative group, against which adjustment factors can be applied regarding unweighting and potentially an exercise session environment for estimating the session output, such as for performing the exercise session off-treadmill, on-treadmill, or on the MG system.

Evaluating the session output of Method 5050 includes determining a 2nd exercise parameter 5022,5072 based on the session output 5087 and the unweighting 5025,5075 for a comparison selection of the comparative group, for which the 2nd exercise parameter includes a second run speed and a second incline. Likewise, the same example normalized metabolic relationships can be used for determining the 2nd exercise parameter based on the session output 5087 along with applying adjustment factors as appropriate regarding unweighting and potentially an exercise session environment. For instance, the running" equation shown on FIG. 12 can be used to evaluate the exercise output 5087 based on the 1st exercise parameter that includes the first run speed identified as "S" in the equation and the first incline identified as "G" in the equation, which provides a preliminary session output in the form of estimate of Running $VO_2$ for a general running session, for which the running equation applies for run speeds greater than 5 mph. Adjustment factors can further be applied for the unweighting and applicable exercise environment or device. In a similar manner, the sane running equation can be used in reverse for determining the second run speed and second incline as the 2nd exercise parameter 5022,5072 of the comparison selection.

Normalized estimates and subjective determinations of exercise output for a user during an exercise session can often deviate slightly or even significantly for a user in comparison with subjective session output calculated or measured for a user based on attribute data for the user (e.g., fitness level, age, weight, and sex), sensor inputs, and ongoing performance evaluations. Nonetheless, normalized estimates can provide accurate evaluations of comparative sessions as relative measures for the same user performing (or evaluated to perform) each session under substantially the same conditions other than those applied as factors (e.g., exercise parameters and compare condition including unweighting), as well as for many other users.

The normalized relationships apply to a large portion of the population, but can deviate from actual measurements for specific users. They are based on extensive evaluations of metabolic output relationships for particular types of exercise applicable to all users. As such, the normalized relationships can provide accurate equivalence information for most, if not all, evaluations of comparative sessions for the same user within relatively high confidence levels—particularly with respect to run exercises, within appropriate limitations, such as greater than 5 mph for metabolic determinations under run conditions or run motility vs. walk or job motility. Further, these relationships can be used for providing such comparative equivalence information independent of attribute information for the user, such as the user's weight or estimates thereof.

FIG. 12 depicts known Metabolic Equations for Estimating Gross $VO_2$ (Gross Output) of a user session for each of the exercises shown including Running based on equations and relationships determined by the American College of Sport Medicine (ACSM) as of the Eight Edition, published in 2010, which equations have largely remained unchanged for many years despite numerous evaluations and verifications, and which continue as a significant tool for evaluating metabolic exercise output. The measure "Gross $VO_2$" refers to the gross volume of oxygen used by a user on a per min. basis for Running with respect to the exercise parameters of Velocity (shown in FIG. 12 as S for speed) in meters/min. and Incline or Gradient (shown in FIG. 12 as G for grade (% incline)) in decimal form. Note that $VO_2$ is directly related to calories burned, which is more often presented as kilocalories or "kcals" according to the standard for 1 Liter of oxygen used during metabolic activity equal to 5 kcal of energy burned. Further, each of the Gross $VO_2$ relationships can readily be converted into Metabolic Equivalent of Task (METS) or MET by dividing the Gross $VO_2$ output calculated per min. for an exercise session by the resting $VO_2$ amount, which has been set as 3.5 mi/kg per min. as a standard amount.

The metabolic equivalent of task (MET) is the objective measure of the ratio of the rate at which a user expends energy, relative to their mass, while performing some specific physical activity such as running compared to a reference, which is currently set by convention at an absolute 3.5 mL of oxygen per kg per minute (resting $VO_2$). Resting $VO_2$ is the energy typically expended when the user is sitting quietly, which is chosen to be roughly representative of the general population at the 35 value. A primary use of METs is to grade activity levels for common household activities (such as cleaning) and common exercise modalities (such as running). An earlier convention defined the MET as a multiple of the resting metabolic rate (RMR) for the user, such that the user's resting metabolic rate can be measured by absolute gas exchange, absolute thermal output, or steady-state diet in a sedentary condition (with no reference to body mass), which continues in use by many. Such optional MET determinations are not normalized, and can be estimated from age, sex, height, body mass, and estimated fitness level (which in part functions as a proxy for lean body mass). As a relative measure, it can be used with a rating of perceived exertion.

Many coaches and professionals prefer a measure of exercise output and exertion indexed to maximum heartrate (HR), which is easy to monitor continuously with modern consumer electronics. Some exercise equipment with an accurate delivered-wattage indicator permits the use of 'relative METs' for the same purpose, which assumes a known ratio of biological efficiency in converting metabolic energy to mechanical energy. The ratio can be fined tuned over time, but for most is commonly estimated as around 25%. A benefit of relative METs vs heart rate is that it can track fairly directly to caloric consumption, and can be used to judge the impact of task exertion on fed or fasted states in various dietary regimes, and is sometimes denominated in MET-hours (effectively RMR-hours), where sedentary hours count as unitary.

Many users evaluate their fitness with a medical or athletic professional to determine their $VO_2$ and $VO_2$ max for use with planning exercise sessions, as well as evaluating blood lactate levels, gases expelled, and other parameters. Further, numerous exercise monitoring devices having global positioning system (GPS) tracking, heart rate sensors, accelerometers and so on are increasingly available to users along with user-worn sensors retained in clothing, shoes, belts or other attached devices. In addition, exercise device sensors such as load plates are also becoming increasingly available and used by various users to monitor, evaluate and identify fitness characteristics and attributes for the user. These values can allow for the use of more complex and user-specific evaluations of user exercise output for comparative exercise sessions along with session output values calculated based on user attributes and measured data, and/or largely measured for the user.

However, in many cases, evaluating comparative equivalence using normalized evaluations including METS evaluations can be highly accurate, if not equally accurate, to complex measurements, physiological tests such as graded exercise tests, and longer-term evaluations, and equivalence information based on evaluating comparative sessions for the same user and same overall conditions except those specific to the comparative evaluation has proven accurate for identifying the same or substantially similar exercise outputs as equivalents for each session.

As further shown in FIG. 12, METS values determined based on the normalized ACSM running calculations are generally considered appropriate for treadmill or non-treadmill, and outdoor (e.g., flat run) determinations. However, it is generally understood that running on a traditional treadmill is typically easier or requires less energy output for the same velocity and/or velocity and incline % (if running uphill off-treadmill) vs. off-treadmill runs. The reduced energy output has been assumed to be related to powered belt movement of most treadmills, benefits from having a set, regular rate established by the treadmill, lack of wind resistance or drag when running on a treadmill vs. outside or on an indoor track based on actual vs. relative movement, and various other considerations. Regardless of factors and cumulative reasons, differences are known to exist between on-treadmill and off-treadmill running, which are not specifically addressed or determined using the ACSM equations and evaluations. Thus, as shown in FIG. 12, as an example, evaluations of MET (run) exercise outputs involving a traditional treadmill and/or an MG treadmill can involve having a Tm Factor applied to METS determinations.

Numerous studies, well documented user output tests for persons running multiple exercise sessions at varying speeds and intensities have been performed for test subjects exercising on both unsupported standard treadmills and unweighted MicroGravity-type systems by varying % UW as discussed above along with FIG. 6. One of the more recent of these types of studies includes a study performed over 2019 & 2020 in Arizona for which the corresponding research article is entitled, "Cardiorespiratory and metabolic responses to exercise testing and lower-body positive pressure running", which included healthy yet untrained subjects for investigating among other things, the impact of body-weight supported (BWS) treadmill exercise regarding hemodynamic and metabolic responses (the "Arizona Study").

The research made use of numerous evaluation and measurement devices for accurately evaluating exercise output for the persons, which ultimately concluded that "reduced metabolic workload [for UW sessions was] indicated by a slower increase in $VO_2$ per kilogram" (i.e., MET exercise output values). The study further concluded that many of the various, more extension measures of exercise output and alternative options for determining exercise output stayed within normal levels suggesting that more complex, sensor and measurement mechanisms for evaluating exercise output for exercise during an UW sessions were similarly accurate or corresponded well with basic ACSM evaluations for running when adjusted for UW, in that an anticipated lower workload during UW exercise likewise resulted in lower $VO_2$ per kg or exercise output during testing.

Numerous other evaluations and studies of MicroGravity Systems were performed prior to the Arizona Study, and many have been conducted since. Despite conclusions from various other studies confirming exercise output reductions occur as unweighting percentage increases, various graduated exercise therapy (GXT) trends and recovery/improvement recommendations involving the use of MG systems continue to identify significantly increased velocities for UW exercise sessions to users for maintaining similar fitness levels as for unsupported exercise rather than or without considering comparative equivalence of an UW session and an unsupported session regarding combined metabolic effects of velocity and incline. Further discussion of these and other proposed solutions regarding unweighted exercise are discussed in the BACKGROUND and above along with FIG. 6.

Based on the many and various studies and evaluations between unweighted sessions and unsupported sessions, along with findings, raw data, and linear regression analyses of results for wide ranges of participant types that have been published and provided, which further refine core metabolic relationships pertaining to unweighting, the inventors have been able to identify, refine and determine metabolic relationships and exercise output factors appropriate for evaluating equivalence between UW sessions and unsupported sessions. As further discussed along with other example methods herein, such metabolic relationships and mechanisms include evaluating comparative equivalence based on run speed or walk speed as appropriate combined with gradient or incline, which can enable further advantages and enhanced benefits for use of unweighted exercise for users.

These can include use of adjustments such as a Tm Factor for comparing UW Tm sessions with standard Tm sessions to adjust for exercise performance losses identified by many studies and UW session evaluations for a run exercise session performed on an MG treadmill, without unweighting, vs. a standard treadmill, as well as for adjusting for On-Tm vs. Off-Tm exercise. The adjustment amount can include a weighted UW Factor determined based on an unweighing percentage, or more precisely, based on a body-weight % associated with a particular exercise (e.g., running or walking). Further, the inventors have considered and evaluated primary metabolic exercise parameters long identified and available for evaluating run exercise output per unit time or duration that rely on fundamental ACSM metabolic relationships. In particular, both velocity (run or walk speed) and incline exercise parameters as primary factors considered and used to the extent available and appropriate for evaluations of comparative equivalence sessions.

Nonetheless, it is understood that the METS and normalized, ACSM-based relationships depicted herein for example evaluations of comparative equivalence represent scenarios and mechanisms related to evaluating comparative equivalence as discussed herein, and more particularly for evaluating a session output for a comparative group including an unweighted and unsupported session (walk, jog, or run) based on related unweight for each, and gait speed & incline for one session, as well as determining gait speed & incline for the other session. Existing multi-regression formulas and relationships have various limitations and drawbacks as noted in the BACKGROUND and along with FIG. 6 including various age, fitness, sex, elevation/altitude or other limitations and/or the lack of options for evaluating incline % other than level conditions. However, it understood that conventional relationships and ongoing improved relationships can likely be included as available and/or along with further characteristics or user information if/when available and/or for improving accuracy along with the METS/ACSM based examples provided herein without limiting or detracting from various innovative concepts, aspects and features described herein.

The ACSM relationships and METS approach are recognized as one of many various approaches for evaluating exercise output, for which the present application and Method 5050 and other methods, aspects and features described herein are not so limited. Nonetheless, fundamental metabolic exercise parameters primarily rely on the exercise parameters of velocity as the horizontal factor and overall primary exercise parameter value for exercise output evaluation and metabolic output purposes, as well as on grade, gradient, incline or incline % as an additional fundamental exercise parameter and vertical component for at least equivalence evaluation purposes, which applies as well for UW exercise sessions.

One UW relationship that the inventors have previously identified for use when evaluating UW % as an UW Factor to adjust unsupported treadmill or open run exercise output determinations includes the following relationship; UW Factor=1−((−1.1302)*BW %)+1.2045)), which can be used as a factor for adjusting a determined exercise output, such as based on the ACSM run evaluation an Exercise Output per unit time is proportional to an UW Factor*(V*0.2)+(V*G*0.9)/3.5 where V is run velocity in m/min, and G is a gradient or incline in % incline for the run. Further, Exercise Output for equivalence evaluations of unweighted exercise sessions can be determined as being proportional to the relationship of [1−((−1.1302)*BW %)+1.2045))]*(V*0.2)+(V*G*0.9)/35 that provides a METS exercise output per kg. In addition, a Tm Factor can be applied for adjusting for exercise output losses identified between a standard treadmill and an AG-type unweighting treadmill, such as about a 7% loss or reduction in exercise output as identified for at least one study and evaluation of UW treadmill systems and related exercise discussed above along with FIG. 6. Accordingly, one option for evaluating exercise output between an unweighted, MG system and an unsupported on or off-treadmill session can evaluate one or more of the following factors regarding exercise output determinations:

E.Output α [Tm Factor]*[UW Factor]*$VO_2$ or other metabolic estimates (V & I);

E.Output α [Tm Factor] [1−((−1.1302)*BW %)+1.2045))]*(V*0.2)+(V*G*0.9)/3.5;

Such that E.Output is proportional to METS (per kg., per min.) based on the example relationship, where:

BW % is bodyweight % of the user's weight in decimal form;

V is Velocity in meters/min.; and

G is Gradient in % or Incline %.

Most, if not all MG system users after performing for at least a few unweighted exercise sessions show significant interest in knowing what the exercise session they are proceeding with, have completed, or plan to perform compares to as an equivalent for either a standard treadmill exercise session or an unsupported off-treadmill exercise session with which users are more familiar. Further, most MG system users including long-term users are somewhat perplexed as to various exercise factors and related exercise effects regarding UW and unsupported sessions, such as Work Performed, Load, Peak Loads and other considerations, which can be evaluated and provided to a user or users as requested or desired and/or as overall information in accordance with aspects, concepts and features pertaining to evaluating equivalence as described herein.

Evaluations of equivalence between UW sessions and unsupported sessions and related functionality can enable these and various other related beneficial aspects and features for unweighted exercise and unweighted MG systems, as well as for other exercise systems and sessions. More specifically, evaluating comparative equivalence according to aspects, concepts and features for methods described herein include providing comparative equivalence information to the user and/or support entity, such as a coach or therapist for the user, which can include arrangements for automatically evaluating comparative equivalence that include providing comparative equivalence information to the user and/or support entity. The comparative equivalence information can readily provide an effective, easily understood, relative measure of an unweighted exercise session to the user and/or support entity as comparative equivalence information with a familiar unsupported exercise session. This information can be used as a significant tool to improve use and effectiveness of unweighted exercise for the user and enhance benefits the user can gain from unweighted exercise.

Relative Evaluations; Multiple Analytics, Sources and Evaluation Mechanisms

With continued reference to FIG. 12 along with FIGS. 6,8, 11A & 11B, the Method 5050 of FIG. 8 is further described with respect to options for evaluating comparative equivalence that can make use of various analytic options, sources and evaluation mechanisms. The comparative information provided to the user and/or support entity can include relative information rather than exact measurement values for exercise or energy output for the user for a user session, such as precise $VO_2$ measurements and/or calculations. As noted for the above METS discussions, evaluations can be performed based on normalized data and relationships applicable for most people that can be readily used for comparative evaluations. However, other analytic options can also be used and/or multiple evaluation mechanisms can be used for evaluating comparative equivalence as discussed herein including for verifying comparative equivalence information.

In addition, combinations of evaluation mechanisms can be used along with Method 5050 and related methods described herein as appropriate for particular conditions and/or for results validations and verifications. For instance, although various proposed solutions discussed in the BACKGROUND include significant drawbacks and shortcomings, such as limiting research for unweighted exercise to run speed as a single exercise parameter, almost uniformly restricting evaluations for unweighting to increments of 10% (90% bodyweight 80% bodyweight, 70% bodyweight, etc.), and similarly restricting run speed evaluations to 5 mph increments, such results can be used for verification and validation of comparative equivalence information evaluated from other evaluation mechanisms according to aspects, concepts and features described herein.

Further, relationships between exercise parameters and exercise output for unweighted exercise can significantly change with respect to unweighting applied to the user, such that reasonably accurate evaluation mechanisms can have limited applicability to ranges of unweighting applied to the user or other limitations. For instance, a first evaluation mechanism or relationship can be validated as providing reasonably accurate results for a range of unweighting applied to the user, such as from about 65% to 90% bodyweights, but unreliable outside of that range, and a second, different evaluation mechanism or relationship can be validated as providing reasonably accurate results for a range of about 50% to 70%.

As such, an applicable evaluation mechanisms and relationships can be identified and applied according to corresponding limitations, such as using the first evaluation mechanism for an unweighted session at 80% bodyweight and the second evaluation mechanism for an unweighted session at 60% bodyweight. Further, multiple applicable evaluation mechanisms and relationships can be used for evaluating equivalence, for which corresponding results can be compared, contrasted and/or verified for accuracy to determine an appropriate mechanism or relationship, as well as combination results using multiple evaluation mechanisms or sources. For example, for an unweighting of 65% bodyweight, both the first and the second evaluation mechanism can be used for evaluating equivalence, and comparative equivalence information can be based on results using one of the equations deemed more accurate for the applicable scenario or overall, and/or based on a combination of the evaluation mechanisms.

Further, aspect, concepts and features described herein contemplate the use of various and changing evaluation mechanisms and related sources for verification purposes, continued improvement based on research and development advancements and relationships identified, user preferences, and according to limitations and accuracy of evaluation mechanisms and relationships. The following example scenarios and depictions include or address various aspects, features, options and functionality mentioned above and/or related to exercise equivalence evaluations according to Method 5050 and related methods.

Interface Interactions Examples—Single Exercise Parameter (Speed)

Figure 13:
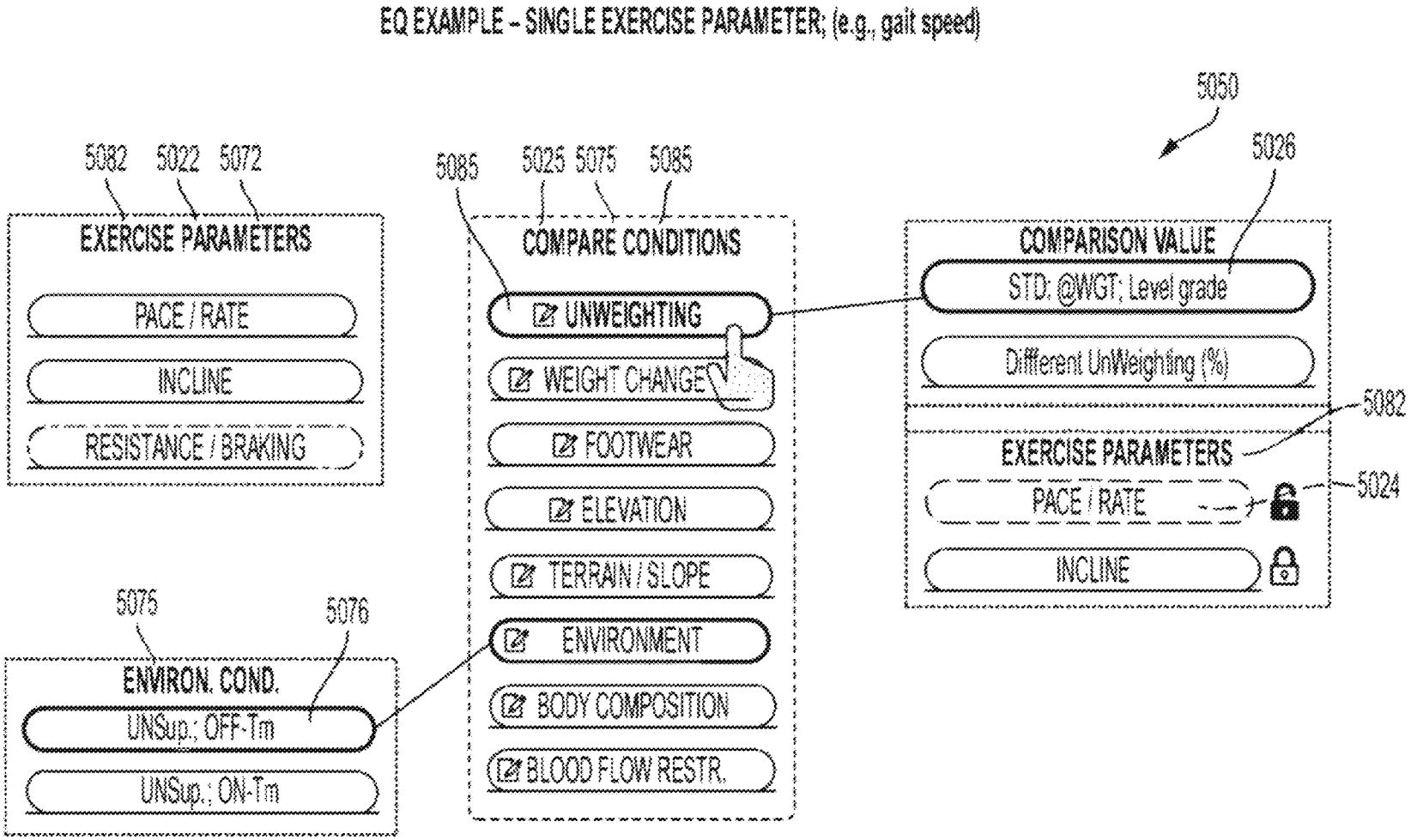
FIGS. 13, 14 and 15 are each an example schematic representation of an interface with the computer control system of FIG. 10 for the method of FIG. 8.

Referring now to FIGS. 13 through 17, a plurality of example interface actions and example user interfaces are shown for Method 5050 and related actions pertaining to evaluating comparative equivalence for one or more unsupported run sessions (Off-Tm) and an equivalent unweighted session on the MicroGravity system such as MG system 3240, which can be considered as a comparative group of exercise sessions for Method 5050. With particular reference to FIG. 13, an example schematic representation of interactions with the Computer/Equivalence Engine 5000/5001 for Method 5050 are shown, which depict actions for receiving an unweighting (UW) by the computer/equivalence engine for each exercise session of the comparative group and a $1^{st}$ exercise parameter for a base selection from the comparative group. As shown, unweighting 5085 is selected as a Compare Condition for evaluating comparative equivalence, which can optionally be established as a default compare condition for a comparative group that includes an unweighted MG exercise session.

The comparative group for evaluating comparative equivalence for Method 5050 includes an unsupported exercise session 5070 as a default exercise session selected as a base selection of the comparative group according to user preferences for the present example and/or according to system preferences of the MG exercise system 3240 or the computer/equivalence engine 5000/5001, as well as an unweighted MG exercise session 5020. The unsupported exercise session 5070 (i.e., non-unweighted exercise session) can be established as a default exercise session for evaluating comparative equivalence with the MG exercise session 5024), because most uses are familiar with walking or running exercise in an unsupported environment and can typically identify a run speed (walk speed or run speed) or range of run speeds likely appropriate for an exercise session. As such, the unsupported exercise session 5070 can act as the base selection as an optional default setting, which can be used as a relative measure by the user or support entity for identifying settings of an UW MG exercise session considered comparatively equivalent to the familiar unsupported exercise session.

Optionally, the unweighted MG exercise session can be selected as a default base selection, such as for identifying to the user or a support entity a comparative equivalent unsupported session for a current unweighted MG exercise session performed by the user, already performed, and/or planned for the user to perform, which can identify for the user a readily understandable reference for considering aspects of the MG exercise session. Further, Method 5050 can include evaluating equivalence between the unweighted MG exercise session 5020 at a first UW with a different unweighted exercise session at a second, different UW. Thus, as shown in FIG. 13, options can be provided for selecting a comparison value for a second exercise session for evaluation with the MG exercise session 5020 having as a comparison value an option for "Different Unweighting (%)" or similar, which is depicted as unselected in FIG. 13. An option for selecting a comparison value of "STD: @ WGT; Level grade" is provided as well and depicted as 'selected' in FIG. 13, which can represent a standard unsupported exercise session performed without unweighting (at the users bodyweight) at a level grade.

Further, optional selections can be provided for a combination exercise environment/compare condition 5075 for identifying an unsupported exercise session performed either on a standard treadmill or as an off-treadmill exercise session, for which such as a selection that provides a compare condition value 5076 at bodyweight or 100% bodyweight for the UW 5075 under an exercise environment of either on-treadmill or off-treadmill. Exercise environment can be a helpful option for considering a Tm factor or other appropriate adjustment for use with evaluating the session output as discussed above along with FIG. 12. As such, information received by the computer/interface engine can optionally include an exercise environment for one or more of the exercise session of the comparative group.

As further shown in FIG. 13, options can be provided for identifying exercise parameter values 5024 for Method 5050, such as run or walk speed 5024 alone, and/or in combination with incline and optionally with belt resistance/braking. The exercise parameter value 5024 of the default base selection for the unsupported exercise session 5070 in an off-treadmill environment also includes a level or horizontal grade condition, such that the incline % would be considered zero % for the example shown. As such, the $1^{st}$ exercise parameter can include a run speed for the unsupported exercise session, which is often considered a primary exercise parameter value for evaluating comparative equivalence between sessions, along with zero % incline, which is often applicable for off-treadmill exercise.

An option is also shown for the example of FIG. 13 for selection of exercise session values 5024 to be considered for the equivalence evaluation for the MG exercise session 5020 as the compare selection. FIG. 13 depicts selection of"incline" for the MG exercise session as being "locked" for indicating incline setting adjustment is unavailable for consideration along with run speed for the $2^{nd}$ exercise parameter. As such, for evaluating comparative equivalence, incline % for the MG exercise session as the comparison selection will be considered as zero % or horizontal/level. As discussed along with other examples, run speed and incline can be included for evaluations of comparative equivalence, which can enable multiple potential results for the $2^{nd}$ exercise parameter. Thus, both sessions for the example of FIG. 13 have incline values of zero % incline or horizontal/ flat run conditions along with run speeds values included for the corresponding exercise parameters for the Method 5050 for evaluating comparative equivalence.

Figure 14:
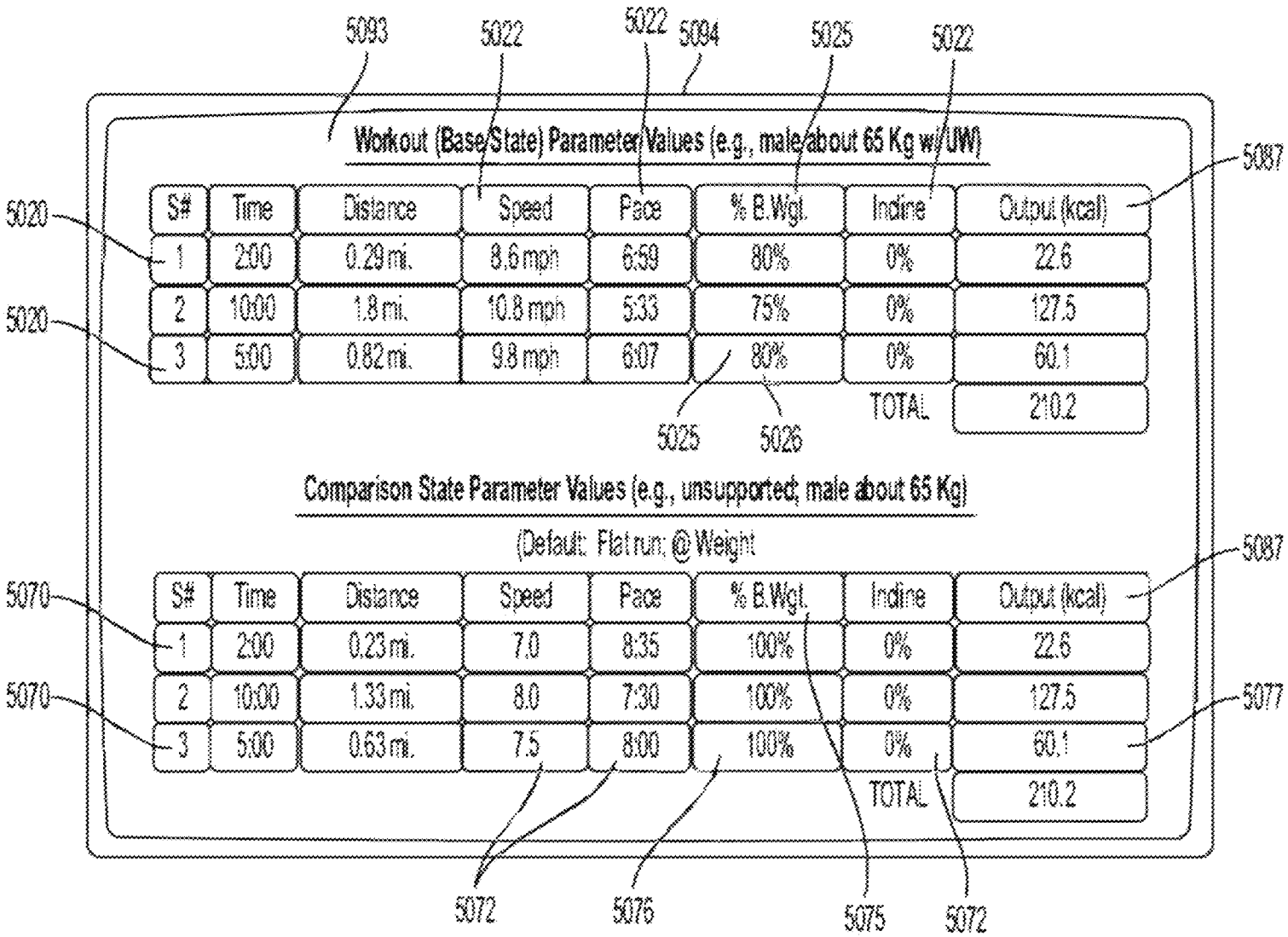

Continuing with FIG. 14 for the same example as FIG. 13, user interface 5094 depicts multiple comparative evaluations having been performed and/or in progress for setting up a multi-session workout involving the three exercise sessions 5020 shown for the MicroGravity system 3240 along with three comparative unsupported sessions 5070 evaluated with the MG sessions for evaluations of comparative equivalence according to Method 5050. As shown for the example user interface 5094, the exercise output 5087 (convened to kcal based on the bodyweight estimates) is the same for each of the MG sessions 5020 numbered 1 to 3 compared with each of the corresponding unsupported sessions 5070 numbered 1 to 3 consistent with the session outputs of exercise sessions for each evaluation of comparative equivalence being the same or substantially the same. Likewise, the Time or Duration for each of numbered sessions 1 to 3 matches the corresponding session for the MG sessions 5020 vs. the unsupported sessions 5070. As discussed above and along with FIG. 13, the Change Condition 5075 for these sessions is unweighting 5085 along with the Change Condition/Exercise Environment of using different exercise devices, such that the value 5076 for UW for the unsupported exercise sessions is 100% BW as shown.

Assuming session no, 3 corresponds with the interactions depicted on FIG. 13 as an example, a value 5026 for the unweighting Change Condition of unweighting 5025 can be provided to the Computer/Engine 5000/5001 as, for instance, 80% bodyweight, which can be provided for representing an unweighting of 20% applied to the user. Further, the speed exercise parameter 5072 can be provided, for instance, as 7.5 mph or a pace of 8:00 minutes per mile for the unsupported exercise session 5070. Based on the base selection speed (7.5 mph) in the environment of unsupported running and the unweighting of full bodyweight, the Computer/Engine 5000/5001 can determine an exercise session output such as an estimated $VO_2$ or METS value, which based on the estimated bodyweight of the user (65 kg/143 lbs.) and the 5.0 min, exercise period can be converted into an estimated energy output 5077 in kcals.

As discussed above along with the Equivalence Engine and FIG. 12, based on a value for incline remaining at 0% and the unweighting value for the MG session provided as 80% BW, an equivalent velocity or run speed for the MG session 5020 can be computed, such as 9.8 mph as shown on FIG. 14. Note that these calculations and specific values depicted in the drawings and discussed herein are merely example representations regarding inventive aspects, concepts and features for evaluating equivalence discussed herein. It is understood that calculation errors or discrepancies can exist or inadvertently be included with the drawings and detailed descriptions without detracting from the inventive aspects, concepts and features. Further it is understood that specific equivalence evaluation relationships, factors, calculations, algorithms, mechanisms and methodologies will likely continue to evolve and improve, which is contemplated for incorporating in and making use of for equivalence evaluations to the extent such changes and improvements are sufficiently validated and accurate. As such, the method 5050 for evaluating comparative equivalence and related equivalence evaluations described herein along with examples are not specifically limited to examples described herein or related metabolic relationships and methods depicted or described.

Note further that evaluations of comparative equivalent sessions implies maintaining equivalent exercise intensities. As such, a duration provided for the base selection of an exercise session is maintained for exercise sessions of a comparative group of Method 5050. If no set duration is provided, the base selection and other comparative sessions, as a default, can be evaluated using a common rate value with respect to duration, such as a per min. rate. Doing so allows for accurate comparisons between exercise output determinations of comparative sessions for the provided duration and/or based on rate comparisons, such as exercise outputs per min. for the associated exercise activities.

Figure 15:
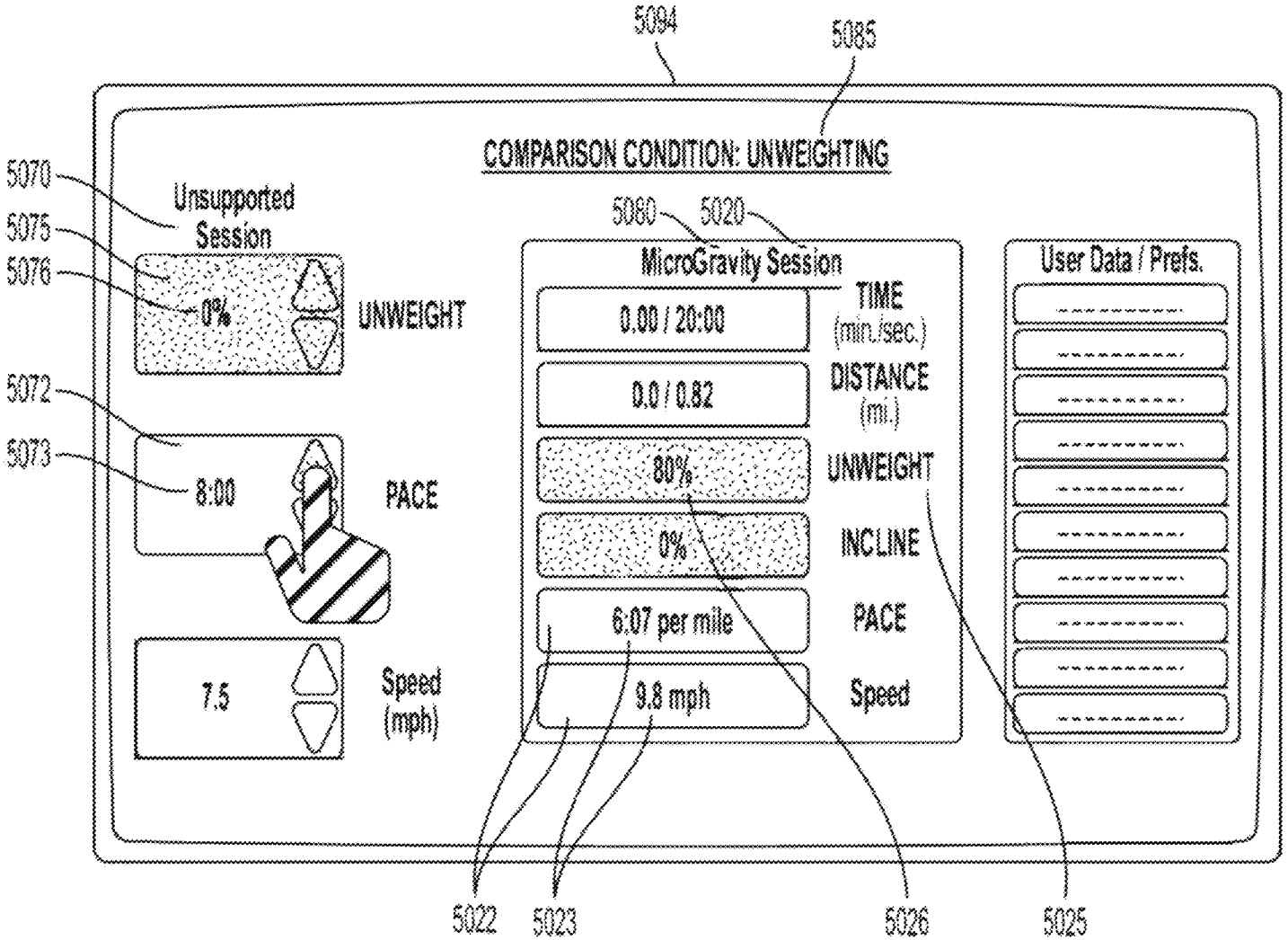

With specific reference to FIG. 15, an interface 5094 is shown for enabling the user or another person acting on the user's behalf to interact with Computer/Engine 5000/5001 and provide information pertaining to evaluating equivalence of comparative sessions and, in particular, for Method 5050, as well as for general control interactions with the Computer/Engine 5000/5001 for an impending or planned unweighted exercise session on the MG system 3240 and/or being provided with comparative equivalence information. Based on information entered as discussed above with FIG. 14 for an example equivalence evaluation described above, information for the MicroGravity Session 5020 is shown along with information for the Unsupported Session 5070 choses as the 'initial selection' for Method 5050. The user 5002 or user's agent can interact with the Computer/Engine 5000/5001 for entering or adjusting information related to the equivalence evaluation, such as adjusting or entering values 5073 for the exercise parameter (e.g., pace/run velocity) 5072 as depicted in FIG. 15. As further shown thereon, an unweighting value 5026 for the UW Change Condition 5025 of the MG session has been provided without the exercise session starting as of yet for the particular example scenario.

Note also that the values 5023 for the exercise parameter 5022 of the unweighted MG session 5020 are shown and provided to the user, which are outputs provided to the user for Method 5050 as equivalence values of run speed and incline considered equivalent with the base selection of the unsupported session 5020 that was initially selected and obtained based on the speed or pace values for the exercise parameters 5072 of the unsupported session, environment conditions thereof as an off-Tm run, having a duration provided as 20 mins, and/or considered on a per min. basis, and unweighting of each exercise session that includes full bodyweight for the unsupported session and 80% BW for the MG session 5020.

Figure 16B:
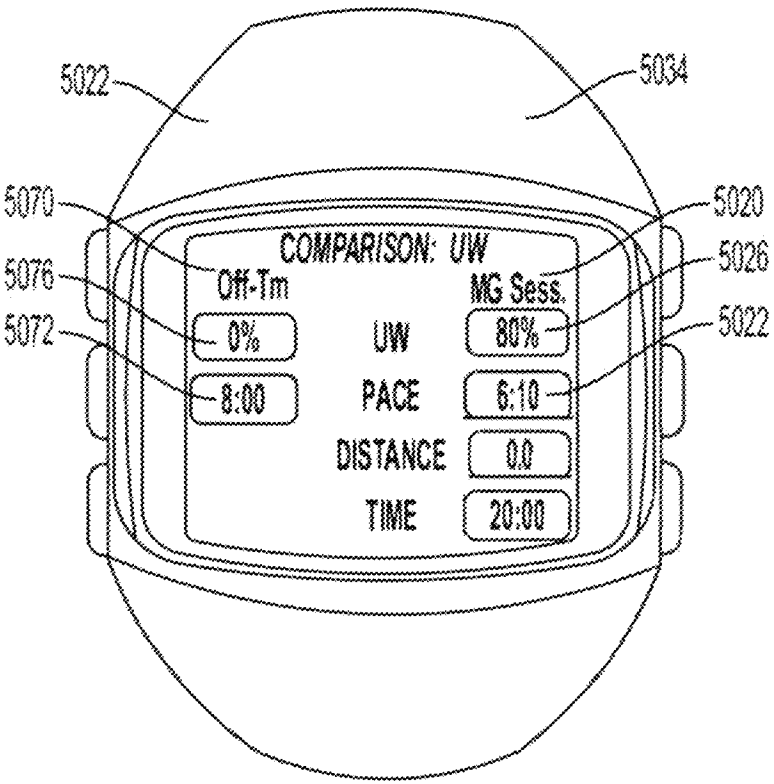
FIG. 16B is a plan view of an example wrist device of FIG. 11A and an example schematic representation of an interface with the computer control system of FIG. 10 for the comparative equivalence method of FIG. 8.
Figure 16A:
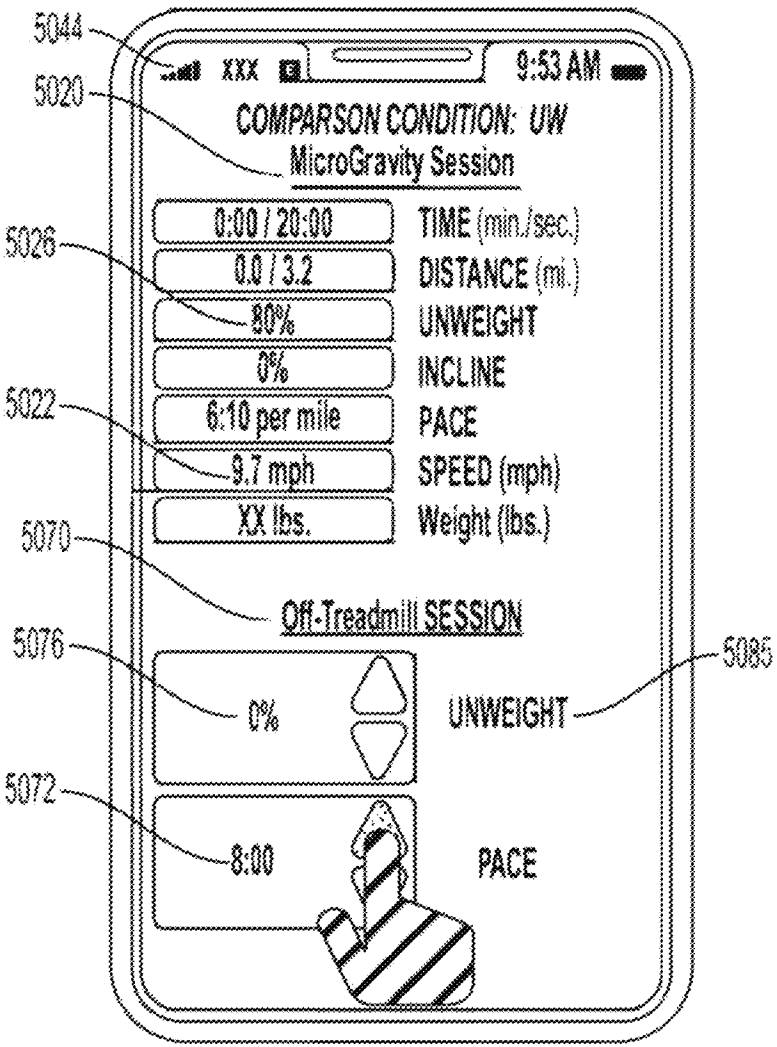
FIG. 16A is a plan view of an example mobile device of FIG. 11A and an example schematic representation of an interface with the computer control system of FIG. 10 for the comparative equivalence method of FIG. 8.

With particular reference to FIGS. 16A & 16B, additional interfaces 5044 & 5024 are shown, which include interface 5044 on a mobile device, such as a mobile device for the user as identified in FIG. 11A and an interface 5024 for a user-worn device, such as a watch adapted for communicating with the mobile device and/or directly with Computer/Engine 5000/5001 and other devices using wireless communications, interfaces 5044 & 5024 can be used for interacting with the Computer/Engine 5000/5001 for actions and information related to 5050, as well as for other interactions and operations of the MG system 3240. Optionally, interfaces 5044 & 5024 can operate as primary interfaces with the Computer/Engine 5000/5001 for Method 5050, as alternative or secondary interfaces, and/or as primary or parallel information exchanges for providing equivalence information to the user and providing information to the user or support entity. As shown, each interface 5044 & 5024 can display and provide similar equivalence-related information and enable similar interface functionality as described along with FIG. 15.

Figure 17:
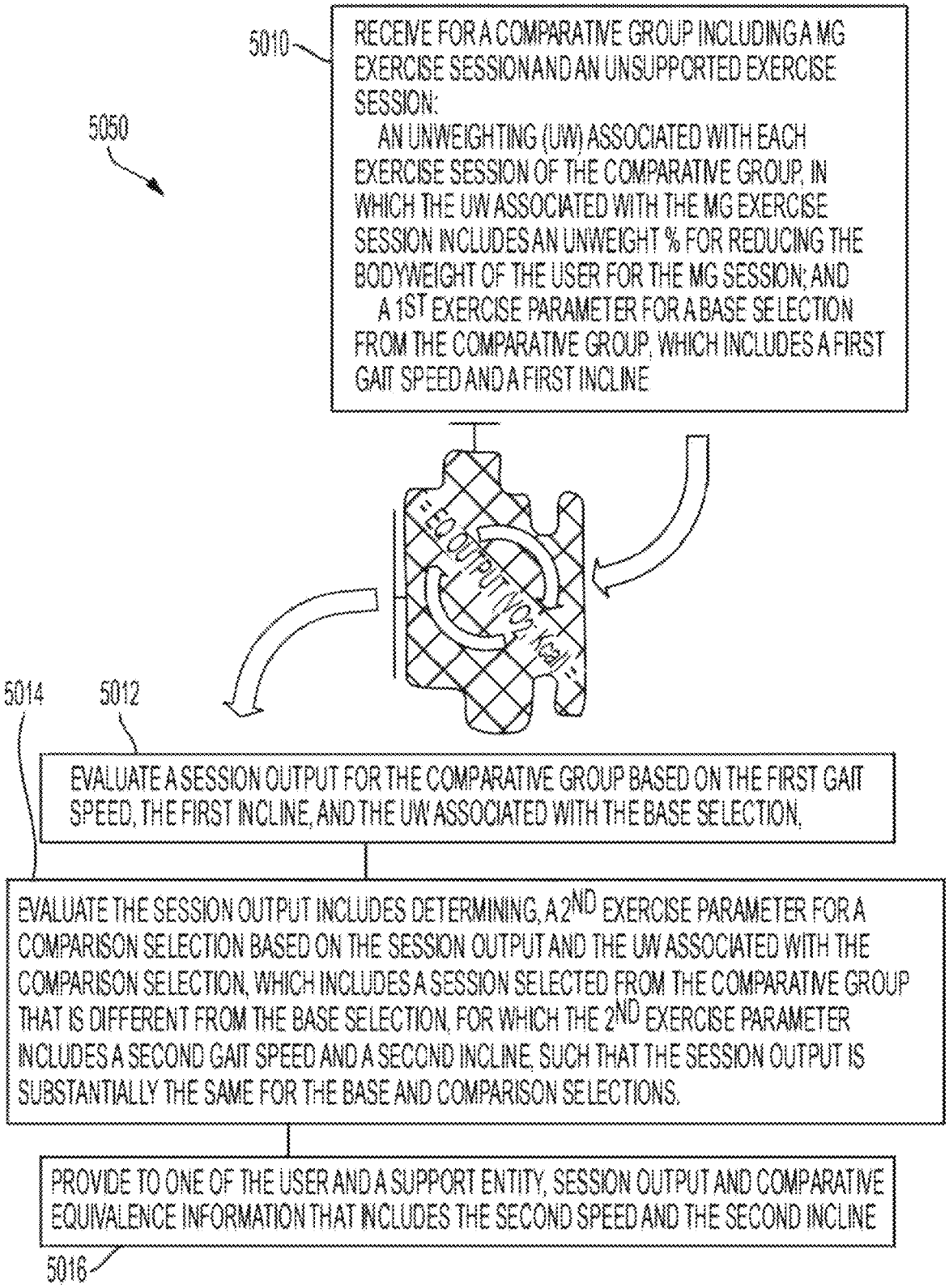
FIG. 17 schematically depicts actions for evaluating comparative equivalence between multiple exercise sessions including an unweighted exercise session and a non-unweighted unsupported exercise system, by a computing device, such as the computer control system described along with FIG. 10 for the comparative equivalence method of FIG. 8 and/or other computing device in accordance with inventive aspects, concepts and features described herein.

With particular reference to FIG. 17, actions performed by the Computer/Engine 5000/5001 for Method 5050 are schematically depicted. These actions include Action 5010 for receiving for a comparative group that includes an MG exercise Session and an unsupported exercise session (on or off treadmill): An unweighting (UW) associated with each exercise session of the comparative group, in which the UW associated with the MG exercise session includes an unweight % for reducing the bodyweight of the user for the MG Exercise session; and a $1^{st}$ exercise parameter for a base selection from the comparative group (MicroGravity or unsupported), in which the $1^{st}$ exercise parameter includes a first run speed and a first incline. The Method 5050 further includes Action 5012 for evaluating a session output for the comparative group based on the first run speed, the first incline, and the UW associated with the base selection.

As an example for discussion purposes, Action 5012 for evaluating the session output for the comparative group can include the computer/equivalence engine 5000/5001 using normalized relationships such as the ACSM relationships discussed above along with FIG. 12 for evaluating the session output for the comparative group. The examples and descriptions regarding ACSM relationships, METS, adjustment based on a TM Factor, and modification based on an UW Factor discussed above can be used for performing Action 5012 using, for instance, sample values provided and discussed along with FIGS. 13 to 16B. As such, a METS value can be determined using the run velocity for the $1^{st}$ exercise parameter (e.g., 7.5 mph or 8:00 per mile) and the example MET (Run) Output Unsupported relationship depicted on FIG. 12. As such, a session output in the form of a normalized, METS output can be assessed via the ACSM run relationship by converting the $1^{st}$ exercise parameter value 7.5 mph to meters/second by multiplying 7.5 miles/hour by 26.8 (1609.34 meters/mile/60 minutes per hour) and multiplying the resultant run velocity by 0.2 per the ACSM run relationship, adding 3.5 to the result, and dividing the sum by the resting $VO_2$ rate to obtain a preliminary METS output. The normalized preliminary METS output rate can be adjusted for exercise output using the MG treadmill to obtain a METS rate of about 11.13 per kg per min. as an output based on the base selection, the corresponding duration (20 min.) or as a per/min, rate for consideration via normalized relationships and METS values, and the UW (e.g., full bodyweight) of the base selection. Note that the base selection includes an unsupported Off-Tm flat run, such that the gradient or incline % is zero for the ACSM relationship.

The Action 5012 of Method 5050 for evaluating the session output for the comparative group includes an Action 5014 for determining, a $2^{nd}$ exercise parameter for a comparison selection based on the session output and the UW associated with the comparison selection, for which the comparison selection includes an exercise session selected from the comparative group that is different from the base selection, and the $2^{nd}$ exercise parameter includes a second run speed and a second incline. For the present scenario and example, a run rate or velocity can be reverse calculated using the same ACSM run relationship after applying a UW Factor according to the value for the unweighting, which for the present scenario is 80% BW and the UW Factor result is 0.69966. The output determined for the base selection can be divided by the UW Factor and multiplied by the resting metabolic rate of 3.5, from which the value of 3.5 of the ACSM relationship can be subtracted and the result divided by the 0.2 multiplier of the ACSM relationship to yield a run velocity value in meters per min. As for the conversion described above for determining the exercise output, the resultant velocity in meters per minute can now be divided by 26.8 to yield a run velocity in miles per hour (9.8 mph for the example scenario) that can be used as a comparative run rate setting for the MG session 5020.

Optionally, the value 5023 (see e.g., FIG. 15) determined for the $2^{nd}$ parameter of the comparison selection (MG exercise parameter) as the second run speed can be verified as a confidence check against validated run tables or precalculated comparison data obtained or stored by the Computer/Engine 5000/5001 and/or via other methods or verification methodologies, such as via linear regression equations for the UW of the comparison selection. Method 5050 continues with Action 5016 of providing, to one of the user and a support entity, the session output and comparative equivalence information including the second speed (e.g., 9.8 mph) and the second incline (zero %), which for instance can be via the interface 5094 of FIG. 15, the interfaces 5044 and/or 5024 of FIGS. 16A & 168, and/or other appropriate option according to user and/or system preferences. Such options can include, for instance, communicating with the computer 5095 discussed along with FIG. 11A as being a user-accessible computer or sending the information to a storage location identified by or accessible to the user.

Note that optionally, comparative equivalence information can be provided to the user or support entity without providing session output information, for which an estimated or measured bodyweight for the user can be required for determining and providing a particular session output value. Whereas, as discussed along with FIG. 12, mechanisms and actions for evaluating comparative equivalence can be performed independent of the user's bodyweight. As such, evaluations of comparative equivalence can be performed without providing specific session output information to the user or support entity. However, information for session output can be considered as part of evaluating comparative equivalence as discussed along with FIG. 12 using normalized relationships such as METS values and, optionally, involving the user of linear regression relationships or chart or table information that likewise can be independent of bodyweight and based on evaluating session output for the related exercise sessions. As such, providing comparative equivalence information including run speed and incline for the comparison selection includes providing session output information.

Equivalence Engine Example Metrics-Multiple Unweighted Exercise Parameters

Figure 18:
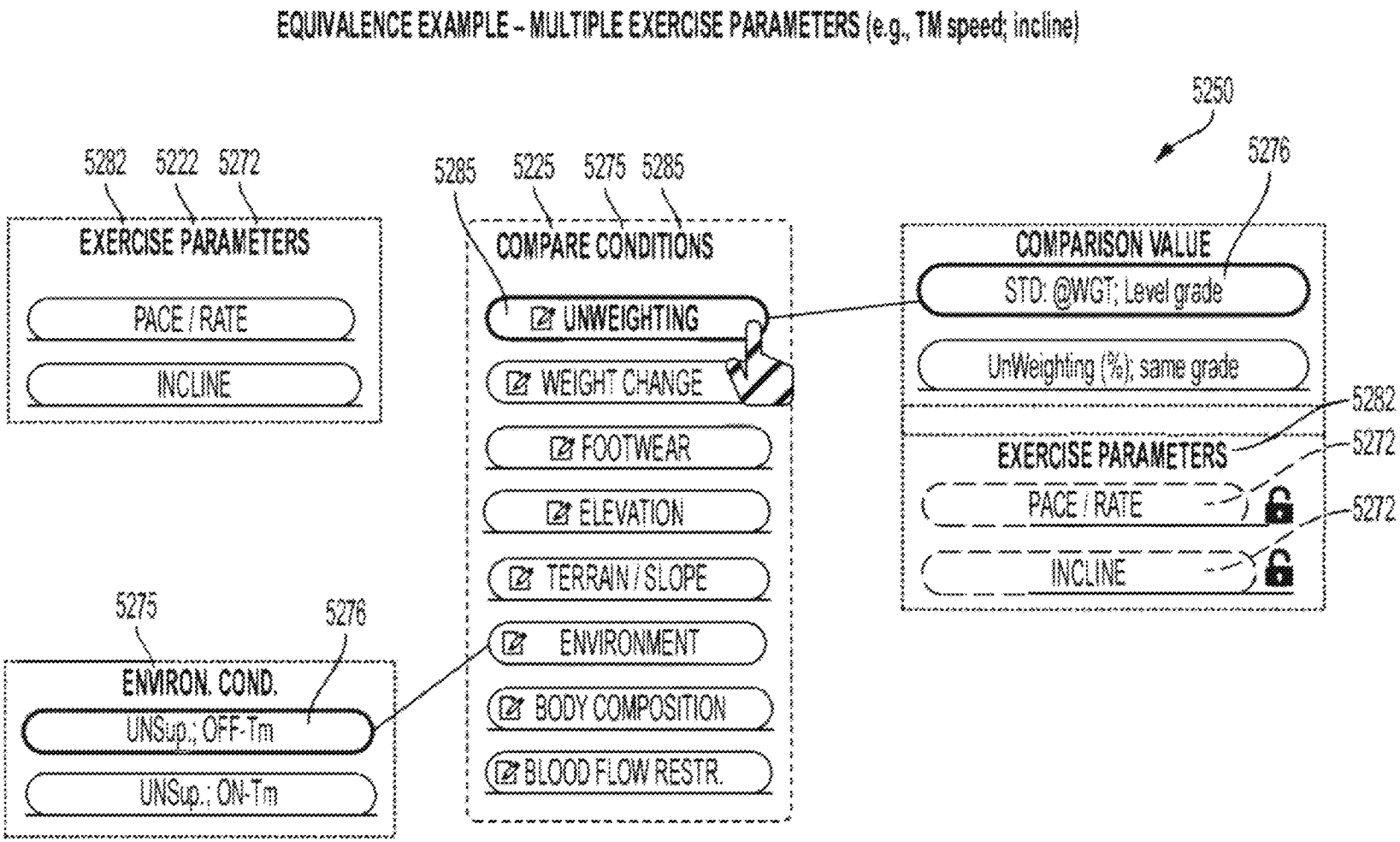
FIG. 18 is a further example schematic representation of actions of the equivalence engine of the computer control system of FIG. 10 for a further method of evaluating comparative equivalence between an unsupported treadmill exercise session and an MG exercise session according to aspect, concepts and features described herein.
Figure 19:
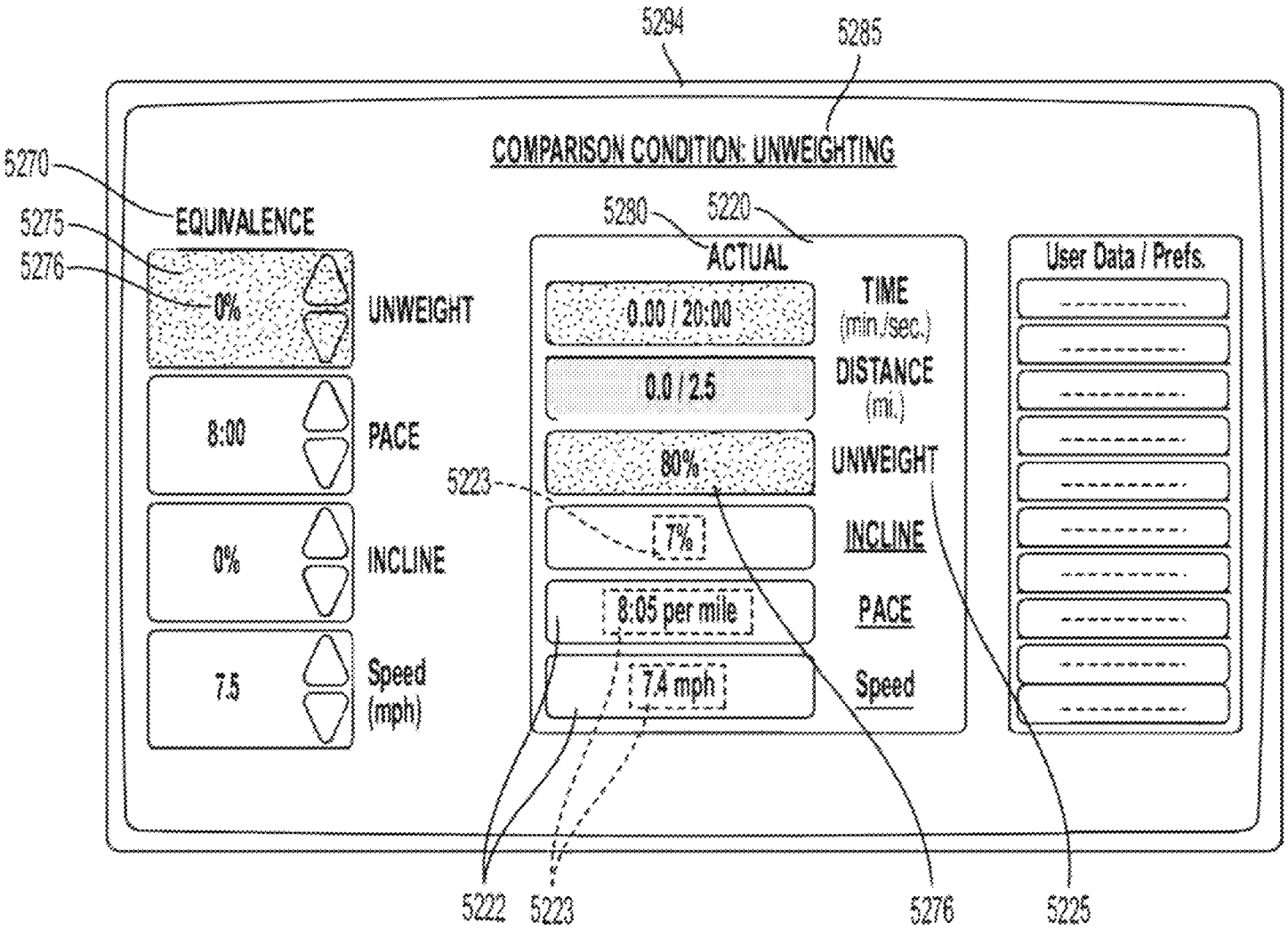
FIGS. 19 and 20 are additional example schematic representations of an interface for the equivalence engine and the computer control system of FIG. 10 for the comparative equivalence method of FIG. 18.

Referring now to FIGS. 18 & 19, a further Method 5250 for evaluating equivalence of comparative exercises sessions is shown, which generally includes the aspects, concepts and features described above along with Method 5050 except as described hereafter. Accordingly, like numbers refer to like features.

With particular reference to FIG. 18. Method 5250 primarily differs from Method 5050 in that the exercise parameter 5272 for the unsupported exercise session 5270 includes a run velocity 3072 and am incline or gradient 5272, for which values 5273 can be provided to the Computer/Engine 5000/5001. Continuing the same example and scenario for discussion purposes used above along with Method 5050, assume that the unsupported exercise session 5070 was selected for the base selection and that an Off-Tm environment was similarly selected. As such, the off-Tm exercise session includes a flat run that is often the case for most off-Tm runs especially for comparative equivalence evaluations, the associated unweighting for the Off-Tm un as full bodyweight or at the user's bodyweight, and the MG exercise session 5220 includes an unweighted session having an unweighting equivalent to a value of 80% BW.

Note that FIG. 18 depicts 'lock' and 'unlock' symbols indicating that certain compare conditions, exercise parameters and other exercise output factors and options pertaining to evaluating comparative equivalence for sessions can be locked and excluded from equivalence evaluations based on user or system preferences, exercise or activity restrictions for the user, functional limitations of the MG system 3240 during such interactions with the Computer/Engine 5000/5001, and/or many other reasons. Further, it can be helpful during initial considerations and usage of equivalence evaluation functionality to restrict a range of adjustable options and considerations for evaluating equivalence as a user or support entity becomes acquainted with the functionality and wide range of applicable benefits that can be gained through use of the comparative information as a tool for the user and related unweighted exercise sessions.

For example, expanding such functionality for evaluating multiple compare/change conditions and additional exercise sessions within the comparative group, as well as comparative evaluations involving additional exercise parameters like belt resistance/braking and the like, can quickly become complex or unwieldly for the user or support entity, and/or provide comparative equivalence information that can be misunderstood or misapplied by the user and/or support entity. Such expanded usage can include evaluations involving significantly increased numbers of variables and considerations, which can diminish significant benefits that can be gained through usage of comparative evaluation information as tool for fine-tuning or adjusting unweighting sessions for the user.

For example, unrestricted equivalence evaluations using, for example, extremely high or low unweighting values (e.g., 90% bodyweight or greater, 10% or less unweighting support; 50% bodyweight or less, 50% or more unweighting support) and/or run velocities alone or in combination with incline values at or near system limits can result in equivalence information being provided to the user that can be unsafe or that poses high risk for the user to attempt either on the MG system 3240, Off-Tm and/or on a traditional treadmill exercise device. Likewise, enabling evaluations for additional compare conditions like modified elevations, changes in body composition, or weight loss or gain can provide unsafe or risky equivalence information for the user to attempt or provide for another person to pursue.

As shown on FIG. 18, both exercise parameters 5272 for the base selection of the unsupported Off-Tm session 5270 are shown as 'unlocked' for the user. The use of both run velocity and incline or gradient in combination have long been fundamental components for evaluating run exercise output and providing significant control or adjustment flexibility to the user for such exercise options. The velocity component (run velocity times 0.2) is considered the horizontal component of the ACSM metabolic relationship and the gradient or incline component is considered the vertical component. Significant flexibility for exercise output and run features, such as gait, stride length and stride frequency, can be gained through the use of both parameters when evaluating and considering exercise sessions, which of course are typically controllable for sessions performed on a traditional treadmill and on an AG-type system.

Further, both run velocity and gradient or incline have long been included as factors for evaluating metabolic exercise output of a run exercise session, which is included in the ACSM relationship discussed above, predecessor metabolic formulas and relationships, and many other options and considerations for evaluating exercise output and adjusting the same for running. However, combination evaluations for both run velocity and gradient or incline have largely been ignored for proposed solutions discussed in the BACKGROUND including various studies, research, and evaluations of MicroGravity-type systems and corresponding exercise output.

The inventors have evaluated and line-tuned ACSM-based relationships for use with unweighted MicroGravity systems and exercise sessions such that exercise output calculations can accurately be performed within reasonable limits for most users and comparative evaluations including for a reasonable range of run velocities and unweighting values typically used for most unweighted exercise sessions including unweightings from about 60% BW to about 90% BW. The use of such validated relationships along with incorporating fundamental ACSM metabolic relationships allows for evaluations of both run velocity and gradient or incline for comparative session evaluations and for allowing flexibility for considering multiple comparative equivalence options based on multiple combinations of equivalent exercise parameters for run speed and incline having substantially similar exercise session outputs, such as for graded exercise therapy and planning.

Accordingly, FIG. 18 includes both run velocity and incline as exercise parameters 5272 for evaluations of equivalence between unsupported and unweighted exercise sessions. Continuing with the previous scenario and example, the exercise output can be determined the same as above for the base selection of an Off-Tm run exercise session, which, included the example value of 7.5 mph or 800 minutes per mile as run velocity or pace values. As such, the Action 5014 of Method 5050 discussed above along with FIG. 17 and applied to Method 5250 can include determining the $2^{nd}$ exercise parameter for the comparison selection & duration based on the unweighted exercise environment for the MG session 5220 of unweighting at 80% BW for equivalent combinations of run velocity and incline that meet the exercise session output evaluated for the Off-Tm exercise session 5270.

Note that gradient or Incline values are assessed under the ACSM base relationship according to Incline %, which represents rise over run increments for uphill angles of the treadmill surface. Thus, a 1% incline represents a vertical increase of 1 cm (rise) with respect to a horizontal distance for the treadmill base or fully vertical treadmill surface condition of 100 cm. As such, a 1% incline corresponds with a small angle of only 0.573 degrees, a 5% incline corresponds with an angle of 2.86 degrees, and a 10% incline with an angle of 5.71 degrees. Many treadmills adjust incline % in 1% increments, which can limit options for evaluating incline along with run velocity for equivalence evaluations.

Further, initial incline increases in the range of about 1% to 3% are noticeably small and likewise appear to have minimal impact on exercise output according to various studies, observations, and under the ACSM exercise output relationships. However, greater incline values of about 5% to 10% or more can have significant impact on exercise output, observed exertion affects, and for exercise output relationships including ACSM relationships. As such, w accordance with Method 5250 and aspect, concepts and features discussed herein pertaining to evaluating equivalence between comparative exercise sessions including for unweighted MicroGravity sessions, both run velocity and incline can be considered for determining equivalence of an unweighted exercise session 5220 with an unsupported exercise session 5270.

With particular reference to FIG. 19, an interface 5294 is shown that is similar to the interface 5094 depicted and discussed along with FIG. 15 except as discussed herein. As such, like numbers refer to like features. Interface 5294 primarily differs from interface 5094 in that equivalence values have been calculated and provided to the user via interface 5294 for both run velocity or pace 5223 and for incline 5223 as an incline % (e.g., 7% shown in FIG. 19 along with a speed or rate of 7.4 mph). When performing reverse calculations for determining equivalence velocity values in combination with incline values, iterative calculations can be performed for identifying a combination of incline % with run velocity that best matches the exercise output determined for the base selection, and/or for providing multiple combinations to the user and/or support entity. This because, even though each 1% incline value represents a relatively small angle, the 0.9*v*G portion of the ACSM relationship involving incline impacts the reverse determinations in a stepwise manner for each 1% incline that can be applied as a setting for the MG system 3240, which have increasing significance and cumulative impact as the incline % increases.

As such, an overlapping range of velocity values are often available for consideration and/or line-tuning reverse calculations determinations to best meet an exercise session output for each incline % value, for which for most treadmills and MicroGravity systems have a range from 0% up to 15% incline. This can allow for multiple output options of equivalence values based on incline % and run velocity combinations. Further, overlapping equivalence options typically exist for ranges of unweighting values, such as unweighting at 75% or even 70% instead of the provided 80% for equivalence values. Of course, if hard initial selection preferences or instructions are provided or preset, such as indicating the unweighting value must be at 80% BW vs. for instance +/−5%, then the calculations for the $2^{nd}$ exercise parameter can be more restricted, but nonetheless can likely include multiple options for best meeting equivalence with the session output evaluated based on the base selection.

Note that the example of FIG. 19 includes a run velocity value of 7.4 mph that only differs from the unsupported run velocity provided as 7.5 mph by 0.1 mph. Note further that the equivalence incline % provided to the user for the unweighted session is at 7%, which is about 4% beyond the 1.3% range noted above as typically having minimal impact on exercise output & intensity and at a mid-range for available incline settings of most treadmills including AG-type treadmills. A preference for performing evaluations of comparative sessions according to Method 525) and related methods and considerations described herein can include weighting equivalence options according to preferences of the system or user and/or in accordance with best practices for optimizing results and exercise performance.

Thus, an example weighting can include identifying the incline value and velocity value combination closest to or most accurately matching the exercise output determination based on the base selection. Another example weighting, which is represented along with FIG. 19 for the example scenario for "weighted to maintain run characteristics," can include iterative actions for attempting to match the equivalence run velocity value to the base selection run velocity and identifying 'best match' or 'best lit' resultant combinations of run velocity and incline, as well as for attempting to keep the incline % close to mid-range values or other user or system preferences for weighting potential comparative equivalence options.

In addition, studies have shown that run characteristics of each person can vary significantly based on run velocity increases and decreases, such that the more a person increases or decreases run velocity compared with typical run speeds for the user, the more significantly characteristics like gait, stride length and stride frequency change. Studies have further shown that unweighting can affect run characteristics including increasing stride length and reducing stride frequency as the unweighting amount increases. In addition, studies have shown that incline % and uphill running can have minimal impacts on run characteristics and exercise output for relatively small increases and even for incline % values approaching the mid-range of incline adjustments. As such, strategies for weighting incline % and velocity combinations for equivalence evaluations can include attempting to match or slightly increase or decrease a run velocity value for an equivalence determination vs. a run velocity value for a base selection as is appropriate for the user and related run performance concerns or observations.

Evaluation Flexibility, Automatic Default Options, Multi-Session Workouts & Plans Referring now to FIGS. 20 to 25, additional interface examples are shown as schematic depictions of various additional features pertaining to methods for evaluating comparative equivalence between exercise sessions including an unweighted exercise session and an unsupported On or Off-Tm exercise session according to aspects, concepts and features described herein, as well as for exercise system controls, computer operations and actions including interactions with the Computer 5000/5001 pertaining to equivalence evaluations. The interfaces of FIGS. 20 to 25 generally includes the same aspects, concepts and features describe previously including along with interfaces 5094, 5044, 5024 and 5194 except as discussed hereafter. As such, like numbers refer to like features.

Figure 20:
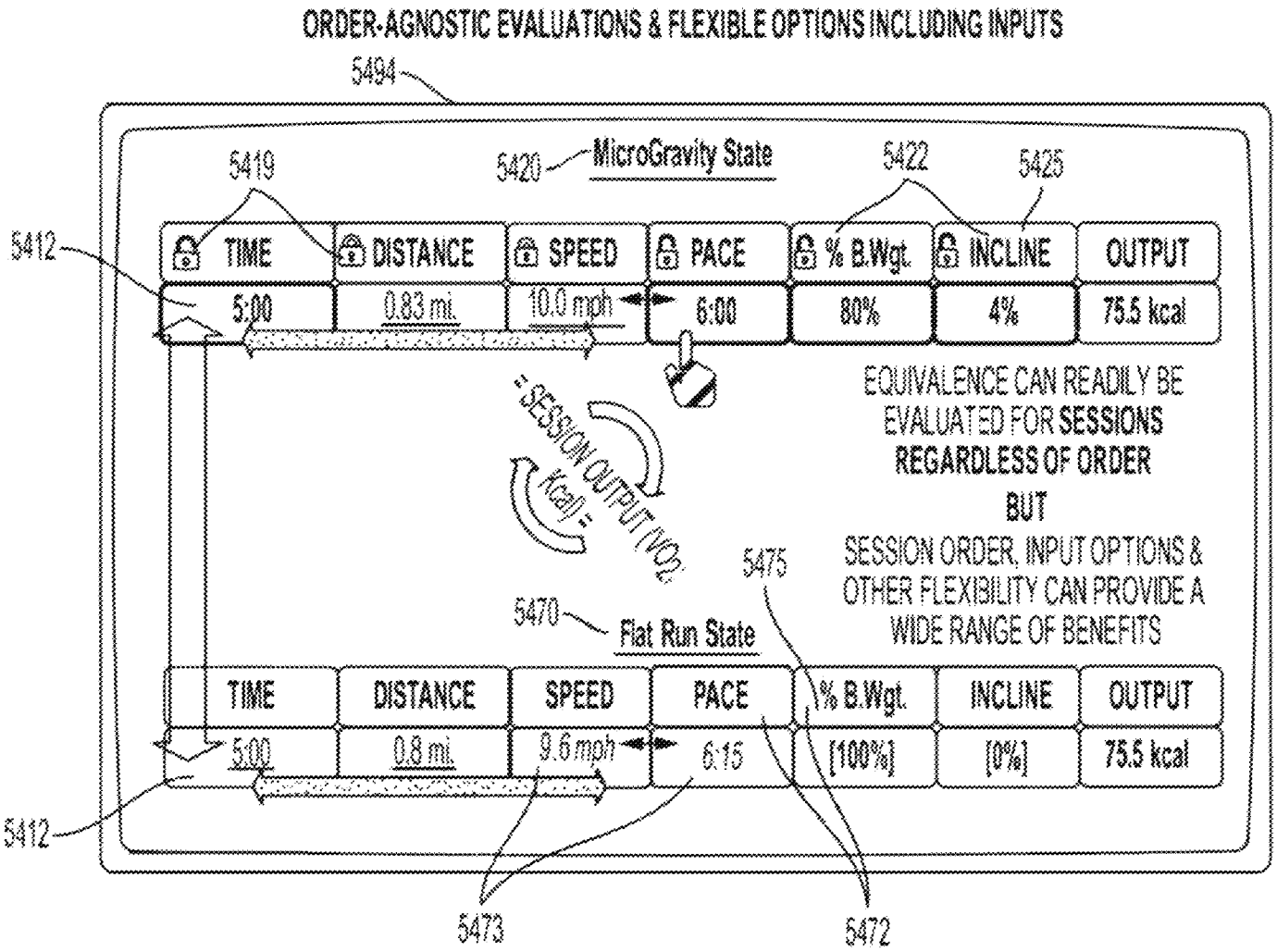

With particular reference to FIG. 20, an interface 5494 is shown for a method 5450 for evaluating equivalence between exercise sessions 5280 including an unweighted MicroGravity session 5420 and an unsupported run session 5270, which depicts various beneficial aspects and features related to exercise equivalence evaluations, flexibility for performing such evaluations, and interface usage and flexibility. In particular, the interface 5494 and related Method 5450 of FIG. 20 identifies information and inputs provided to the Computer/Engine 5000/5001 for evaluating equivalence between comparative sessions VS information automatically determined by the Computer/Engine based on functionality VS Outputs or Results of EQ evaluations.

As a preliminary example for demonstrating reversibility or order-agnostic aspects pertaining to the equivalence evaluation methods described herein, an example scenario corresponding with FIG. 20 includes a base selection between an unweighted MG session 5420 and an unsupported run session 5470 that differs from earlier examples. Method 5450 and example scenarios shown in FIG. 20 provide an opposite example scenario in that the MG session 5420 is identified as the base selection, such that equivalence including exercise parameters 5472 are calculated and provided to the user for the unsupported run session 5470 based on initial unweighted session information and parameters. As such, reversibility regarding session order is described and demonstrated via the corresponding example.

For the example scenario of FIG. 20, assume the Computer/Engine 5000/5001 has received a selection identifying the MG session 5420 as a base selection for a corresponding evaluation of comparative equivalence between at least an unweighted, MG exercise session 5420 and an unsupported exercise session 5470, an Exercise Environment for each session including identifying the MG session 5420 as unweighted and the unsupported session 5470 as an Off-Tm Flat Run continuing with the previous scenario without having incline options for the unsupported session for simplified description purposes, and further UW for each session including identifying 80% BW for the MicroGravity session 5420 and by virtue of a designation as unsupported, 100% BW as unweighting for the unsupported exercise session 5470. Further, assume a 1$^{st}$ exercise parameter has been received that includes a value for a pace setting 5423 and an incline setting 5423 as the 1$^{st}$ exercise parameter.

TIME/DURATION—As discussed along with FIG. 9A and as used herein, an exercise session refers to a period (duration or rate) of user activity according to an exercise parameter that is performed at a value(s) or setting(s) that directly affect(s) user exercise output (e.g., $VO_2$, METS or Kcal). Identification of a set duration or rate, or consideration of rate as a default time metric as an option discussed above, maintains intensity for the comparative sessions by setting an exercise output for the sessions that is the same, or substantially the same, for each or for a set of multiple sessions per unit time, duration, or as a default on a rate basis of per min.

Stated differently, extending a time period for one of the exercise sessions, such as setting a time for the unsupported exercise session 5470 shown in FIG. 20 as 10:00 or even 20:00 for instance while maintaining an initial 5:00 duration for the MG session 5420 can destroy equivalence between the comparative sessions at least for purposes of evaluating equivalence in accordance with Method 5450. An intensity level associated with performing the MG exercise session for the specified 5:00 minutes duration of the exercise output and session would not be maintained for the unsupported exercise session 5470 if evaluated to have the same exercise output over a greater period of time. The same exercise output over twice the period length as the MG session, for instance, clearly would not be considered as a comparative equivalent exercise output. A double headed vertical arrow between the entries for Time 5412 for each session of FIG. 20 indicates shared entry of the Duration or Rate received to each comparative session of the evaluation for ensuring consideration of the appropriate time component between exercise sessions.

As discussed along with one or more examples hereafter, time or duration adjustments between the comparative sessions can be an option based on user preferences and evaluation goals after sufficient completion of the evaluation for comparative equivalence purposes, such that exercise output and intensity between the comparative sessions is maintained for evaluation purposes. Accordingly, assume that a time 5412 of "5:00" as shown in FIG. 20 has further been received by the Computer/Engine 5000/5001. Upon receipt of the base selection identifying one of the unweighted MG session 5420 and the unsupported session 5470 as a base selection, the Computer/Engine 5000/5001 can perform an optional action of Limiting 5413 input options for providing the 1$^{st}$ exercise parameter 5422.

As an example depicted in FIG. 20, one or more categories pertaining to information for the exercise session identified as the base selection can selectively be "locked" or designated as "unlocked" for input purposes as represented by the open and closed locks' 5419. The action of Limiting can include electing categories to lock or designate as unlocked, which can be chosen, identified or controlled based on user or system preferences. For instance, a user or associated professional can identify a preference for primarily evaluating and monitoring run pace or"pace" as the primary speed input and output for purposes of run velocity that can assist with avoiding confusion between treadmill settings for speed vs. actual speed values or for other reasons such as maintaining focus for the user/runner on a desired pace for runs.

As such, user input for "Speed" as shown can be locked for input purposes regarding the MicroGravity exercise session. Computer/Engine 5000/5001 can automatically perform standard conversion functions to convert a pace value 5423, such as minutes per mile or minutes per kilometer, to run velocity in meters/min, or other value depending on exercise output determination metrics and preferences. In particular, Computer/Engine 5000/5001 can readily and automatically convert rate information provided as minutes: second per distance to a minutes decimal equivalent. Thereafter, the decimal pace can be divided by 60 to obtain distance/hr. Further, multiplying 60 minutes/hour×I/pace in minutes per unit distance (e.g., mile) can convert pace to unit distance (miles or km) per hour.

Values for each of the exercise sessions 5420 & 5470 shown in bold alone in FIG. 20 represent values directly received or provided as inputs, and <u>underline</u> values represent those that have been determined automatically by the Computer/Engine 5000/5001 according to its basic conversion functionality. Further, entries in [brackets] & bold denote values designated as automatic defaults for a particular session type or environment like [100%] meaning 100% of bodyweight as a default UW of the unsupported session 5470. Information shown in increased font & italics for FIG. 20 denote values provided as comparative equivalence information to the user from the equivalence evaluation (or a resultant conversion such as for converting a Speed result (9.6 mph) to a corresponding pace value (6:15) or vice versa).

Thus, FIG. 20 depicts an example opposite scenario from those of Method 4950, 5050 and 5250 in that the MicroGravity session 5420 is identified as the base selection and, thus, 1$^{st}$ parameter values of pace (6:00) and incline % value (4%) denoted in bold are received as input values along with an unweighting amount or value 2486 (80% BW) and the value for duration or rate (5:00) 5412. Note that "speed" and "distance" values for the MG session 5424) are presented as underlined for identifying each as having been automatically determined according to basic session functionality.

As discussed above at the outset for describing FIG. 20, a "time" for the exercise session is specifically identified and implied based on the term "exercise session" for equivalence evaluation methods as referring to a "period (duration or rate)" of user activity for the exercise parameter of the session. Distance is thereby also implied and can be determined via default conversion or rather derivation functionality, such distance/time relationships and speed or pace for each session, which as shown includes 0.83 mi. on the MG system 3240 and 0.76 mi, for the unsupported flat run 5470. The double arrows across Time, Distance and Speed for each of the exercise sessions 5420 & 5470 further identifies default session functionality for determining a missing value for any of the related items based on receiving or calculating one of the three. More accurately, default system functionality for related missing features also applies to pace that is automatically derivable from speed if not received or calculated as for the present scenario.

Specific values for the unweighting of the unsupported session 5470 and an incline as a potential exercise parameter for the unsupported session are each identified as being 'default-blocked' for user input via the [brackets] and bold designations shown in FIG. 20, which for the present scenario and example are depicted respectively as [100%] and [0%], The action of Limiting 5413 discussed above can also apply for the comparison selection in response to the Computer/Engine 5000/5001 having received the base selection for the MG exercise session, which implies that can and should include information for all comparative exercise sessions for the evaluation, after which the action of Limiting 5413 can further include setting a default-block condition for default conditions that block user input, such as for UW and incline values for the unsupported session 5470.

The initial action of Limiting and/or the further action of Limiting 5415 for the remaining session can include automatically designating features related to unweighting and incline for the remaining session (unsupported in this scenario) as 'default-blocked' as shown in FIG. 20 meaning that based on exercise environment information received for the remaining session, values for these exercise output factors or parameters are set to corresponding default values without permitting modifications. For instance, receipt of the selection of the unsupported exercise session 5470 as the comparison selection along with an exercise environment identifying the sessions as an Off-Tm, flat run exercise session can trigger designations of default values associated with the session along with blocking changes for corresponding designations, such as designating the default unweighting as [100% BW] for the session and the incline as [0%] according to environment limitations.

The value(s) 3473 shown for "Speed" & "Pace" can include equivalence results provided by the Computer/Engine 5000/5001 for the unsupported exercise session 5470, which becomes the comparison selection between the two sessions along with at least one of the values being provided to the user as an equivalence result for Method 5450. For instance, continuing with Action 5412 (identified as Action 5012 on FIG. 17) an exercise session output can be determined for the MicroGravity session 5420 based on the $1^{st}$ exercise parameter (received as 6:00 pace that is equal to 10 mph or 268 m/s & based on an incline of 4% or 0.04 for use when evaluating the ACMS relationship session output), the exercise environment as 'unweighted' for the MG System treadmill, and the associated UW % of 80% BW. The exercise session output for the MicroGravity session 5420 can thereby be determined as discussed above using, for instance, metabolic relationships shown and described above along with FIG. 12 including the ACSM run formula evaluated using the velocity value of 268 m/s and the gradient or incline percentage as 0.04 along with applying appropriate UW and Tm Factors using the UW of 80% BW and adjustments, it any, related to use of an MG treadmill for the session.

Action 5414 can continue thereafter including determining the $2^{nd}$ exercise parameter based on the UW for the comparison selection, such as reverse computing the run velocity for the unsupported exercise session 5470 based on the same exercise output & the common duration or rate along with information received for the exercise environment being an Off-Tm exercise session according to similar descriptions for Methods 5050 and 5250, but without evaluating unweighting effects of the comparison selection for the unsupported session 5470, for which the exercise session output is evaluated for the full bodyweight of the user. Method 5450 can continue with the Action 5416 of providing to one of the user and a support entity the exercise output and the $2^{nd}$ exercise parameter 5472, which is depicted on FIG. 20 as "9.6 mph" (equal to the 6:15 pace shown without incline). The exercise output for each exercise session is depicted in FIG. 20 as an energy conversion of the exercise output (same, set equal) in kcals, according to an estimated bodyweight for the user obtained by the Computer/Engine 5000/5001 and the duration or time value of 5:00 mins.

Thus, example descriptions pertaining to the schematic representations and example depictions of FIG. 20 demonstrate significant flexibility for the application and use of equivalence evaluations according to inventive aspects, concepts and features described herein including reversibility and significant flexibility regarding an order for evaluating one or more comparative exercise sessions that include an unweighted session and an unsupported session with other sessions. Such flexibility can enable many different beneficial features and uses for comparative equivalence evaluations of the OAP session, the user and/or other related exercise systems and users. For example, other related example depictions and descriptions herein identify beneficial use of equivalence evaluations for short and for long term graded exercise therapy plans or progressive workouts, comparisons with and preparations for meeting physical standards or performance tests, and usage with limitations for avoiding likely damage or injury thresholds during recovery or improvement periods. Further, default options for automatically evaluating and providing comparative equivalence information to a user can be beneficial for at least unweighted exercise sessions of a user of the MicroGravity system 3240 and either as a default or a preferred unsupported exercise session environment and arrangement.

Automatic Default Options; 'Responsive' EQ Results/Updates; Live, Mid-Session

Referring now to FIGS. 21 to 25, additional example schematic depictions of interfaces 5694A to 5694E are shown that are almost identical with one another except for being separated in time with respect to a UW MicroGravity overall "Workout" for a user spanning a series of several unweighted MG exercise sessions. The UW Workout 561R depicted includes a series of substantially non-stop or connected UW exercise sessions as part of an overall workout routine, which can be identified as separate or individual exercise sessions based on the user providing inputs, as an example scenario, for modifying settings or other values of exercise session output factors including unweighting for the MG exercise session 5620 and/or modified exercise parameter values for the unweighted exercise, as well as other potential changes, such modifying an exercise environment for the unsupported exercise session, such as from off-treadmill to on-treadmill. Each discrete group of values for exercise parameters and/or changed conditions including the default comparison condition of unweighting are considered as separate unweighted exercise sessions as discussed above along with FIG. 9A and related FIGS. The overall Workout 5618 can initially be established through or based on a Method 5650 for evaluating equivalence between an unweighted exercise session 5620 using the MG system 3240 and as a default, base selection, and an unsupported exercise session 5670 as a compare selection related to Method 5050. Each of FIGS. 21 to 25 depict an interface 5694A to 5694E for interactions with Computer/Interface Engine 5001/5001 and related actions of the Computer/interface Engine 5000/5001.

The Actions shown are for evaluating comparative equivalence therebetween between an unweighted exercise session 5620 and an unsupported exercise session 5670 regarding ongoing and automated repeated equivalence evaluations along with providing equivalence information to the user. Method 5650 and interfaces 5694A to 5694E generally include the same aspects, concepts and features described above for related interfaces and equivalence methods including, in particular, Methods 5450 and 5250 and related interfaces except as described herein. As such, like numbers refer to like features.

Method 5650 can be directed to evaluating equivalence between an unweighted MG exercise session 5620 and an unsupported exercise session 5670 including either an On-Tm or Oft-Tm exercise session similar to equivalence evaluations for Methods 5250 and 5450, for which evaluations of comparative equivalence can be performed in any order according to either the unweighted session or the unsupported session identified as the base selection. Further, default and/or preferential features pertaining to one or both of the unweighted and unsupported sessions can be identified for the Computer/Equivalence Engine 5000/5001 and automated repeat equivalence evaluations for unweighted exercise session interactions with the MicroGravity System 3240 and a user 5602 independent of actual performance, but which can also include automatic, live and ongoing equivalence evaluations along with providing related equivalence information to the user including for live exercise sessions. As described and discussed above along with Methods 5250 and 5450, either type of session (unsupported or unweighted) can be identified as a base selection, which can be provided in response to inputs for Change Condition values (e.g., % BW for UW) or input modifications of exercise parameters (e.g., incline % and/or run speed or pace).

Figure 21:
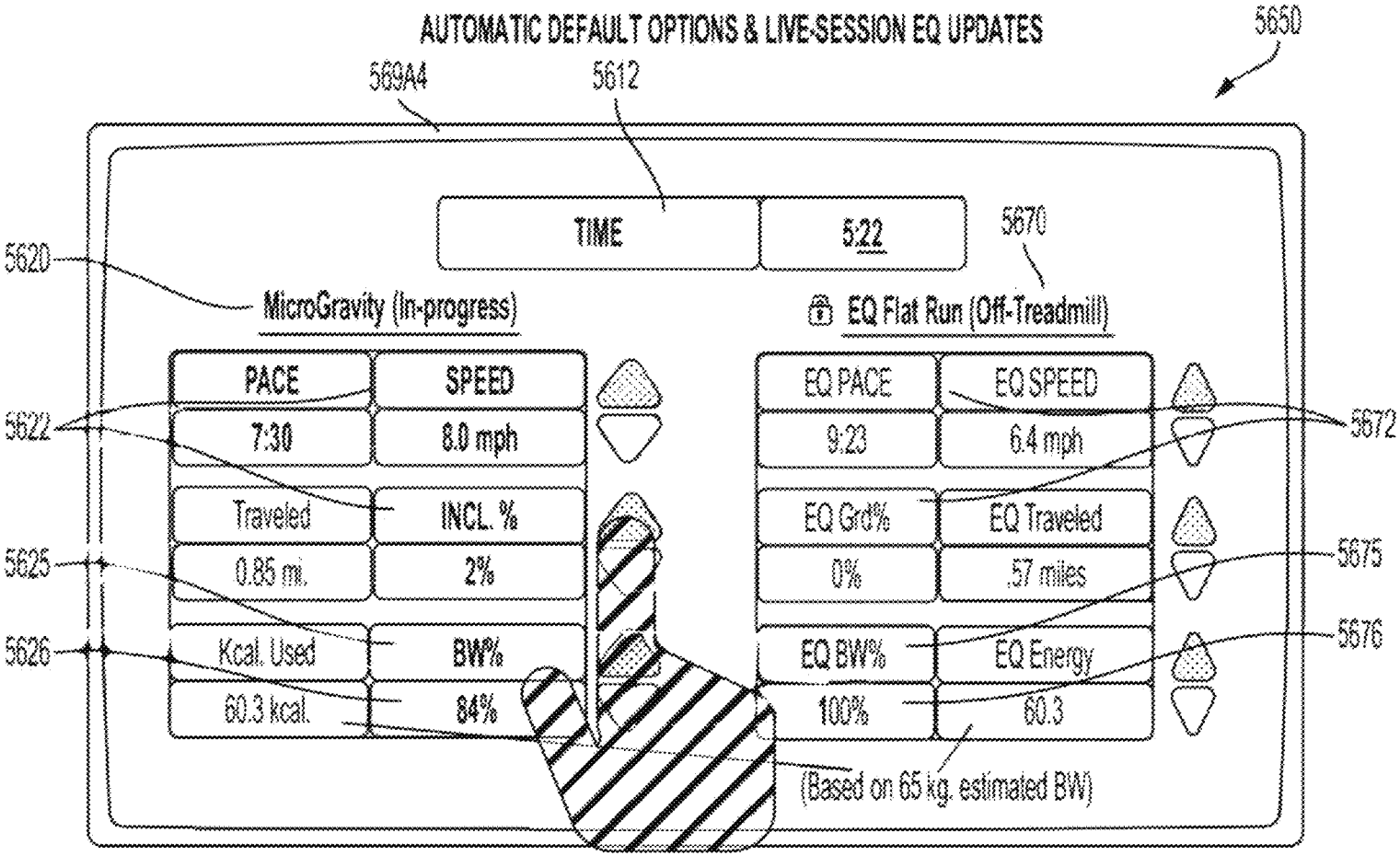
FIG. 21 is yet another example schematic representation of actions of the equivalence engine of the computer control system of FIG. 10 for a further method of evaluating comparative equivalence between an unsupported treadmill exercise session and an MG exercise session according to aspect, concepts and features described herein.

With particular reference to FIG. 21, equivalence evaluation defaults can be provided by a user, authorized person associated with the user, and/or another as preferences or system defaults for enabling automated and ongoing performance evaluations of exercise sessions of a user 5602, which can include exercise sessions performed by the user on the MG system 3240, such as actual unweighted MG sessions 5620 and/or exercise session planned for, under consideration, or otherwise being evaluated for the user. Further, such automated default values, preferences and information pertaining to evaluating equivalence for the user can be established for exercise sessions the user performs using the MG system 3240, such that equivalence evaluations can be performed for an ongoing exercise session and equivalence information for the session can be provided to the user during session performance. Further, input modifications for exercise output factors of the exercise session, such as changing a value for % BW or one or more values for the exercise parameters like incline % or run speed, can initiate an automated equivalence evaluation along with providing live equivalence information to the user during the session responsive to the changes.

For instance, assume that as system defaults or based on user inputs or preferences, the following can be established as base features for evaluating comparative equivalence of at least an unweighted MG exercise session for the user and an unsupported exercise session:

- Duration or Rate Value—Default to Rate (per min.) if not provided
- Two or More Exercise Sessions for Comparative Evaluations
  - At least one with UW and one unsupported (no UW or @ full bodyweight)
- Unweighted Microgravity Exercise Session @% BW (walk, jog or run)
  - UW (exercise output factor) (% BW)
    - Maintain previous % BW for a continuing session & partial changes
  - Exercise parameter (exercise output factors)
    - Both run speed (V) & incline as decimal for % (% I)
    - Maintain previous values if unchanged, ongoing session
- Unsupported Exercise Session (walk, jog or run)
  - UW (exercise output factor)
    - No UW; UW=full bodyweight or 100% BW
    - Default=Off-Treadmill flat run w/o environment inputs or preferences.
  - Exercise parameter (exercise output factors)
    - Both run speed & incline %
    - Maintain previous values if unchanged, ongoing session
    - Default to flat run, 0% incline if not ongoing or provided otherwise
    - Incline % (decimal)
- Metrics/Guidelines for Automated Evaluations
  - Microgravity Session Previously Evaluated or Underway
    - Input Modification of exercise output factor (% BW; V or % I)
      - Triggers EQ eval. update vs. unsupported.
    - Evaluation based on % BW. V & % I for MG session AS MODIFIED
      - New Output determined from continued/modified UW %, V & I
      - Reverse calculation of Unsupported V if flat run (no % I)
      - Reverse, iterative calcs, for Unsupported V & % I best fit.
  - No UW Session Underway or Previously Evaluated
    - Identify Sessions & Initial Selection of UW or unsupported session) w/
      - Exercise environment for each including On/Off TM
      - UW for each incl. % BW (MG session) & 100% BW (Unsup.)
      - Duration or rate (default to Rate as per min.)
      - Exercise Parameter for the base selection (e.g., V, % I)
    - Determine Exer. Output based n UW, V and/or % I
    - Compute (e.g., reverse calc.) V and/or % I for remaining selection
      - Reverse, iterative calcs, for best fit of V w/ % I or multi-EQ
      - Weigh according to optimization guidance, gait, or others prefs.
    - Reversible evaluation order/parameter combinations
      - Helpful use of Unsupported Sess. as initial sel. for therapy plans
      - Enable optimized EQ w/ V & I % such as for gait impact The example base features, defaults and guidance above can identify core information for evaluations of comparative equivalence involving the MG exercise device 3620 and an exercise environment, related automatic evaluation, functional defaults, and other information for the unsupported exercise session 5670. Based on this information and a corresponding functional framework for evaluating equivalence of flat-run, off-Tm exercise and corresponding unsupported, flat run exercise sessions with unweighted exercise and exercise sessions using the MG system 3240, automated default equivalence evaluations along with ongoing update actions are performed by the Computer/Engine 5000/5001 according to Method 5630 including providing live EQ updates to the user for the current session.

In short, for an example scenario corresponding with Workout 5618, Input for the EQ Engine for each of the Sessions A to D of the overall Workout 5618 includes and equivalence evaluation actions thereof includes the Equivalence Engine receiving as a base selection the unweighted MicroGravity exercise workout subsession being performed by the user using the MG system at values of the 1$^{st}$ exercise parameter 5622 for each of Session/Sub-Workout A to D indicated and at the unweighting indicated along with the comparative, Off-Tm flat run session at 100% bodyweight established for each comparative evaluation as follows A. Init. Sel.: UW MG session; UW=084BW; 1$^{st}$ Par.: V=8.0 mph: % I=0.02%
   Flat Run; Off-TM: V=6.4 mph
B. Init. Sel.: UW MG session; UW=0.84BW; 1$^{st}$ Par.: V=8.0 mph: % I=0.04%
   Flat Run; Off-TM: V=5.9 mph
C. Init. Sel.: UW MG session; UW=0.84BW; 1$^{st}$ Par.: V=8.0 mph: % I=0.00
   Flat Run; Off-TM: V=7.0 mph
D. Init. Sel.: UW MG session; UW=0.80BW; 1$^{st}$ Par.: V=8.0 mph: % I=0.00
   Flat Run; Off-TM: V=6.5 mph The Equivalence Engine 5000/5001 can include one or more default exercise environments established for representing comparative sessions of interest for most or many users of the MicroGravity exercise system and/or for preferred arrangements of the same input, which can be provided by particular users who have established preferred exercise settings that can be identified for comparative evaluation purposes with unweighted exercise sessions along with requisite corresponding values or information, such as denoting the MG exercise session 5620 as unweighted at a BW % input generally concurrent with performing the exercise session, and the comparative, Off-Tm flat run exercise session as unsupported and at full bodyweight for the default flat run exercise session 5670. In addition, exercise parameter defaults can be identified as incline % and run speed or pace values for each of the comparative exercise sessions according to user preferences.

As such, during operation of the DAP system 3240 for a user for unweighted exercise session performance that can being, for instance, according to user default preferences, receipt of inputs from the user or a support entity via the system interfaces 5694A to 5694D of FIGS. 21 to 25 to the Computer/Interface Engine 5001/5001 can occur, which can end performance of the initial default exercise session and being a modified unweight exercise session. Thus, modification of a value for an exercise output factor (e.g., unweighting value or exercise parameter value) for a session currently underway or being performed can automatically be considered by the Computer/Interface Engine 5000/5001 as receipt of a base selection of an exercise session for evaluating comparative sessions (i.e., selection of the unweighted MG session 5620 currently underway including maintaining UW and exercise parameter values for the MG session subject to receipt of input modifications) and evaluating equivalence for the unsupported session 5670). For instance, assume that FIG. 21 depicts an example scenario denoted as session or sub-Workout Abased on the default information discussed above that is currently underway for the user 5602 and the MG exercise system 3240 and the unweighted exercise session 5620, for which modification information for the unweighted exercise session can be received according to interactions with the interface 5694.

As noted at the outset of the present application, most users of unweighting exercise systems including the example MicroGravity system 3240 frequently inquire regarding what is or would a particular unweighted exercise session be equivalent with vs. and unsupported exercise session? Many users are competitive or professional athletes who are primarily interested in knowing comparative equivalence with Off-Tm exercise, which can include particular environment conditions for upcoming or regular events, tests or competitions for the user. Many other users are recovering from surgery or injuries and using the MG system 3240 as part of therapeutic or recovery regimens who are primarily interested in knowing comparative equivalence with On-Tm exercise, or for whom professionals involved with such regimens are primarily interested in knowing comparative equivalence with On-Tm or Off-Tm exercise primarily with respect to intensity or exercise output considerations and can benefit from graded exercise therapy involving or based on evaluations of comparative unweighted exercise for the user vs unsupported exercise therapy and standards.

For any of these users and many others having particular exercise interests and goats, significant interest exists and equally important benefits can be provided to the users and related persons by automatically evaluating and providing comparative equivalence according to default information including exercise environment, equipment and conditions including unweighted and unsupported arrangements for readily enabling comparative equivalence evaluations. As such, comparative equivalence evaluations can easily be performed along with corresponding results automatically provided or shown to the user based the Computer/Engine 5000/5001 receiving user inputs that modify values for an exercise output factor of an MG exercise session 5620 currently underway, which include modified values for unweighting (% BW) and modification of an exercise parameter such as incline % and run speed or pace.

Referring now to FIGS. 21 to 25, FIG. 21 depicts an initial example of steady state or existing conditions representative of an unweighted MG exercise session 5620, during performance of which the user or a support person is depicted as entering one or more inputs via the interface 5694A for modifying the current incline % of the MG exercise session. FIG. 21 shows an incline value of 2% incline at a "Workout" timer value representing a measure of "Time" completed for an overall "Workout" of five minutes and twenty-two seconds. As discussed further along with FIG. 25, an overall "Workout" can include a series of exercise sessions that can be performed under differing conditions, exercise parameters and periods, for which an overall time status shown as "Time" can measured and provided to the user.

The Time mark of 5:22 can mark the end of the first exercise session at the compare condition (e.g., UW at 84% bodyweight) and 1$^{st}$ exercise parameter (e.g., run speed of 8.0 mph and incline of 2%) due to receipt of the changed or modified incline % and corresponding changes occurring for the MG exercise system 3240 as depicted in FIG. 21. Upon receipt of the changed or modified incline % input from the user for increasing the incline to 4% for unweighted exercise on the MG exercise system 3240 along with the MG exercise system implementing the change, a subsequent or second MG exercise session 5620' begins as shown for the example interface 5694B of FIG. 22, which depicts an elapsed time often minutes (10:00) for the Workout. Under this and other similar scenarios, an equivalence evaluation can automatically be 'triggered' upon receipt of the change inputs for increasing the incline %.

Accordingly, the example Method 5650 as shown in FIGS. 21 to 25, as well as the computer/engine 5000/5001, MG system 3240, and related devices can be adapted for automatically evaluating comparative equivalence between an MG exercise session 5620 and at least another exercise session including an unsupported exercise session 5670 according to various preferences, preset triggers, and/or other factors or conditions including receiving changed or updated values for a condition or exercise parameter that affects exercise session output. The Method 5650 can be adapted for automatically performing (or re-performing) actions for evaluating comparative equivalence responsive to receiving the modified or updated information for the exercise sessions of the comparative group including modified or updated unweighting for one or more of the exercise sessions, for the $1^{st}$ exercise parameter, and/or for values or settings to be determined for the $2^{nd}$ exercise parameter. Upon detecting the receipt of such modified or updated information, the actions of Method 5650 and related comparative equivalence methods described herein can be repeated for evaluating comparative equivalence according to the modified or updated information.

Triggers and/or trigger events can include receipt of modified or updated information for conditions for an exercise session of the comparative group including for either an unweighted MG exercise session or an unsupported exercise session. The conditions can include a comparison condition, such as unweighting that can be established as a default comparison condition, as well as for other conditions that affect exercise output, such as an updated or modified input for an exercise environment. For instance, if the computer/equivalence engine receives information for updating or modifying the exercise environment for the unsupported exercise session from an off-treadmill session to an on-treadmill session, which affects exercise session output, a repeated evaluation of comparative equivalence can automatically be trigger and performed.

Figure 22:
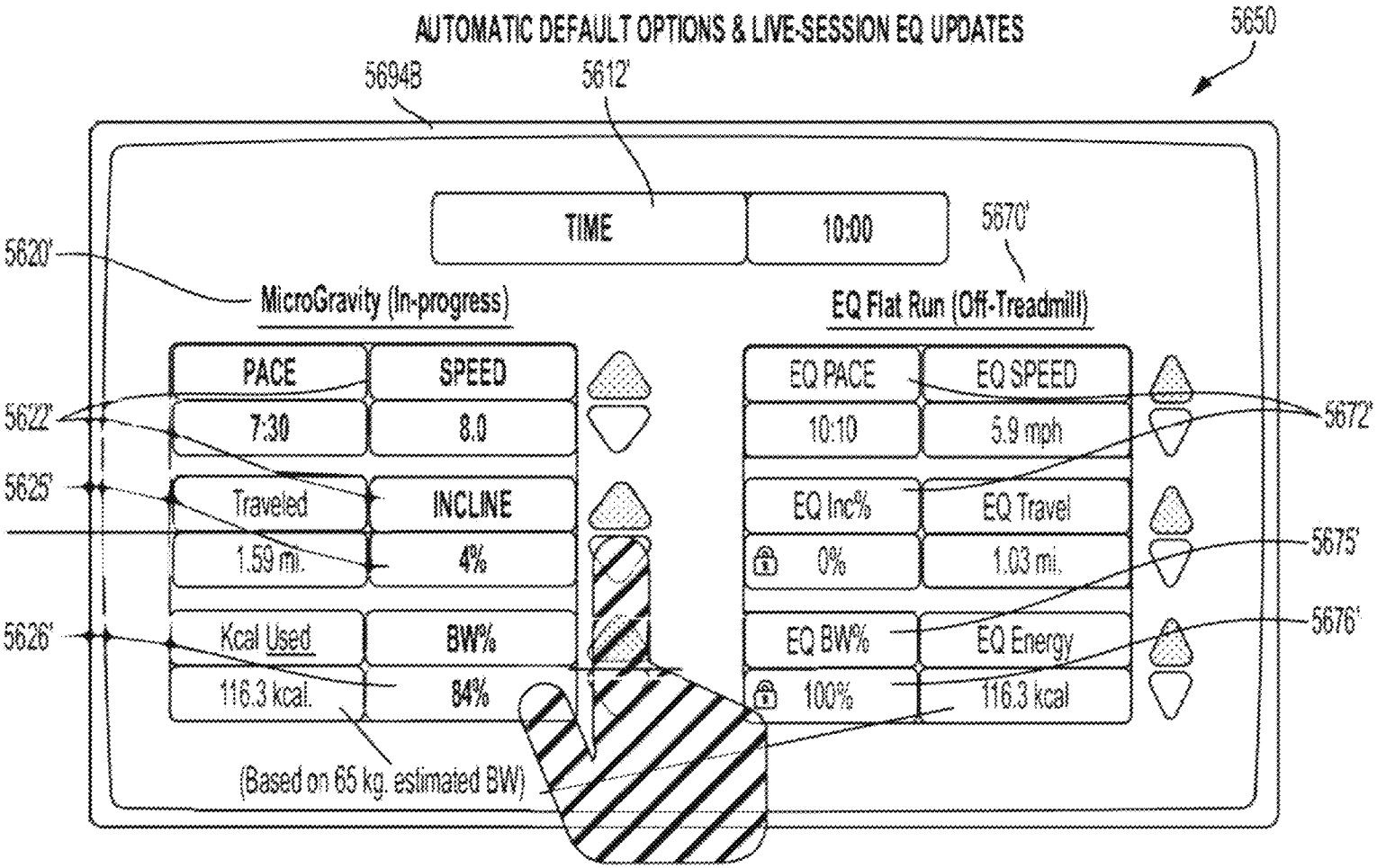
FIGS. 22, 23, 24 and 23 each show example schematic representations of interfaces with the computer control system of FIG. 10 for a method of evaluating comparative equivalence between an unsupported treadmill exercise session and an MG exercise session according to aspect, concepts and features described herein.

Similarly, the changed or updated values can include modified settings or values received for the $1^{st}$ exercise parameter (speed and/or incline settings) of the unweighted MG exercise as discussed above for FIG. 21. Resulting comparative equivalence information can thereby be automatically provided to the user or support entity for the repeat evaluation of comparative equivalence as shown for the updated EQ flat run (off-treadmill) values for comparative equivalence shown on the 2694B in response to the modified inputs for increasing incline from 2% to 4%. FIG. 22 further depicts the receipt of supplemental user inputs via Interface 5694B for a subsequent or second modification for the unweighted session underway at about the 10:00 mark for the Workout.

Figure 23:
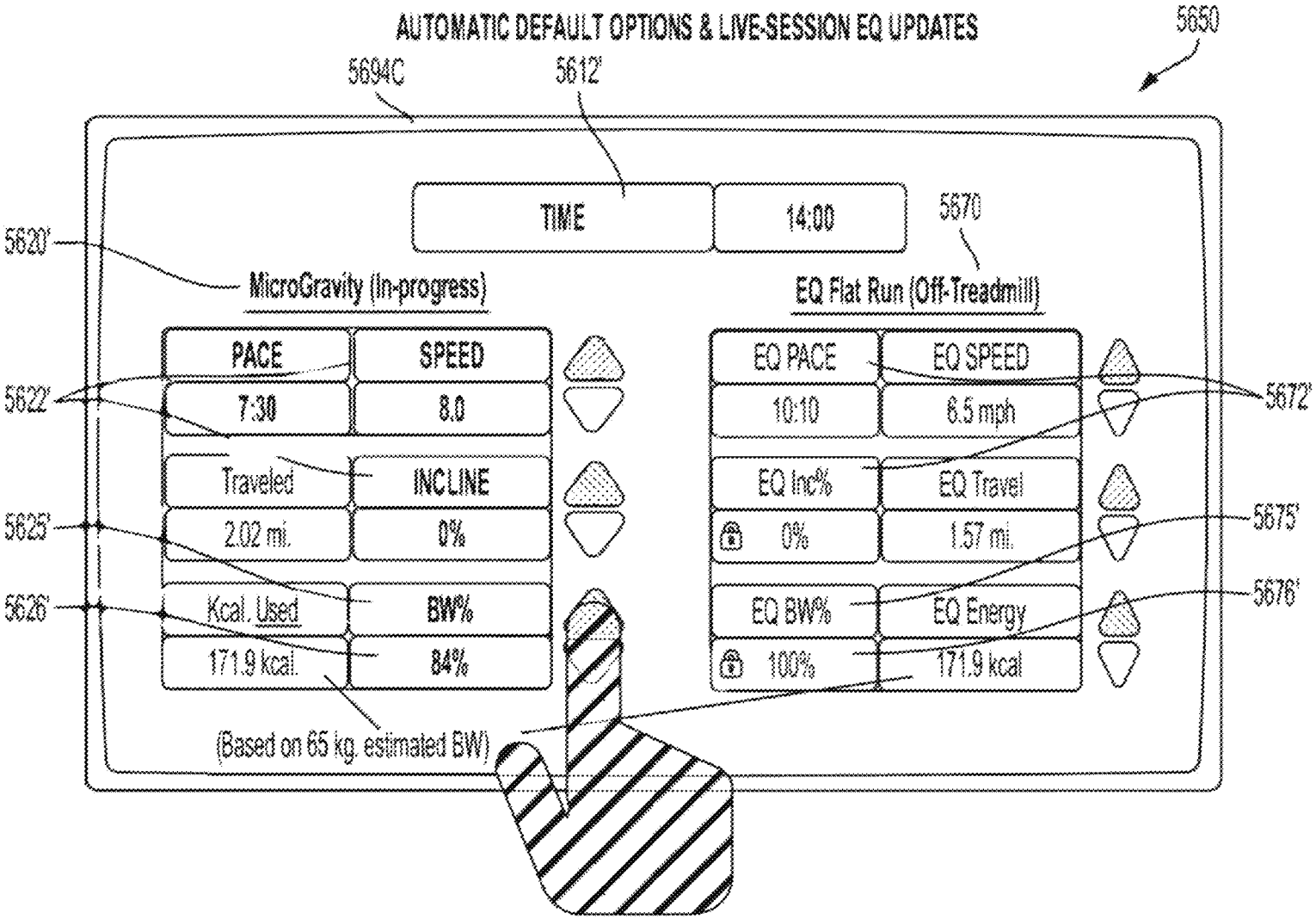

In a similar manner as described above for the first modification, upon receipt of a second input modification for a value of an exercise output factor including the $1^{st}$ exercise parameter 5622 and the unweighting, another equivalence evaluation is triggered along with automatic performance of actions for the evaluating comparative equivalence including providing resultant information to the user as an update depicted on FIG. 23, which shows an EQ Speed for the EQ Flat Run (Off-Treadmill) comparison estimated as 6.5 mph without incline for the MG session (% I set to zero). However, FIG. 23 also depicts a modification input occurring via interface 5694C at about the 14:00 of the overall Workout for receipt of a third modification for the unweighted session underway, which in this instance is for an updated or modified unweighting value for the current session rather than for an exercise parameter value.

Figure 24:
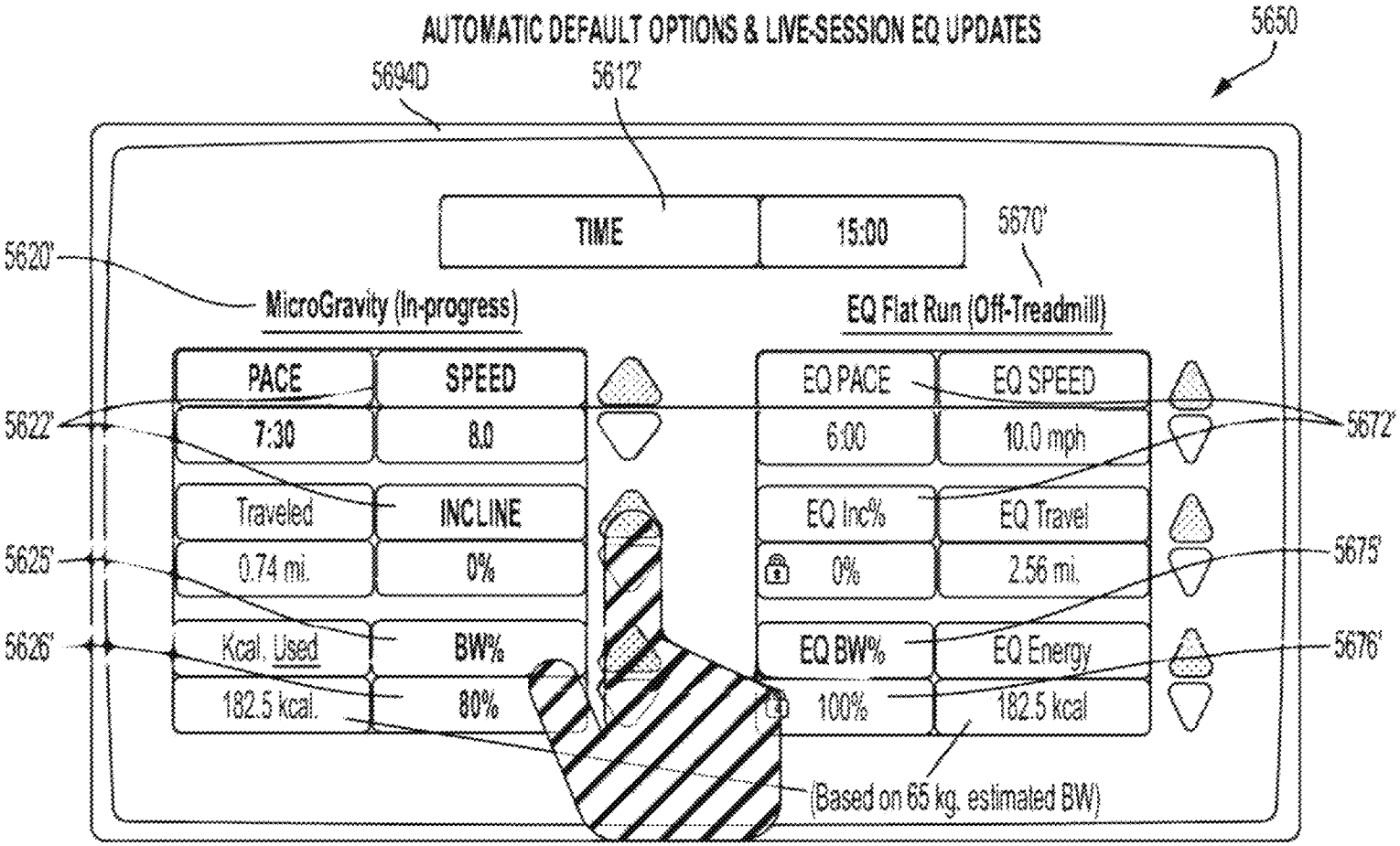

In a similar manner as automatic actions performed by the Computer/Interface Engine 5000/5001 discussed above with FIGS. 22 & 23 responsive to receipt of input modifications that affect exercise session output, upon receipt of a third input modification for a value of an exercise output factor including the unweighting as a modified value for % BW in this instance, a further equivalence evaluation is triggered along with automatic performance of actions for the evaluation including providing resultant information to the user as an update depicted on FIG. 24, which shows an EQ Speed for the EQ Flat Run (Off-Treadmill) comparison estimated as 10.0 mph for the % BW change for increasing unweight support applied to the user by 4% such that the % BW decreases from 84% BW to 80% BW. Although FIG. 24 depicts implementation/completion of the unweighting modification at a Workout time about one minute later than shown for FIG. 23, note that MicroGravity systems may or may not be able to implement modifications for UW of an exercise session currently underway quickly or easily, if at all without depressurization and pressurize routines or performing similarly complex actions.

Nonetheless, with respect to evaluating comparative equivalence automatically including providing equivalence information to the user, automated actions can be created for Computer/Equivalence Engine 5000/5001 such that equivalence evaluations can be automatically initiated and conducted via default exercise session arrangements and related instructions and preferences. Further, equivalence information can automatically be provided to the user based on the same as well as based on other trigger mechanisms and scenarios for doing so, which can provide significant benefits for users of MicroGravity systems and related professionals providing related therapeutic inputs or guidance.

With particular reference to FIG. 25, a further interface 5694E is shown related to interfaces 5694A to 5694E discussed above along with FIGS. 21 to 24 that is based on the same scenario and examples for Workout Sessions or Sub-sessions A to D. FIG. 25 is provided as a short follow-up in view of Examples A to D discussed above for demonstrating more expanded use beyond single sessions evaluations for Comparative Equivalence functionality, which can enable and provide a wide range of significant and beneficial information, features, and helpful evaluations for evaluating comparative equivalence between exercise sessions including UW and unsupported sessions, as well as other session types, for use for instance, with therapeutic training planning and session outlines, as well as for evaluating and considering equivalent exercise sessions for cumulative or overall information gained from multiple other sessions, such as identifying a single unweighted and/or a single unsupported exercise session that can be considered equivalent or substantially equivalent to a group of exercise session as depicted in FIG. 25 for the example sessions A to D discussed with FIGS. 21 to 24.

EQ Output—'Design' Benefits for Therapy/Session Planning

Figure 26:
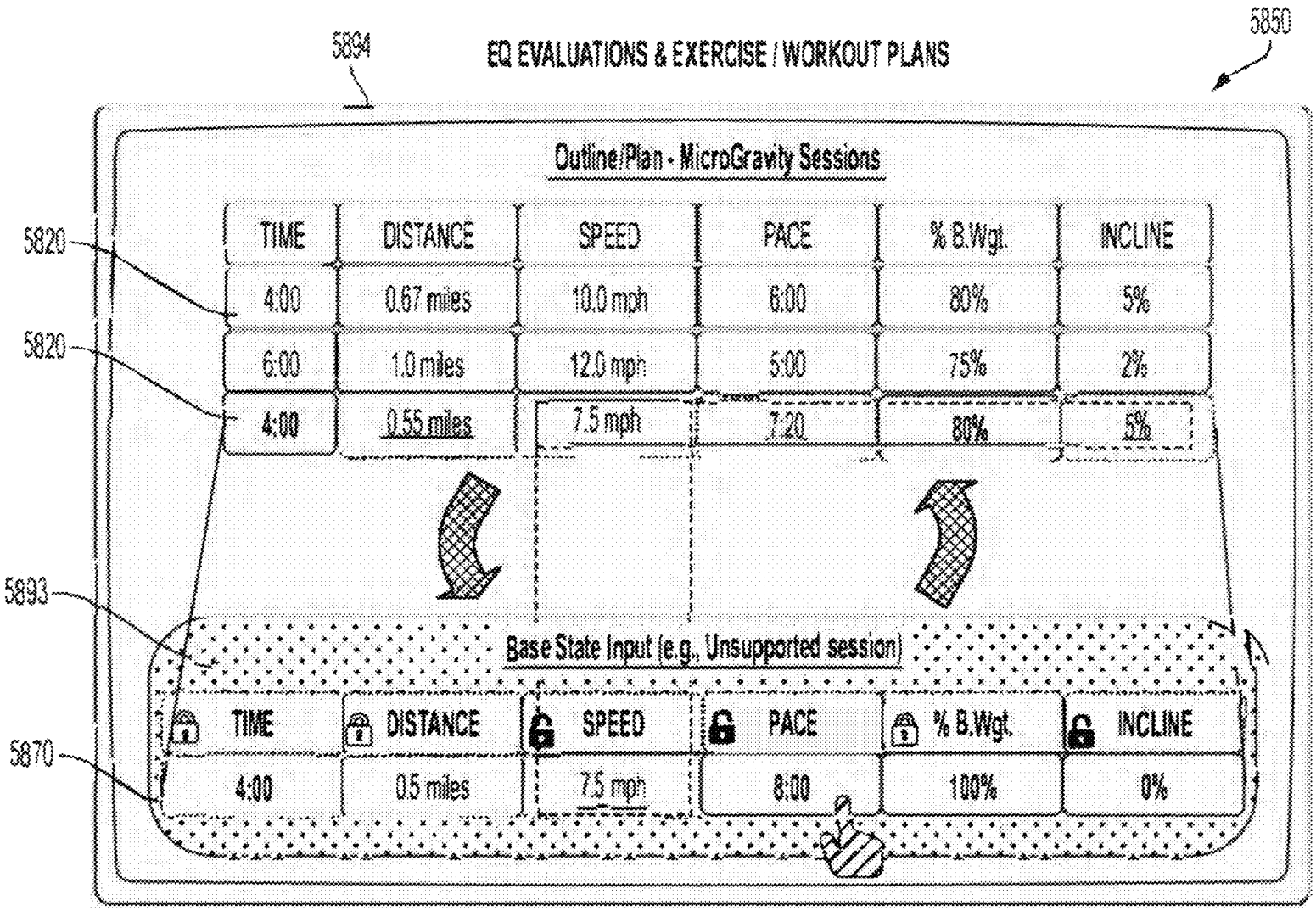
FIG. 26 is an additional example schematic representation of an interface with a computing device that can include the computer control system of FIG. 10 for a further method of evaluating comparative equivalence between an unsupported treadmill exercise session and an MG exercise session according to aspect, concepts and features described herein.

Referring now to FIG. 26, an example interface 5894 is shown for yet another example Method 5850 pertaining to evaluating equivalence of an unweighted exercise session and an unsupported exercise session in accordance with inventive aspects, concepts, and features described herein that generally includes features described previously except as noted hereafter. Accordingly, like numbers refer to like features. Method 5850 and the example scenario and arrangement including interface 5894 primarily differs from Method 5650 and similar methods and interfaces discussed above in that actions for evaluating equivalence (EQ) between exercise sessions including an unweighted and a non-unweighted unsupported exercise session are adapted for 'design' or planning purposes. As such, actions performed for Method 5850 can include providing to the user a 'method result' including equivalence information that can be entered automatically into an exercise schedule, fitness plan or workout framework for a person or patient, and/or that can act as or be considered an exercise session entry for the schedule, plan or framework.

For clarification purposes based on a comparison of interface 5694B depicted in FIG. 22 with interface 5894 depicted in FIG. 26, the first is directed to evaluations of comparative equivalence occurring automatically responsive to an input or modification trigger along with providing as a method result, equivalence information to the user and/or a support entity (e.g., display update of the exercise device, which can further be provided to a device worn by the user, a computer for a support person or entity, or other related devices). In contrast, the second interface 3894 and Method 5850 of FIG. 26 can be directed to a planning perspective or request scenario, such that the action for providing equivalence information can be provided to a support person or entity who, as an example, entered the base selection and related exercise information and/or for which the information is automatically entered as a session entry for a schedule, plan or framework of an exercise device user (e.g., equivalent exercise session entry).

Interface 5894 as shown can be directed to enabling and conducting interactions for actions of Method 5850 related to therapy considerations and/or exercise session planning, which can involve or incorporate actions and interactions for considering equivalence between UW exercise sessions and unsupported exercise sessions. As such, the example display of interface 5894 includes information about one or more MicroGravity exercise sessions 5820 and unsupported exercise sessions 5870 similar with examples discussed above, but involves actions and functionality different from previous examples and descriptions and that can be implemented or readily performed independent from an MG system or other related exercise system.

Functionality for evaluating comparative equivalence between multiple exercise sessions including an UW session and an unsupported session, such as Actions of Methods described herein including Methods 4950, 5050, 5250 and 5650, can be performed by a wide variety of computers and computing devices (not shown), such as a laptop computer, desktop computer, or mobile device. Further, the computing device (not shown) can include a cloud-based computing device hosted on enterprise servers as is known in the art, which can establish a virtual computer as a cloud resource or similar to provide ready access to an Equivalence Computer (not shown) adapted for performing Actions of Method 5850. The Equivalence Computer (not shown) can support comparative equivalence evaluations for a wide range of exercise environments, circumstances, scenarios and related devices and sensors as discussed above, which can be unrelated to a particular exercise device or system and widely accessible for access and usage by support persons or entities and MG system users. Further, such an Equivalence Computer can interact with a range of persons and entities of Method 5850 and perform actions thereof, which can occur and be performed for the benefit of or on behalf of patients or users of an unweighted MG exercise device.

For instance, medical professionals, athletic and therapeutic professionals and others often establish graded exercise therapy plans, regimens, outlines, arrangements and/or other exercise/fitness framework that include or involve similar unweighted and unsupported exercise sessions, for which inventive aspects, concepts and features pertaining to evaluating equivalence between sessions including an unweighted and an unsupported session can be incorporated. Doing so can provide a wide range of benefits including improved rehabilitation and recovery planning, enhanced accuracy and information regarding unweighted sessions, and enabling greater modification and adjustment flexibility on behalf of such persons and impacted patients/MG system users. Alternatively, the actions of Method 5850 can focus on unweighted exercise sessions for a particular MicroGravity device, system or family such that improved accuracy or evaluation results having high confidence levels can be obtained and provided to the user and/or support entity.

Interface 5894 shown in FIG. 26 depicts an example arrangement for taking advantage of comparative equivalence functionality from a 'design' perspective, such as for outlining or creating graded exercise therapy plans or fitness workouts for a patient or user. A Base State Input sub-interface 5893 can simplify entry of exercise device or session information associated with the base selection of a method user. For the scenario depicted, equivalence information for an unsupported session, such as an off-treadmill indoor or outdoor flat run that can include default exercise session information, is provided as a method result, for an unweighted MG session entry for a session or a plurality of sessions of a workout plan of an exercise device user. For instance, assume the exercise device user is person who is currently subject to exercise limitations from injury, surgery recovery, or other reasons encouraging use of unweighted support exercise sessions. The method user seeking or receiving the equivalence information and the exercise device user subject to limitations, for example, can be the same person or entity as well as different persons or entities.

EQ Results Weightings, Linear-Regression or Relationship-Based Evaluations

Figure 27:
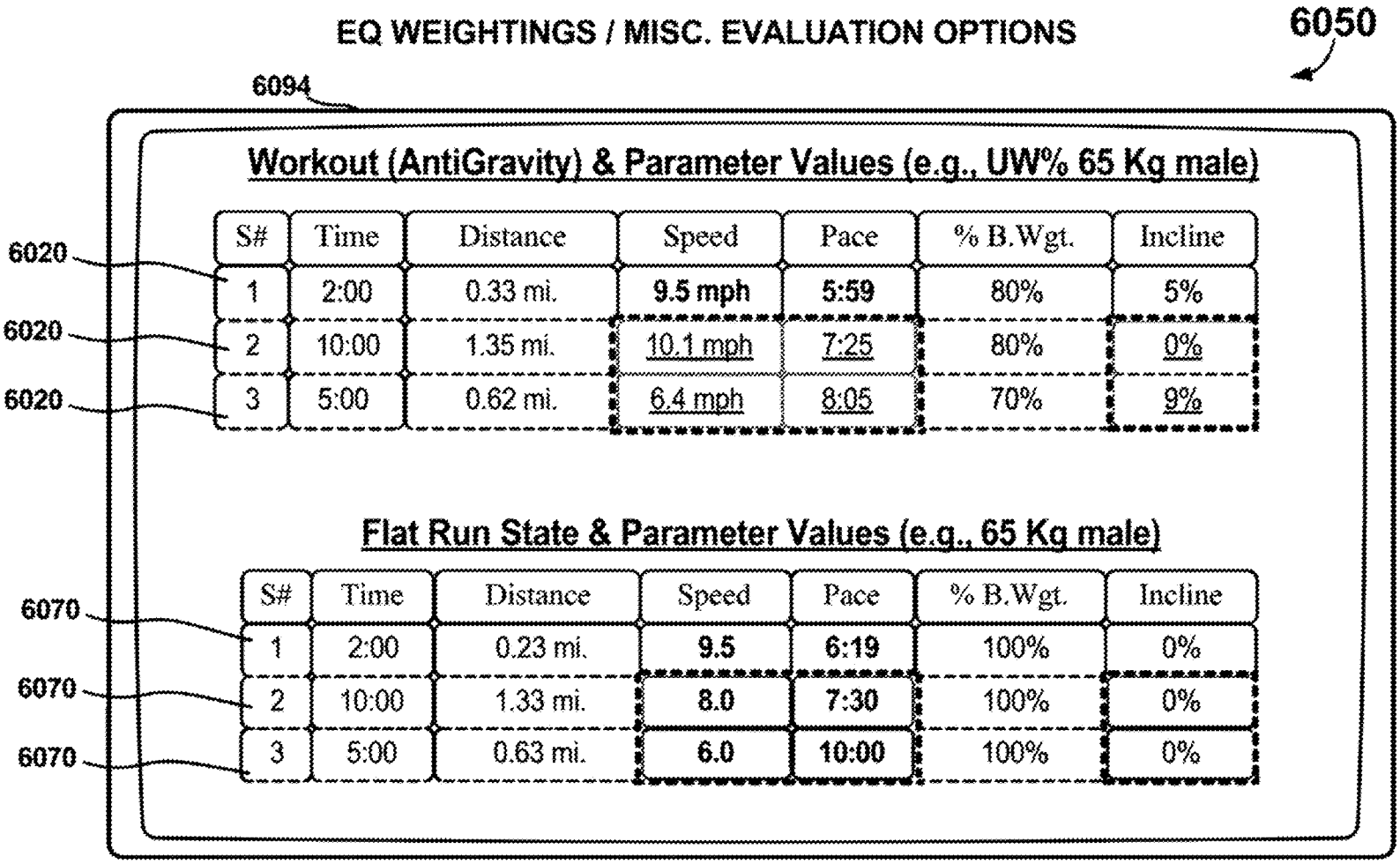
FIG. 27 is a further example schematic representation of an interface with a computing device that can include the computer control system of FIG. 10 for a further method of evaluating comparative equivalence between an MG and an unsupported treadmill exercise session according to aspect, concepts and features described herein.

Referring now to FIG. 27, an example interface 6094 is shown for yet another example Method 6050 pertaining to evaluating equivalence of an unweighted exercise session and an unsupported exercise session in accordance with inventive aspects, concepts, and features described herein that generally includes features described previously except as noted hereafter. Accordingly, like numbers refer to like features. Equivalence information provided as part of method result for Method 6050, such as for Sessions 2 and 3 of the sample list of sessions shown, can include comparative equivalence information that is weighted, guided or otherwise evaluated and comparative equivalence information determined according to user or system preferences, and as noted above along with other example methods, such evaluations of comparative equivalence can be evaluated, determined, calculated and provided to a user or other person based on various metabolic relationships, user attributes and data along with related subjective-based analytics, and technical resources according to aspects, concepts and features described herein.

As discussed along with earlier examples, equivalence information and results can often include a plurality of exercise session results that meet criteria for an equivalence evaluation, such as multiple combinations of run speed and % Incline. Method 6050 can include the corresponding computer or computing device performing a plurality of refinement iterations that can be weighted according to system defaults, user preferences, and related metrics such as confidence level or accuracy guidelines. As shown and highlighted for corresponding exercise sessions #2 and #3 of FIG. 27, equivalence information included as a result of Method 6050 and related methods discussed above can be guided or weighted to favor session options have the same or almost the same run velocity denoted as 'speed' in combination with incline % and/or unweighting values for comparative sessions having the same or substantially the same exercise output per unit time or duration.

Maintaining the same or similar run speed values for an exercise device user can limit or minimize changes for the device user pertaining to run characteristics including gait, stride length and stride frequency. Weighting options and comparative session results for matching or substantially matching run speed values can thereby limit or minimize errors or inaccuracies of comparative evaluation options, which can be subject to user or system preferences and other guidelines, such as research findings pertaining to relative increases of stride length or frequency with unweighting amount or similar reasons.

EQ and Standards, Requirements or Event Criteria Tests—Army Combat Test Example

Figure 28:
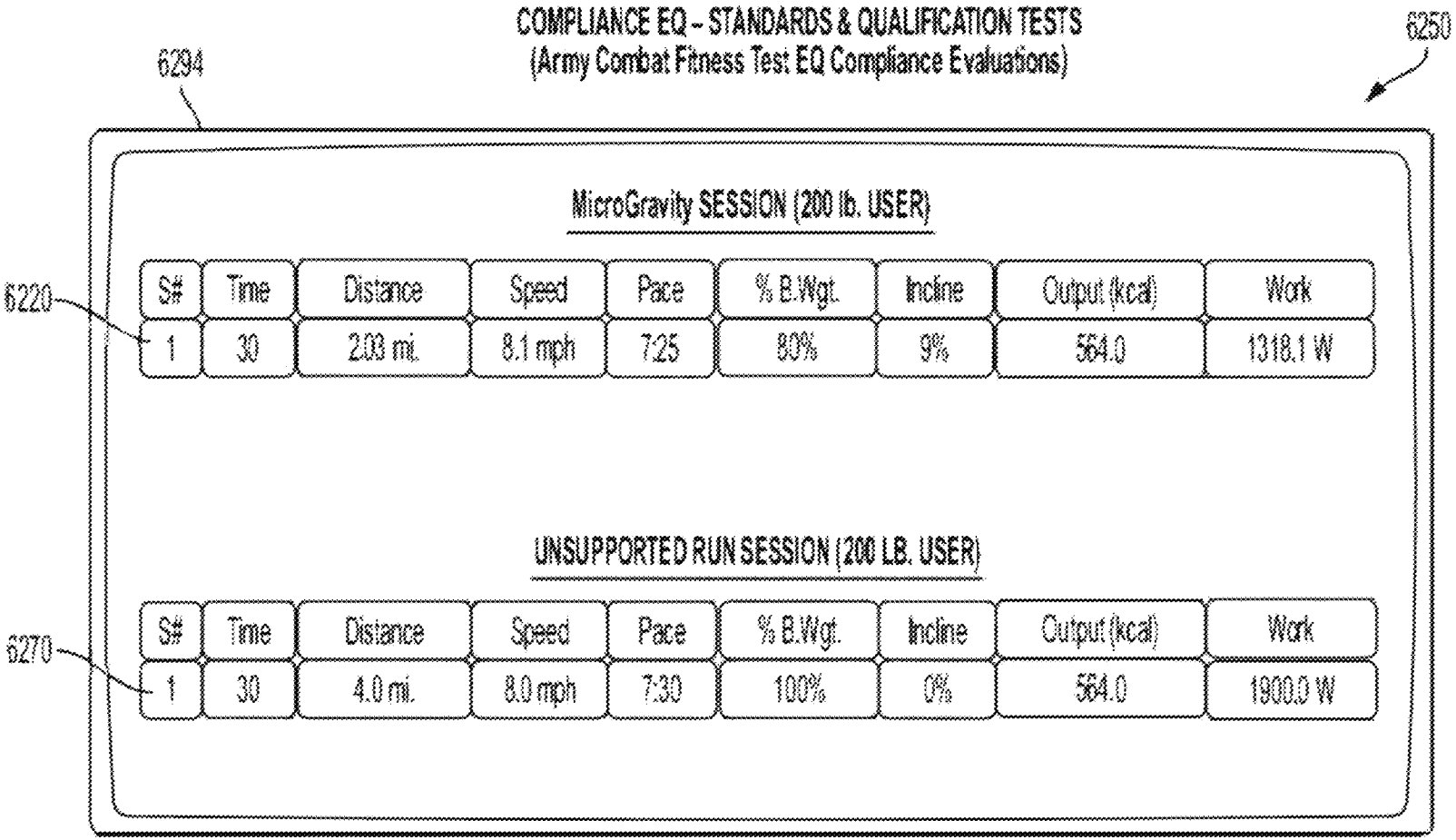
FIG. 28 is an additional example schematic representation of an interface with a computing device that can include the computer control system of FIG. 10 for a further method of evaluating comparative equivalence between an MG and an unsupported treadmill exercise session according to aspect, concepts and features described herein.
Figure 29:
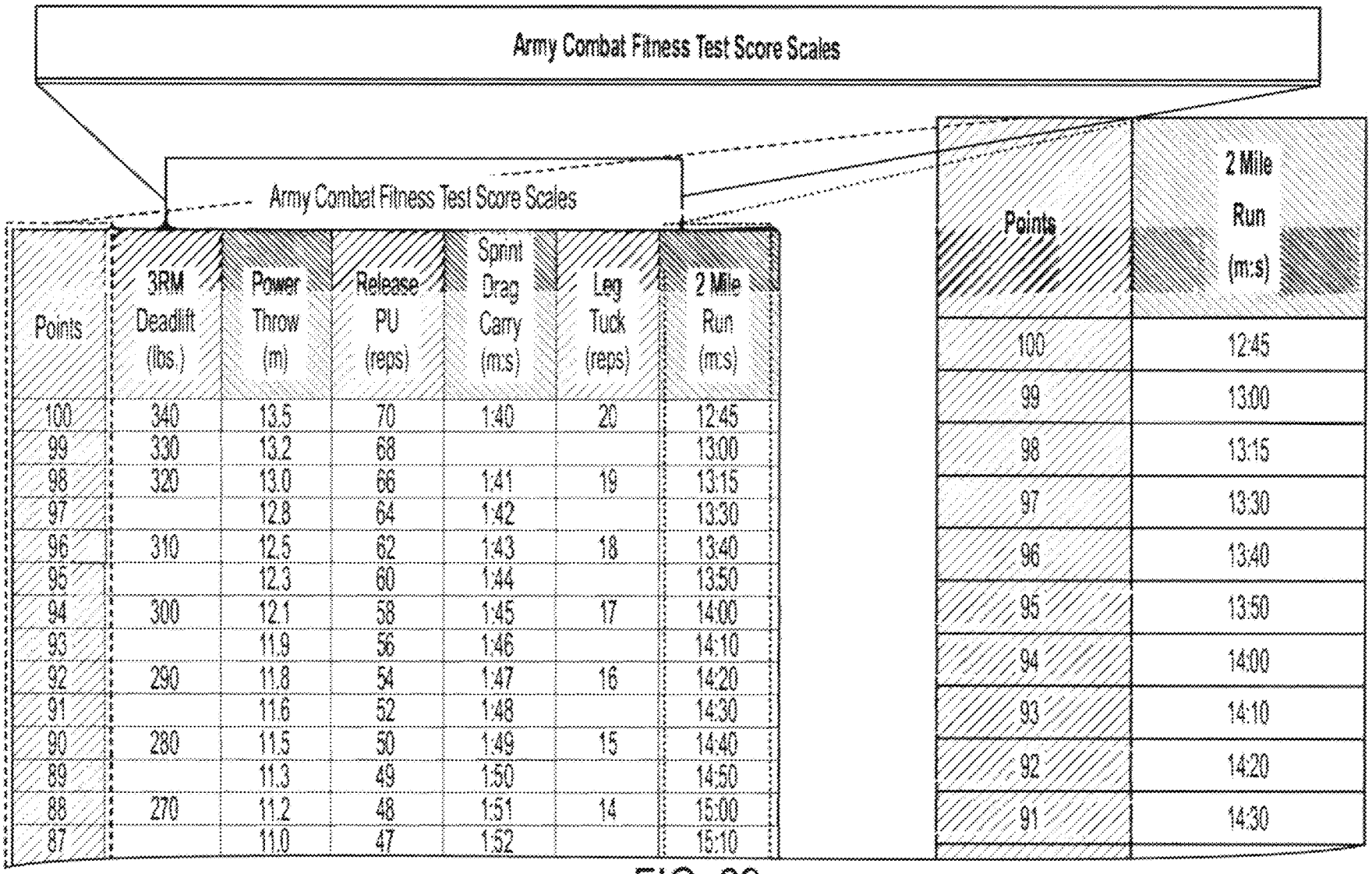
Figure 29:
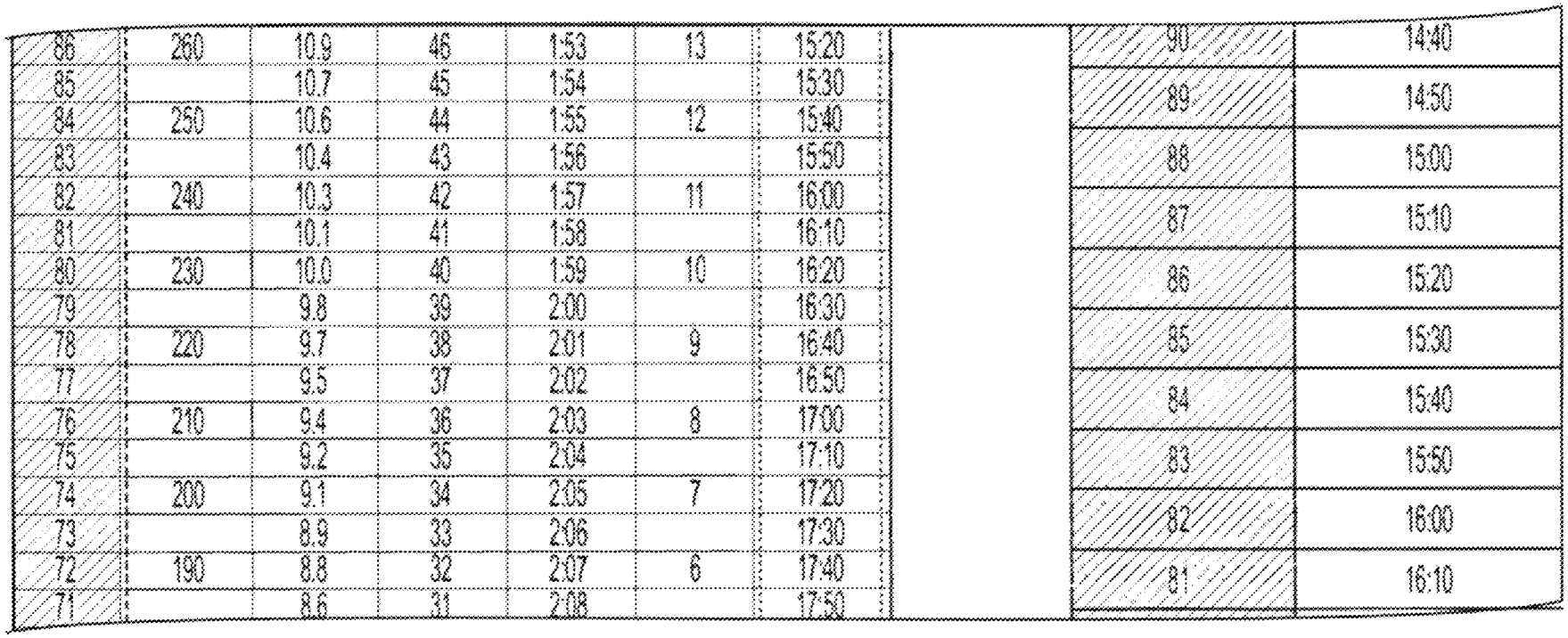
Figure 29:
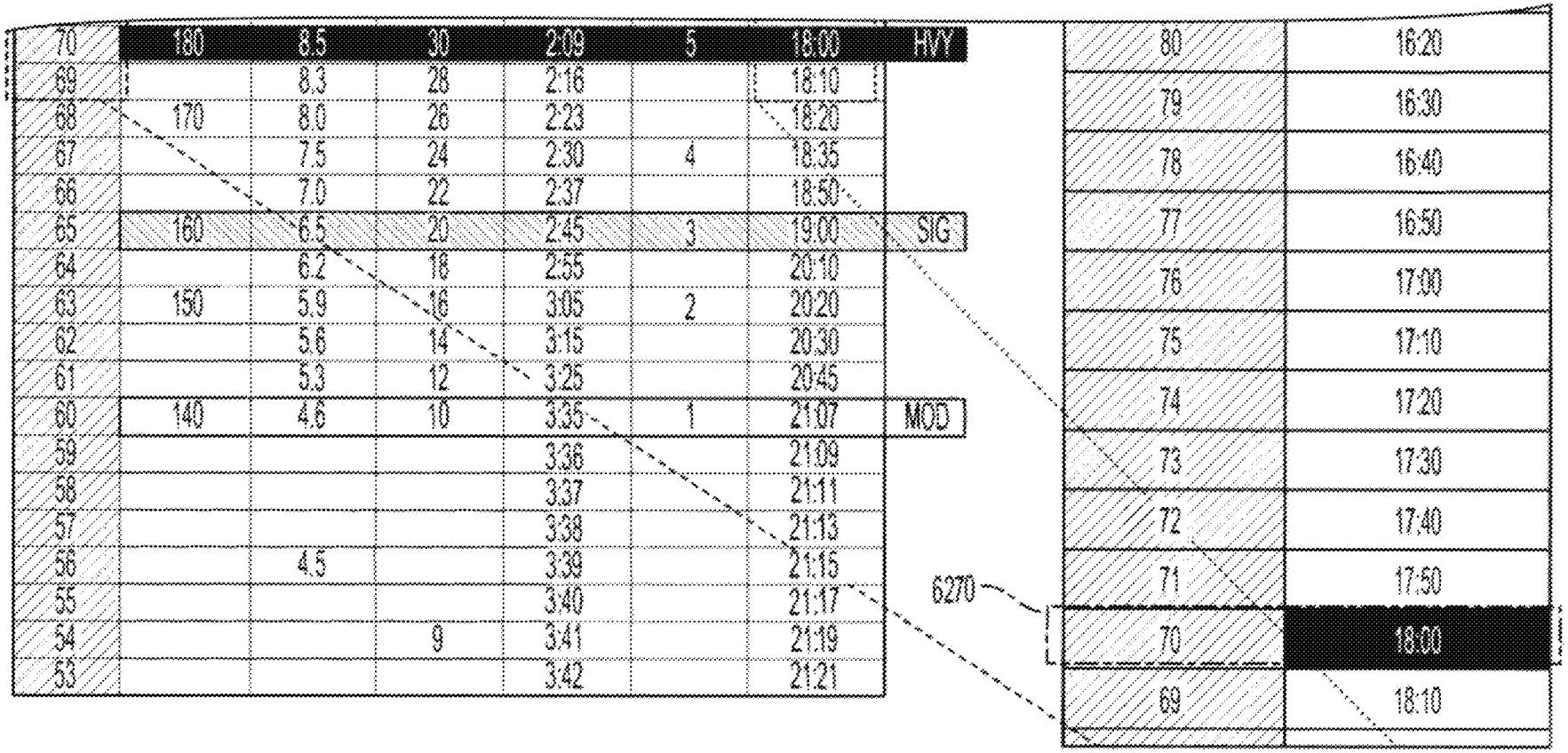

Referring now to FIGS. 28 to 30, an example interface 6294 is shown for yet another example Method 6250 pertaining to evaluating equivalence of an unweighted exercise session and an unsupported exercise session in accordance with inventive aspects, concepts, and features described herein that generally includes features described above for previous methods and interfaces, except as described herein. Accordingly, like numbers refer to like features. Interface 6294 and Method 6050 primarily differ from previous example interfaces and methods discussed herein in that comparative equivalence evaluations can be performed and method results provided for considering compliance with particular fitness standards, exercise session qualification requirements and other established criteria.

FIG. 28 shows a comparative equivalence interface 6294 having unsupported exercise session information 6270, as an example, for meeting minimum run test requirements of the Army Combat Fitness Test along with unweighted Micro-Gravity exercise session information 6220 for considering or demonstrating compliance for the Army standard, such as for accident, injury, recovery or other circumstances using an unweighted or other exercise device for performing a comparatively equivalent exercise session. FIGS. 29 and 30 depict portions of the Amy regulations or other references that identify criteria for the unsupported exercise session information 6270 of FIG. 28 and options or authority to consider equivalence options under Special Conditioning authorization or similar, as an example.

It is understood of course that numerous other examples of performance standards or fitness requirements exist for which evaluations of comparative equivalence can be performed and evaluation results provided, which can include other military-related requirements, service criteria for police or fire employment and positions and the like. Further, it is understood that authorization may or may not exist for demonstrating compliance with such a standard via an MG system or other equivalence option. However, in accordance with inventive aspects, concepts and features described herein, Method 6450 can include evaluating comparative equivalence and providing comparative equivalence information to a user, such that comparative equivalent information can provide preparation or training benefits for exercise device users, if not certified for official compliance evaluations.

Output and Cumulative Load Evaluations

Figure 31:
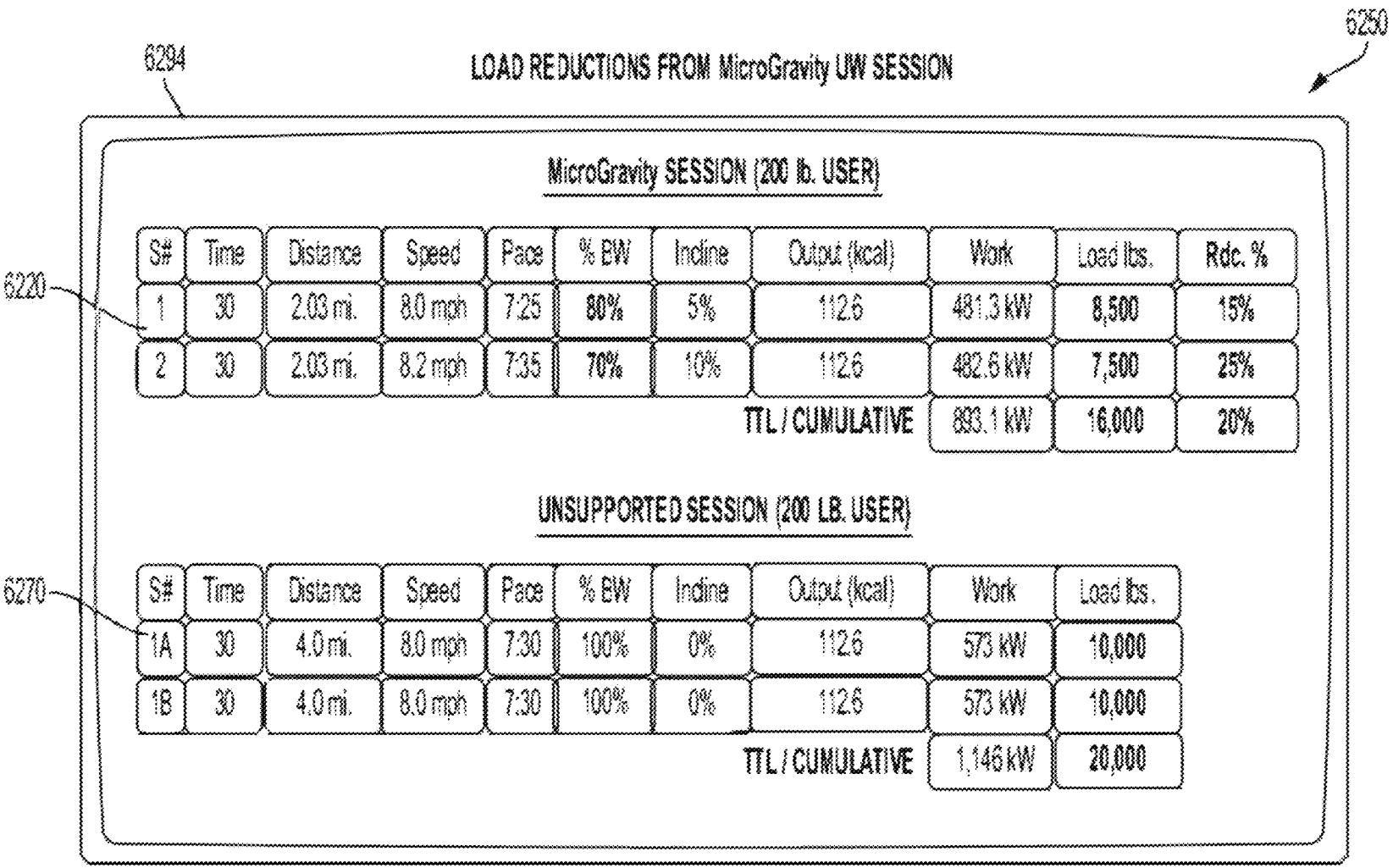
FIG. 31 is an example schematic representation of an interface with a computing device that can include the computer control system of FIG. 10 for an additional method of evaluating comparative equivalence between an MG and an unsupported treadmill exercise session according to aspect, concepts and features described herein.

Referring now to FIG. 31, an additional example user interface 6294 is shown according to aspects, concepts and features described herein pertaining to methods including Method 6450 pertaining to evaluating equivalence of an unweighted exercise session and an unsupported exercise session in accordance with inventive aspects, concepts, and features described herein that generally includes features described above for previous methods and interfaces, except as described herein. Accordingly, like numbers refer to like features. Method 6450 primarily differs from methods discussed above for evaluating comparative equivalence, in that Method 6450 further includes evaluating LOAD as a supplemental factor for an Unweighting Change Condition.

Conventional treadmills and other traditional, unweighting exercise equipment can show estimated exercise session output in terms of "kcal" burned, which can also be evaluated along with methods for evaluating equivalence discussed above and further shown to the user on an interface of the MG exercise system 3240. According to various example potential metabolic and other relationships discussed above, exercise session output values can be evaluated using normalized relationships that can include evaluating METS values in terms of output per min. per kg, mass of the user. As such, methods for evaluating comparative equivalence as discussed herein can be performed independent of the user's bodyweight.

In addition, estimates for Work performed by the user for an exercise session can be determined for both unweighted and unsupported exercise sessions, which can be provided in units such as "watts" as depicted for various example interfaces discussed and shown above and/or as a work rate as waits/sec. However, as indicated in FIG. 12 and discussed along with various example relationships, unlike normalized metabolic relationships including METS values that can be used for evaluating comparative equivalence for an unsupported exercise session vs. an unweighted MG exercise session according to Methods described herein including for Method 6250, evaluating Work or Work rate for an exercise session, whether unweighted or unsupported without unweighting, involves considering bodyweight or mass for the user. Further, unweighting support applied to the user for partially offsetting the user's bodyweight, affects Work and Work rate for an unweighted MG exercise session 6220 of Method 6250 and for related methods discussed above. Similarly, evaluating and/or determining Load values experienced by a user for an exercise session, as well as cumulative load on the user for a series of exercise sessions of the user, are related to the user's mass and affected by unweighting support applied to the user for MG exercise sessions.

On exercise bicycles, these can be determined or evaluated looking at resistance and cadence. On treadmills or for running exercises, such values can be determined or evaluated based on factors such as running speed and incline combined with mass or bodyweight of the user. MG Systems including 3240 as described herein and methods for evaluating comparative equivalence described herein including Method 6250, can additionally evaluate exercise factors and impacts on the user that are related directly to bodyweight or mass of the user, such as Work, Work Rate and/or Load for the exercise session of the comparative group along with providing, to the user and/or support entity, comparative information for these values along with other comparative equivalence information.

The example interface 6294 shown in FIG. 31 includes, for instance, estimated Work values in Watts and estimated Load in lbs. experienced by the user for each of the exercise sessions of the comparative group including unsupported exercise session 6270 and unweighted MG exercise session 6220, as well as total values (e.g. for Work) and cumulative values (e.g., for Load) for multiple exercise sessions as depicted in FIG. 31. Further, Reduced % is shown for the Loads experienced by the user for the unweighted MG exercise sessions 6220 for the example % bodyweight values for the unweighting associated with each of the MG exercise sessions.

MG Systems described herein and related control computer systems can evaluate output for a user run session based, for instance, on (speed & % grade & % bodyweight). In a particular example in which the user's weight can be reduced by 16% due to unweighting benefits applied, a session output could be evaluated more accurately based, for instance, on (speed & % grade) & (% bodyweight×0.84). Such a determined output could be provided to the user as an output value in watts, calories burned or as a volume of oxygen used represented as $VO_2$.

As a particular implementation example, the following relationships can be calculated by the MG System and provided as an output to the user (e.g., as kcal for a session):

USER OUTPUT(METS/kg/min.)=(1−(−(1.1302*% BW)+1.2045))*((3.5+(0.2*v))+(0.9*v*G))/3.5, where:

METS=Metabolic Equivalent of Task in ml $O_2$/kg/min. and can be converted to kcal on the basis of 5 kcal/L of $O_2$:

% BW=body weight % (in decimal form);

v=velocity in meters/min; and

G=% gradient (in decimal form); such that

AVERAGE POWER (Watts)=average calories*69.5; and

TOTAL WORK (kJ)=(average power*workout duration in seconds)/1000.

Further aspects, features and benefits related to controls and evaluation of exercise sessions for MG Systems described herein and with related applications can include cumulative load evaluations, as well as saved cumulative load regarding reduction in cumulative load enabled for a user based on unweighting benefits. For instance, if a user weighing 200 lbs runs at an average pace of eight (8) miles per hour for a full hour, an estimate of cumulative load could be determined for exercising with MG System unweighting benefits, as well as a comparative load without unweighting benefits and providing comparative information for cumulative load savings. Such an estimate pertaining to load determinations can be based on ground reaction forces for the person of a given weight (e.g. 200 lbs) while running at a specific speed (e.g., eight miles per hour) for a particular period (e.g., one hour).

Assuming for discussion purposes, a cumulative load for the person running during an exercise session without MG System assistance is about 20,000 lbs for the workout, which is depicted in FIG. 31 for the unsupported exercise sessions 6270 identified as session #1A and #1B for present scenario. Assume further as a comparison that the same person uses an MG System described herein for a comparative equivalent MG exercise session 6220, but that instead of running at full body weight the user runs for 30 min at 80% bodyweight and 30 min at 70% bodyweight, which is depicted in FIG. 31 for session #1 and #2 using MG exercise system 3240. Method 6250, MG Systems and corresponding computer controls described herein can be arranged for determining a cumulative load for the user and session in view of unweighting benefits encountered, which for instance could determine the user encountered 16,000 lbs of cumulative load for the session instead of the full 20,000 lbs. cumulative load, in which the user's body saved or avoided impacts for 4,000 lbs of load vs. similar exercise without gained benefits from the MG System.

As shown in FIG. 31, LOAD can be determined for an unsupported session based on exercise output factors, such as velocity and pace along with user weight, which can be estimated for the user. Further, custom LOAD data can be received for the user including detailed load data and previous calculations, such as can be measured using pressure plates, sensors including accelerometers and strain gages, and the like. Reduced values for estimated LOAD can be evaluated along with evaluations of comparative equivalence according to Method 6250 in a similar manner as related methods described for previous examples and provided to the user and/or support entity along with providing comparative equivalence information. Because Load experienced by the user while running is generally directly related to the mass or bodyweight of the user, Load reductions experienced by the user for unweighted exercise sessions likewise are typically reduced according to the unweighting % support applied to the user, such that an unweighting of 20% applied as upward support for the user for an unweighted value of 80% bodyweight typically reduces Loads experienced by the user for the MG exercise session 6220 by a corresponding amount, or for a reduction of 20%. Similarly, upward applied unweighting of 30% for an unweighted value of 70% bodyweight for an MG exercise session can likewise reduce Loads experienced by the user by 30%.

Evaluating and estimating Load experienced by a user for exercise sessions involving running, whether unsupported or unweighted, can be determined based on attribute and exercise data for the user including sensor data or related measurements. For many users, such data can be provided to the computer/equivalence engine 5000/5001 from which reduced Load estimates can be determined according to Method 6250 and provided to the user and/or support entity along with comparative equivalent MG exercise session 6220 information as shown in FIG. 31. However, in the absence of user attributes, exercise data measurements, and/or related analysis and determinations for similar exercise sessions performed by the user, Reduced Load % can be evaluated and provided to the user or exercise support entity.

The Reduced Load % can be evaluated and determined for the MG exercise session 6220 according to Method 6250 along with evaluating comparative equivalence of the same with an unsupported session based on the unweighting % applied as upward support for the user Evaluating a reduced % for Load can include evaluating a standard deviation or error % applicable for evaluating exercise session output based on the 1$^{st}$ exercise parameter of the base selection and unweighting for each session of the comparative group according to Method 6250 in the same or similar manner as described above for related methods for evaluating comparative equivalence. The % error or standard deviation % evaluated can be applied to the upward unweight support % applied to the bodyweight of the user for each MG exercise session 6220 for determining a Reduced % for Load experienced by the user for the MG exercise session 6220. Thus, as shown in FIG. 31 and corresponding with the example scenario described above, for session #1 having an upward unweighting of 20% applied to the user for the MG exercise session 6220, a Reduced % of Load is determined as a 15% Reduced %, such that a Load of 10,000 lbs, experienced by the for running 8.0 mph for 30 minutes of unsupported, flat run exercise, can be reduced by 15% so that the user experiences a reduced Load of 8,500 for an equivalent exercise session at 80% bodyweight. Similarly, for unsupported run exercise at 8.0 mph for 30 min., an MG exercise session 6220 at 30% upward unweighting applied to the user for an unweighting of 70% bodyweight, the Reduced % can be determined as 25%, As such, the Load of 10,000 lbs. determined for the unsupported exercise session 6270 can be reduced to a Load of 7,500 lbs. for the comparative MG exercise session 6220.

Thus, a cumulative Load of 20,000 that the user would experience for the unsupported exercise session 6270 identified as #1A and #1B for above scenario can be reduced by 20% for a cumulative Load applied to the user of 16,000 lbs. for the comparative equivalent MG exercise sessions 6220 identified as session #1 and session #2 in FIG. 31. Thus, the user and/or support entity can consider information for lower LOAD values along with comparative equivalence information for unsupported vs. unweight exercise and effectively use the same as tool for enhancing unweighted exercise benefits while minimizing or avoiding injury.

Although various arrangements and embodiments have been described as having particular features and/or combinations of components, other embodiments and arrangements are possible having a combination of any features and/or components from any of embodiments or arrangements as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

We claim:

1. A method for evaluating comparative equivalence between an unsupported exercise session and an unweighted MicroGravity (MG) exercise session for a user of a MG system wherein a bodyweight of the user is reduced for the unweighted MG exercise session, the MG system comprising a computer, an MG treadmill, and an inflatable enclosure operable for partially unweighting the user, the method comprising:

receiving, by the computer, for a comparative group comprising the unweighted MG exercise session and the unsupported exercise session:

an unweighting associated with each exercise session of the comparative group; and a $1^{st}$ exercise parameter for a base selection from the comparative group, the $1^{st}$ exercise parameter comprising a first run speed and a first incline;

evaluating, by the computer, a session output for the comparative group based on the first run speed, the first incline, and the unweighting associated with the base selection, the evaluating comprising determining a $2^{nd}$ exercise parameter for a comparison selection based on the session output and the unweighting associated with the comparison selection, the comparison selection comprising an exercise session selected from the comparative group that is different from the base selection, the $2^{nd}$ exercise parameter comprising a second run speed and a second incline, wherein the session output is substantially the same for the base selection and the comparison selection; and providing, by the computer, to the user, the session output and comparative equivalence information comprising the second speed and the second incline.

2. The method of claim 1, wherein for the providing to the user the session output and comparative equivalence information, the session output comprises at least one of:

a determined work or power output in watts;

an energy output in calories or kilocalories;

a volume of oxygen used represented as $VO_2$;

a cumulative load estimate; and a cumulative load reduction.

3. The method of claim 1, wherein:

for the receiving, the unweighting associated with the unsupported exercise session is the bodyweight of the user;

for the evaluating a session output for the comparative group:

the determining comprises reverse calculating, by the computer, the $2^{nd}$ exercise parameter from the session output evaluated for the base selection, such that the session output is substantially the same for the unweighted exercise session and the unsupported exercise session; and the evaluating the session output is performed based on at least one of exercise data for the user and attributes received by the computer for the user;

wherein the exercise data for the user comprises at least one of sensor data, $VO_2$ max measurements or calculations, fitness data, expelled gas information, heart rate data, perceived intensity feedback, and historical exercise data for related exercise sessions of the user.

4. The method of claim 1, wherein:

the method for evaluating comparative equivalence is performed as part of a method for controlling a MG system during use by the user for performing the unweighted MG session as a current unweighted exercise session, the evaluating performed substantially concurrently with the user performing the current unweighted exercise session;

for the receiving for the comparative group, the base selection for the comparative group comprises the current unweighted exercise session and the $1^{st}$ exercise parameter comprises the first run speed and the first incline for the current unweighted exercise session;

for the evaluating the session output for the comparative group, the comparison selection comprises the unsupported exercise session and the $2^{nd}$ exercise parameter for the comparison selection comprises the second speed and the second incline; and for the providing to the user the session output and comparative equivalence information, the providing is performed in real-time substantially concurrently with the user performing the current unweighted exercise session;

wherein real-time comparative equivalence information is provided to the user during performance of the current unweighted exercise session.

5. The method of claim 4, wherein for the evaluating the session output for the comparative group:

the unsupported exercise session comprises exercise device environment parameters selectable as one of default or user-selected parameters;

the second incline comprises an incline % selectable as one of a default or user-selected incline %; and the providing to the user the session output and comparative equivalence information performed in real-time comprises providing to the user baseline comparative equivalence information relative to the unsupported exercise session having the default or user-selected exercise device environment parameters and the default or user-selected incline %.

6. The method of claim 5, wherein:

the exercise device environment parameters are selected according to user default comparative equivalence preferences comprising user-selected exercise device environment parameters;

the user-selected exercise device environment parameters comprise environment parameters for an off-treadmill, flat run unsupported exercise session; and the user-selected incline % comprises an incline % corresponding with a level exercise gradient, the incline % comprising zero % according to user preferences for default comparative equivalence preferences.

7. The method of claim 5, wherein the user-selected exercise device environment parameters and the user-selected incline % correspond with an exercise arrangement identified as familiar for the user for providing user-customized comparative equivalence information in real-time for user evaluation of the current unweighted exercise session.

8. The method of claim 5, further comprising:

on condition of receipt of one or more modification inputs for the current unweighted exercise session, by the computer, modifying control values for at least one of the $1^{st}$ exercise parameter, the $2^{nd}$ exercise parameter or the unweighting associated with the current unweighted exercise session, and reperforming, by the computer, the method for evaluating comparative equivalence based on the modified control values associated with the current unweighted exercise session combined with any unmodified values the associated with the current unweighted exercise session;

wherein the user is provided, by the computer, the session output and comparative equivalence information corresponding with the modified control values as real-time comparative equivalence information.

9. The method of claim 1, wherein:

the unweighted MicroGravity exercise session and the unsupported exercise session each comprises one of a walking session; a running session; and the first run speed comprises one of a first running velocity and a first walking velocity;

the second run speed comprises one of a second running velocity and a second walking velocity;

the second incline is different from the first incline; and in response to the receiving, the computer automatically performs the evaluating and the providing.

10. The method of claim 1, wherein:

the evaluating further comprises:

setting, by the computer, the second run speed to one of a matching or an adjusted best match run speed;

analyzing, by the computer, at least one potential value for the second incline for combining with the matching or the adjusted best match run speed such that the matching or the adjusted best match run speed combined with the second incline provides substantially the same session output; and for the providing, on condition the potential value provides substantially the same session output, the session output and comparative equivalence information further comprising the combination of the potential value for the second incline with the matching or the adjusted best match run speed.

11. The method of claim 10, wherein for the setting the second run speed, the matching or the adjusted best match run speed are each calculated, by the computer, for optimizing one of a temporal spatial factor and a kinetic response, the temporal spatial factor comprising one of a cadence and a stride length, the kinetic response comprising one of a ground reaction force (GRF), an estimated load, a GRF impulse, and a perceived pain input.

12. The method of claim 1, wherein the evaluating the session output comprises:

calculating an unweighting (UW) factor for the base selection based on the unweighting associated with the base selection;

calculating a metabolic output for the base selection based on the $1^{st}$ exercise parameter; and calculating the exercise output for the base selection based on the UW factor and the metabolic output.

13. The method of claim 12, wherein for the evaluating the session output for the comparative group:

the calculating the metabolic output comprises determining, by the computer, a Metabolic Equivalent of Task (MET) for the base selection, wherein the MET is substantially the same for the comparison selection.

14. The method of claim 12, wherein, for the evaluating the session output for the comparative group:

the calculating the metabolic output comprises performing, by the computer, normalized, weight-independent and user-attribute independent calculations.

15. The method of claim 12, wherein, for the evaluating the session output for the comparative group:

the calculating the metabolic output for the base selection comprises determining, by the computer, the metabolic output according to a metabolic output relationship substantially comprising $((3.5+(0.2*v)+(0.9*v*G))$ where the v comprises a velocity in meters/min, and the G comprises a % grade in decimal form.

16. The method of claim 12, wherein, for the calculating the UW factor for the base selection:

on condition the unweighting comprises the unweighting percentage of the bodyweight, the unweighting percentage comprises a percentage bodyweight for the MG exercise session; and the calculating the UW factor for the base selection comprises assessing the UW factor based on an unweighting relationship comprising $(1-((-1.1302*(\%BW))+1.2045))$ where the % BW comprises the percentage bodyweight in decimal form of the bodyweight of the user.

17. The method of claim 12, wherein, the evaluating the session output for the comparative group further comprises:

calculating, by the computer, an estimated run environment factor (REF) for the base selection; and adjusting, by the computer, the metabolic output for the base selection based on the estimated REF to compensate for a run environment impact for a plurality of run environment options comprising outdoor off-treadmill exercise, indoor off-treadmill exercise, powered treadmill exercise, user-powered treadmill exercise, and unsupported MG treadmill exercise;

wherein the calculating the estimated REF for the base selection comprises calculating, by the computer, the estimated REF factor based on the unweighting relationship of the UW factor, wherein the estimated REF is determined based on a reduced percentage bodyweight of about 94% to about 98% of the bodyweight of the user.

18. The method of claim 1, wherein:

the MG exercise session is a first MG exercise session of the MG system for the user;

the unweighting is a first unweighting;

the base selection is a first initial selection;

the unsupported exercise session is a first unsupported exercise session;

the comparison selection is a first remaining selection; and the exercise output is a first exercise output; and the comparative equivalence is a first comparative equivalence;

the method further comprising evaluating a second comparative equivalence between a second unsupported exercise session and a partially unweighted second MG exercise session for the user, the evaluating the second comparative equivalence comprising:

receiving, by the computer, for a second comparative group comprising the second MG exercise session and the second unsupported exercise session:

a second unweighting associated with each exercise session of the second comparative group, the second unweighting associated with the second MG exercise session comprising a second unweighting percentage for reducing the bodyweight of the user for the second MG exercise session, the second unweighting associated with the second unsupported exercise session comprising no change in the bodyweight of the user; and a $3^{rd}$ exercise parameter for a second base selection from the second comparative group, the $3^{rd}$ exercise parameter comprising a third run speed and a third incline;

evaluating, by the computer, a second session output for the second comparative group based on the third run speed, the third incline, and the second unweighting associated with the second base selection, the second evaluating comprising determining a $4^{th}$ exercise parameter based on the session output and the unweighting for a comparison selection, the comparison selection comprising an exercise session selected from the second comparative group that is different from the second base selection, the $4^{th}$ exercise parameter comprising a fourth run speed and a fourth incline, wherein the second session output is substantially the same for the base selection and the comparison selection; and providing, by the computer, to the user second session output and second equivalence information comprising the fourth speed and the fourth incline.

19. The method of claim 1, further comprising:

receiving, by the computer, an input selection of a supplemental compare condition for a supplemental equivalence evaluation of the comparison selection;

formulating, by the computer, a supplemental compare condition factor value for the comparison selection based on the supplemental compare condition;

re-evaluating, by the computer, the $2^{nd}$ exercise parameter for the comparison selection based on the unweighting; and providing, by the computer, to one of the user and a support entity for the comparison selection, adjusted session output and comparative equivalence information comprising the adjusted $2^{nd}$ exercise parameter;

wherein the supplemental compare condition comprises one of a weight change, a modified body composition, a performance footwear, an elevation, a gradient, a blood flow restriction, and an environment comprising one of an outdoor run, a treadmill run, or non-treadmill exercise device session.

20. The method of claim 1, further comprising:

obtaining, by the computer, attribute data for the user, the attribute data comprising one or more of the following:

a bodyweight value for the user;

gait information for the user, the gait information comprising at least one of cadence information and stride length;

historical exercise and performance date for the user;

estimated height information;

the user's age;

the user's sex;

metabolic test data for the user;

sensor inputs, feedback, historical data, and current data;

exercise monitor evaluation and determination data;

heart rate information;

body composition information comprising fat percentage and free fat percentage; and a plurality of biomechanical characteristics and run performance features for the user;

analyzing, by the computer, the attribute data according to equivalence engine processes for one or more of: adjustment factors, trends, metabolic feedback, and user limitations; and customizing the determining for the comparison selection the $2^{nd}$ exercise parameter for the comparison selection according to the analyzing the attribute data.

21. A method for controlling a MicroGravity (MG) system during use by a user for an unweighted MG exercise session wherein a bodyweight of the user is partially unweighted, the MG system comprising:

an inflatable enclosure having a base and a top opening defined therein adapted for attachment with a user seal interface, the inflatable enclosure adapted to extend upward when inflated operable for partially unweighting the user;

an MG treadmill having a run surface oriented at an adjustable gradient;

a platform retaining the MG treadmill in an exercise arrangement with the MG system, securing the base of the inflatable enclosure to the platform above the MG treadmill, and enabling user access through the inflatable enclosure and the platform to the run surface during use; and a computer operatively connected to the MG treadmill and with an inflation source coupled to the MG system in an airtight connection;

wherein a user seal worn by the user comprises the user seal interface adapted for airtight attachment with the top opening for unweighted use of the MG system by the user;

the method comprising:

evaluating, by the computer, a first session output of a non-unweighted exercise session for the user at the user's bodyweight based on:

a first run speed for the non-unweighted exercise session; and a first % grade for the non-unweighted exercise session;

evaluating, by the computer, a second session output of the unweighted MG exercise session for the user that corresponds with the non-unweighted exercise session and comprises a reduced % bodyweight for the user less than the user's bodyweight, the evaluating based on:

reduced % bodyweight options for the unweighted MG exercise session;

at least one second run speed for the unweighted MG exercise session; and at least one second % grade for the unweighted MG exercise session;

wherein the unweighted exercise session corresponds with the non-unweighted exercise session for the user, and the second session output is evaluated based on an additional factor for the reduced % bodyweight of the user;

determining, by the computer, the second session output, the at least one second run speed, the at least one second % grade, and the reduced % bodyweight for the unweighted MG exercise session;

operating, by the computer, the MG system for retaining the user in an exercise arrangement with the MG system and proceeding with the unweighted MG exercise session;

inflating, by the computer, the inflatable enclosure comprising operating the pressure source to inflate the inflatable enclosure to an unweighting pressure for partially unweighting the bodyweight of the user for the reduced % bodyweight;

operating, by the computer, the MG treadmill for translating the run surface at the second run speed and orienting the run surface at the second % grade for the unweighted MG exercise session; and providing, by the computer, to the user, unweighted session output information comprising the determined second session output, the at least one second run speed, and the at least one second % grade.

22. The method of claim 21, wherein:

the determining the second session output of the unweighted MG exercise session for the user comprises evaluating a reduction to the user's body for the unweighted MG exercise session at the reduced % bodyweight compared with the non-unweighted exercise session for at least one of ground reaction forces (GRF), GRF impulses, load, and cumulative load; and providing, by the computer, to the user, reduced effects information comprising the the evaluation reduction.

23. The method of claim 21, further comprising the method for evaluating comparative equivalence of claim 1, wherein:

the unsupported exercise session is the non-unweighted exercise session;

the comparative group comprises the non-unweighted exercise session and the unweighted MG exercise session;

the unweighting associated with the non-unweighted exercise session is the bodyweight of the user;

the unweighting associated with the unweighted MG exercise session is the reduced % bodyweight;

the base selection is the non-unweighted exercise session and the $1^{st}$ exercise parameter for the base selection comprises the first run speed and the first % grade;

the comparison selection is the unweighted MG exercise session and the $2^{nd}$ exercise parameter for the comparison selection comprises the at least one second run speed and the at least one second % grade; and the evaluating the session output for the comparative group comprises the actions for evaluating the first session output, evaluating the second session output and determining the second session output, the at least one second run speed, the at least one second % grade, and the reduced % bodyweight.

* * * * *